US006046538A

United States Patent [19]

Hishiki et al.

[11] Patent Number: 6,046,538

[45] Date of Patent: Apr. 4, 2000

[54] DEFLECTION YOKE AND YOKE CORE USED FOR THE DEFLECTION YOKE

[75] Inventors: Hideo Hishiki, Iwai; Tsutomu Yashiro, Mito; Takao Watanabe, Noda, all of Japan

[73] Assignee: Victor Company of Japan, Ltd., Yokohama, Japan

[21] Appl. No.: 09/023,811

[22] Filed: Feb. 13, 1998

[30] Foreign Application Priority Data

| | | | |
|---|---|---|---|
| Feb. 17, 1997 | [JP] | Japan | 9-049643 |
| Mar. 4, 1997 | [JP] | Japan | 9-065457 |
| Mar. 4, 1997 | [JP] | Japan | 9-065458 |

[51] Int. Cl.[7] ..... H01J 29/70

[52] U.S. Cl. ..... 313/440

[58] Field of Search ..... 313/440, 426, 313/430, 431, 432, 433

[56] References Cited

U.S. PATENT DOCUMENTS 5,475,066 12/1995 Nikles et al. .

FOREIGN PATENT DOCUMENTS

| | | |
|---|---|---|
| 0 112 577 | 7/1984 | European Pat. Off. . |
| 0 145 178 | 6/1985 | European Pat. Off. . |
| 0 400 716 | 12/1990 | European Pat. Off. . |
| 59-123141 | 7/1984 | Japan . |
| 61-124038 | 6/1986 | Japan . |
| 6-325961 | 11/1994 | Japan . |
| 8-180816 | 7/1996 | Japan . |
| WO 92/20522 | 11/1992 | WIPO . |

*Primary Examiner*—Vip Patel

*Attorney, Agent, or Firm*—Michael N. Meller; Eugene Lieberstein

[57] ABSTRACT

The present invention provides a deflection yoke for deflecting an electron beam emitted from an electron gun of a CRT (cathode ray tube). The deflection yoke is mounted on the CRT at a position between a neck tube having a small diameter section and a funnel having a large diameter section of the CRT. The deflection yoke comprises a horizontal deflection coil for deflecting the electron beam in a horizontal direction in the CRT, a vertical deflection coil for deflecting the electron beam in a vertical direction in the CRT, and a yoke core having a cone shape with a large diameter part at one end thereof in a side of the funnel and a small diameter part at another end thereof in a side of the neck tube to allow the yoke core to cover the horizontal and vertical deflection coils. The yoke core is made of a molded magnetic material cured by heating. The molded magnetic material includes a binder comprising a resin and a magnetic powder treated with a surface treatment agent comprising a compound having an aminoquinone group as a constitution unit.

30 Claims, 39 Drawing Sheets

DEFLECTION YOKE AND YOKE CORE USED FOR THE DEFLECTION YOKE

BACKGROUND OF THE INVENTION

1. Field of the Invention

The present invention relates to a deflection yoke used in a CRT (cathode ray tube) and a yoke core used for the deflection yoke, particularly relates to a deflection yoke capable of readily compensating misconvergence and a yoke core having precise dimensions and excellent magnetic characteristics with a less core loss such as an eddy current loss.

2. Description of the Related Art

In a color CRT (cathode ray tube) display device used as a display device of a computer such as a personal computer and a computer network, or as a display device for a high definition picture, there is required a high precision display performance with a less color deviation and a less geometrical distortion.

Therefore, in a deflection yoke system (referred to as deflection yoke) for generating magnetic fields to deflect electron beams in both horizontal and vertical directions, there is required a high precision performance of the generated magnetic fields to meet a required specification.

FIG. 1 is a perspective view of a CRT mounted with a deflection yoke.

As shown in FIG. 1, a CRT as an enclosed tube generally comprises a panel 1, a funnel 2 and a neck tube 3. Further, the deflection yoke 4 generally comprises a horizontal deflection coil (not shown here), a separator (not shown here) made of a plastic material, a vertical deflection coil (not shown here) and a deflection yoke core 5 (referred to as yoke core). The yoke core 5 is mounted so as to cover outer portions of the horizontal and vertical coils.

The deflection yoke 4 is mounted on the funnel 2 which is inserted from a distal end of the neck tube 3. The deflection yoke 4 deflects the electron beams emitted from the electron guns provided in the neck tube 3.

The funnel 2 nearby the distal end of the neck tube 3 has a circular cone to allow a good productivity of the CRT. The cross section of the funnel 2 at any position is made to be circular, and a center of the cross section coincides with an axis of the CRT.

Generally, the yoke core 5 of the deflection yoke 4 which is mounted on the funnel 2, has a circular cone shape corresponding to the shape of the funnel 2.

The yoke core 5 having the circular cone shape is formed as follows.

FIG. 2 is a section showing a metal mold for producing a yoke core, and

FIG. 3 is a plan view showing a lower metal mold of the metal mold shown in FIG. 2.

As shown in FIG. 2, on a supporting base 10 defining a receiving hole 9, there is fixed a lower metal mold 11. As shown in FIG. 3, there is formed a pair of projecting ribs 15 on an inner wall of the lower metal mold 11 to face each other with respect to a center line 11*a* of the circular section of the lower metal mold 11 for forming separation grooves 14 on the yoke core 5 to allow the yoke core 5 to be separated into two pieces after molded.

Further, there is formed a pair of projections 15, 15 for forming a pair of attachment grooves on the yoke core 5 on both sides of each of the projection ribs 14, 14. In the receiving hole section 9 formed at a center thereof, a part of an upper metal mold 13 is snugly fitted.

Between the lower metal mold 11 and the upper metal mold 13, a ferrite magnetic powder 12 made of Mg—Zn, Ni—Zn or Mn—Zn is poured, and the magnetic powder 12 is molded into a predetermined shape by pushing the upper metal mold 13 downward in a direction shown with an arrow A1 as shown in FIG. 2.

A primary product for the yoke core 5 mentioned above is referred to as a molded product 5' hereinafter.

FIG. 4 is a perspective view of a molded product for the yoke core; and

FIG. 5 is a section along an A—A line shown in FIG. 4.

The molded product 5' is shown in FIG. 4. After sintered, the molded product 5' turns into the yoke core 5. As mentioned hereinafter, when the molded product 5' is sintered, the dimensions thereof are slightly decreased because of contraction. In FIG. 4, both the yoke core 5 and the molded product 5' are shown with an identical figure by neglecting the change of dimensions after sintered.

Referring to FIG. 4, there are formed separation grooves 6, 6 and attachment grooves 7, 7 formed at both sides of each separation groove 6 for attaching metal fittings 8, 8 in the molded product 5' (yoke core 5). As shown in FIG. 5, an inner wall 5*a'* (5*a*) of the molded product 5' (yoke core 5) has a cone shape.

After sintered, the molded product 5' (yoke core 5) are separated into two parts by making use of the separation grooves 6, 6. Then, the two parts are mounted on an outer surface of an assembly of the horizontal and vertical coils which are mounted on an outer and inner surface of a separator (not shown) having a cone shape as mentioned hereinafter, and are integrally joined by inserting the metal fittings 8, 8 into the attachment grooves 7, 7.

Next, a description is given of a process for forming the yoke core 5 by sintering the molded product 5'.

FIG. 6 is a section of the molded product before sintered;

FIG. 7 is a section of the molded product after sintered;

FIG. 8 is a perspective view of a sintering holder, and

FIG. 9 is a section along a B—B line shown in FIG. 8.

As shown in FIG. 6, the molded product 5' is sintered being mounted on a sintering holder 16 in such a manner that the molded product 5' Is supported in a line contact at a peripheral portion B having a small diameter of the cone shape by an edge 16*a*1 which defines an opening 16*a* defined as a holding portion in the sintering holder 16.

After sintered, the dimensions of the molded product 5' are decreased by 15–20% because of contraction. Thus, the molded product 5' moves downward contacting with the edge 16*a*1 of the opening 16*a*, resulting in that the molded product 5' is supported at a peripheral C having a large diameter by the edge 16*a*1 thereof as shown in FIG. 7.

In the yoke core 5 mentioned above, there are problems as follows.

(1) It is difficult to obtain the yoke core 5 having precise dimensions.

(2) It is difficult to obtain the yoke core 5 having a complex shape such as an elliptical cone shape, a rectangular cone shape and one having an irregular wall on its inner wall except for the circular cone shape.

As to (1), one of the reasons that the precise dimensions are not obtained, is that the molded product 5' has the separation grooves 6 and attachment grooves 7. As explained referring to FIG. 2, when the molded product 5' is formed by pouring the magnetic powder 12 between the lower and upper metal molds 11, 13 and by being pressed with the upper metal mold 13, there occurs an uneven density distribution in the magnetic powder 12 because the density of portions nearby the separation grooves 6 and the attachment grooves 7 is different from that of other portions. Thus, when the molded product 5' is sintered, there occurs a stress between the portions nearby the separation grooves 6 and the attachment grooves 7 and other portions caused by the uneven density. This causes a problem that the yoke core 5 has a shape different from a true circle in a section because the yoke core 5 is prone to become elliptical due to the stress occurring in one direction in the process mentioned above.

Another reason that the precise dimensions are not obtained, is due to the sintering holder 16.

Specifically, when sintered, the dimensions of the molded product 5' are decreased by 15–20% by the material contraction. Thus, the molded product 5' softened by heating slides downwards while contacting with the edge 16*a*1 of the opening 16*a*. Thus, the cone shape of the molded product 5' is mostly copied from the shape of the edge 16*a*1 of the opening 16*a* of the sintering holder 16.

Incidentally, the sintering holder 16 is made of a ceramic having a heat resistance temperature of not less than 1300° C., and is formed by sintering the molded ceramic powder in a high temperature. Thus, the sintering holder 16 is used as it is without a further work after sintered because of its high hardness and thus, saving an expensive cost for working if applied.

FIG. 10 shows a measured shape of an edge of an opening defined as a holding section in the sintering holder.

In FIG. 10, the measured shape of the edge 16*a*1 of the opening 16*a* is represented with a real line and an ideal shape of the edge is represented with a dotted line. In FIG. 10, plural scales are radially provided to show distances from a center 0 of the holding section (opening 16*a*), wherein one scale represents a distance of 20 m$\mu$.

As seen from FIG. 10, it will be understood that the measured shape of the edge 16*a*1 is deviated from the ideal one.

The cone shape of the molded product 5' when formed is largely subjected to the shape of the edge 16*a*1 of the opening 16*a* as mentioned in the foregoing.

FIG. 11(A) shows a measured section nearby the small diameter of the yoke core along a direction intersecting an axis of the CRT on which the yoke core is mounted;

FIG. 11(B) shows a measured section nearby the position shown as B of the yoke core along the direction intersecting the axis after sintered in the process shown in FIG. 6; and FIG. 11(C) shows a measured section nearby the position shown as C of the yoke core along the direction intersecting the axis after sintered in the process shown in FIG. 6.

As seen from FIGS. 11(A) to 11(C), as a result, the sectional figures of the yoke core 5 are different at their respective positions, and have no regularity.

Accordingly, a magnetic field generated from the deflection yoke employing such a yoke core 5 is individually different, resulting in a cause of a color deviation of the picture.

As it is impossible to obtain precise dimensions by only sintering the molded product 5', the yoke core 5 is preliminarily formed to be larger than actual dimensions to allow the yoke core 5 to be worked, resulting in an increase of a production cost.

In order to solve these problems, there are proposed techniques for solving them in Japanese Patent Publication 57-11092, Japanese Patent Publication 5-15023, Japanese Patent Laid-open Publication 6-215970, and Japanese Patent Laid-open Publication 6-325961. However, they are far from the actual resolution, in particular, in the field of the high definition picture display device.

Further, in the deflection yoke mounted on the CRT having plural electron guns in line, the horizontal deflection magnetic field distribution by the horizontal deflection coil has a pincushion shape and the vertical deflection magnetic field distribution by the vertical deflection coil has a barrel shape. Thereby, the misconvergence should be theoretically eliminated.

This deflection yoke is called as self-convergence deflection yoke.

Actually, however, it is difficult to obtain such an ideal characteristic based on the theory because of the construction of the CRT, the constructive limitation of the deflection yoke, and dispersion in production, resulting in generations of many kinds of misconvergences.

As examples of the misconvergence, there is misconvergence, so-called $X_H$ or $Y_H$.

FIG. 12 is a schematic view for explaining a misconvergence $X_H$ and $Y_H$, and FIG. 13 is a schematic view for explaining a VCR narrow.

As shown in FIG. 12, the misconvergence $X_H$ is defined as a phenomenon that B (blue color) and R (red color) electron beams are not converged at the same point in distal end sides of a picture in an X axis (horizontal axis) direction of the picture, resulting in an axis deviation in the horizontal direction. The misconvergence $Y_H$ is defined as a phenomenon that each of the color (R, G, B) electron beams is not converged at the same point in distal end sides of the picture in a Y axis (vertical axis) direction of the picture, resulting in an axis deviation in vertical direction.

Thus, the misconvergences $X_H$, $Y_H$ are compensated by using compensation magnetic plates made of permalloy or silicon steel. The compensation magnetic plates are attached on an separator provided on the side surface of the electron gun so as to be at right angles (the X axis) or in parallel (the Y axis) to the array of electron guns.

In the self-convergence saddle deflection yoke employing saddle deflection coil as the horizontal and vertical deflection coils, the vertical deflection magnetic field forms a barrel magnetic field. Thus, as shown in FIG. 13, there occurs a phenomenon, so-called VCR narrow, wherein an amount of deflection of the G electron beam is decreased compared with those of the R and B electron beams. This misconvergence can not be compensated by a combination of the CRT and the deflection coils because of a constructive limitation. Accordingly, the misconvergence is compensated by flowing a compensation current to a VCR compensation (coma compensation) coils.

Here, the description is given of the construction of the deflection yoke in the prior art referred to FIGS. 14 and 15.

FIG. 14 is a partially broken section showing a deflection yoke mounted on the CRT; and FIG. 15 is a right side view of FIG. 14.

Referring to FIG. 14, a deflection yoke 108 generally comprises a separator 101, a pair of saddle type horizontal deflection coils 102 provided on an inner surface of the separator 101, a pair of saddle type vertical deflection coils 103 on an outer surface of the separator 101 and a yoke core 104 to cover both the horizontal and vertical deflection coils 102, 103 as mentioned in the foregoing.

As shown in FIG. 14, the separator 101 has a circular cone shape extended so as to be wider from a side of a neck tube 109N of the CRT 109 to a front funnel 109F thereof. The separator 101 comprises a rear cylindrical portion 101R at an distal end thereof for accommodating a rear bent-up portion of the horizontal deflection coils 102, an attachment portion 101P extended from the rear cylindrical portion 101R and a front cylindrical portion 101F at a side of the front funnel 109F for accommodating a front bent-up portion of the horizontal deflection coils 102. The deflection yoke 108 is mounted on the CRT between the front funnel 109F and the neck tube 109N and fixed to the CRT 109 by using a band 105 and the attachment portion 101P. The R, G, B electron beams emitted from the electron gun 110 provided in the neck tube 109N are deflected by the deflection yoke 108.

Further, as shown in FIG. 15, on a back surface 101RP of the rear cylindrical portion 101R of the separator 101, there is formed a pair grooves 111 at positions close to the neck tube 109N interposed therebetween on an X axis of the CRT 109 for inserting a pair of first compensation magnetic plates 106 for compensating a misconvergence $X_H$. Further, a pair of VCR compensation coils 107 is provided on the back surface 101RP close to the neck tube 109N interposed therebetween on the Y axis of the CRT 109. Furthermore, a pair of second compensation magnetic plates 112 is provided at positions close to the neck tube 109N interposed therebetween on the Y axis for compensating a misconvergence $Y_H$.

FIG. 16 is a schematic view showing an example of an unsymmetrical horizontal magnetic field;

FIG. 17 is a schematic view showing another example of an unsymmetrical horizontal magnetic field;

FIG. 18 is a schematic view showing an example of the misconvergence $X_H$ according to the unsymmetrical horizontal magnetic field shown in FIG. 16; and FIG. 19 is a schematic view showing another example of the misconvergence $X_H$ according to the unsymmetrical horizontal magnetic field shown in FIG. 17.

In FIGS. 16, 17, there are shown examples of unsymmetrical magnetic fields with respect to right and left directions. Thereby, the misconvergence $X_H$ occurs in such a manner that the B electron beam and the R electron beam are not converged at the same point in both distal end portions of the picture in the X axis direction, resulting in an axis deviation in the X axis direction as shown in FIGS. 18, 19, or resulting in that an amount of deviation between the R electron beam and the B electron beam at a right side is different from that at a left side.

FIG. 20 is a plan view showing a compensation magnetic plate; and

FIG. 21 is a schematic view showing a state where the misconvergence $X_H$ is compensated.

A compensation magnetic plate 106 made of permalloy or silicon steel as shown in FIG. 20 is inserted into the groove 111 provided along the X axis from a direction A or a direction B shown in FIG. 15. Two pieces of plates 106 may be inserted into the groove 111 from the directions A and B. Thereby, the unbalance of the horizontal magnetic field distribution is compensated with respect to the right and left directions by making use of a local cancellation of the magnetic field distribution or a change thereof caused by the compensation magnetic plate 106.

Thereby, as shown in FIG. 21, the misconvergence $X_H$ is compensated so that the B and R electron beams are converged at the same point at both distal end portions of the X axis.

Here, the compensation magnetic field caused by the compensation magnetic plate 106 tends to depend on an volume of the compensation magnetic plate 106. Thus, the larger the volume thereof becomes, the larger the compensation magnetic field becomes.

Accordingly, as shown in FIG. 20, the compensation magnetic plate 106 has an rectangular shape of a long side, 106B and a upper short side 106C and a lower short side 106D, and there is formed an inner arch surface 106A having the same radius of curvature as that of the neck 109N of the CRT 109. Thereby, it is possible to effectively cancel or change the horizontal deflection magnetic field.

On the other hand, the misconvergence $Y_H$ and the VCR narrow can be compensated by a combination of the compensation coil 107 and a VCR compensation circuit (not shown) and by causing a compensation current to flow through the VCR compensation coil 107.

Further, the misconvergence $Y_H$ can be also compensated by providing a soft ferromagnetic plate 112 made of silicon steel at a upper or a lower predetermined position along the X axis on a back surface 101RP of the rear cylindrical portion 101R of the separator 101.

FIG. 22 is a schematic view showing a R, G, B misconvergence caused by the horizontal deflection magnetic field distribution shown in FIG. 16; and FIG. 23 is a schematic view showing a horizontal magnetic field distribution when the compensation magnetic plate is disposed closed to the B electron beam.

When the misconvergence $X_H$ shown in FIG. 18 occurs, the horizontal deflection magnetic field distribution holds a state shown in FIG. 16, wherein the magnetic field at the B electron beam side holds a stronger pincushion type magnetic field than that at the R electron beam side. In this state, the misconvergence pattern including the G electron beam in the both distal end portions of the picture along the X axis comes to a state as shown in FIG. 22.

In order to compensate the misconvergence $X_H$ shown in FIG. 22 by using the compensation magnetic plate 106, the compensation magnetic plate 106 is inserted into the groove 111 in the direction B. Then, as shown in FIG. 23, a part of the horizontal deflection magnetic flux $\phi H$ at the B electron beam side is distributed to the compensation magnetic plate 106. Thus, the magnetic flux in the B electron beam side is decreased compared with that at the R electron beam side. As a whole, the magnetic flux distribution is balanced with respect to the R and B electron beam sides so that the deviation of R/B electron beams is eliminated, resulting in the compensation of the misconvergence $X_H$.

FIG. 24 is a schematic view showing a state neglecting an affect of an eddy current loss when the misconvergence $X_H$ is compensated by the compensation magnetic plate; and FIG. 25 is a schematic view showing a state considering an affect of an eddy current loss when the misconvergence $X_H$ is compensated by the compensation magnetic plate.

In this case, as shown in FIG. 24, the G electron beam (the center electron beam) should be deviated from the R/B electron beams to outsides thereof in the both distal end portions of the picture in the X axis direction. Actually, however, as shown in FIG. 25, the G electron beams are deviated from the R/B electron beams to right side thereof. In addition, an amount of the deviation of the G electron beam in the left direction is larger than that of the G electron beam in the right direction. This reason is considered as follows.

FIG. 26 is a chart showing a sawtooth current flowing through the horizontal deflection coil; and FIG. 27 is a schematic view showing an eddy current generated in the compensation magnetic plate.

A sawtooth current shown in FIG. 26 flows through the horizontal deflection coil 102. The sawtooth current has a repetition period T of a combination of a scanning term ts for scanning the electron beam from the left to the right in the picture and a return trace term ts for returning the electron beam to the left.

The repetition period T is determined by a horizontal deflection frequency. In the high definition display, a high horizontal deflection frequency is selected. The value of the return trace term tr is ⅕ as small as that of the scanning term ts, i.e., the scanning frequency is 5 times as large as that of the return trace frequency, because the electron beam has to be quickly returned to the left side of the picture.

Thus, an eddy current is generated in the compensation magnetic plate 106 at the return trace term tr. The value of the eddy current generated at the return trace term tr is larger than that at the scanning term ts, resulting in a magnetic field $\phi e$ as shown in FIG. 27 caused by the eddy current at the beginning.

The magnetic field $\phi e$ caused by the eddy current is superimposed on the horizontal deflection magnetic field, so that the effect of the compensation of misconvergence caused by the compensation magnetic plate 106 is weakened.

Especially, the horizontal deflection magnetic field close to the end portion of the deflection yoke has a strong pincushion magnetic field compared with that nearby the middle portion thereof. Thus, the G electron beam at the left side of the picture is deviated to the right side.

Accordingly, in order to prevent the deviation of the G electron beam to the right side, it is effective to eliminated the generation of the eddy current caused by the compensation magnetic plate 106. Otherwise, a different method is required to eliminate the misconvergence $X_H$.

In order to eliminate the effect of the eddy current, it is effective to employ a magnetic plate having a low eddy current loss in the frequency band used. For instance, Mg—Zn ferrite, which is used in the deflection yoke core as mentioned in the foregoing, is used. However, the Mg—Zn ferrite has such a drawback as being weak in the mechanical strength. Thus, it is necessary to cause the thickness thereof to be thicker than those of the permalloy and the silicon steel, resulting in a limitation of the shape. In addition, the cost of the compensation magnetic plate of Mg—Zn ferrite is more expensive.

As another method, it is possible to compensate the misconvergence by employing a convergence yoke, wherein an analog or a digital compensation current is added to the convergence yoke. However, this method has a drawback of a high cost because of employing the deflection yoke and a compensation circuit. Thus, it is impossible to employ such method in the deflection yoke used in a general use.

Next, the description is given of an example of the VCR narrow compensation in the prior art.

A pair of multi-pole coils each having an E-shaped magnetic core with plural legs around which coils are wound, is arranged on an insulator provided on the side of the electron guns of the CRT in such a manner that the multi-pole coils face to each other in a direction (X axis direction) perpendicular to an extended line of the electron gun arrangement. The coils of the pair of the multi-pole coils are connected in series, and they are connected to the vertical deflection coil to allow the vertical deflection current to flow through the coils of the multi-pole coils so that VCR compensation (comma compensation) is performed.

FIG. 28 is a partially broken section which is vertical to the section of FIG. 14, showing a deflection yoke mounted on the CRT; and FIG. 29 is a right side view of FIG. 28.

Referring to FIG. 28, a deflection yoke 207 generally comprises a separator 201, a pair of saddle type horizontal deflection coils 202 provided on an inner surface of the separator 201, a pair of saddle type vertical deflection coils 203 on an outer surface of the separator 201 and a yoke core 204 to cover both the horizontal and vertical deflection coils 202, 203 as mentioned in the foregoing.

As shown in FIG. 28, the separator 201 has a circular cone shape extended so as to be wider from a side of a neck tube 208N of the CRT 208 to a front funnel 208F thereof. The separator 201 comprises a rear cylindrical portion 201R at an distal end thereof for accommodating a rear bent-up portion of the horizontal deflection coils 202, an attachment portion 201P extended from the rear cylindrical portion 201R and a front cylindrical portion 201F at a side of the front funnel 208F for accommodating a front bent-up portion of the horizontal deflection coils 202. The deflection yoke 207 is mounted on the CRT between the front funnel 208F and the neck tube 208N and fixed to the CRT 208 by using a band 205 and the attachment portion 201P. The R, G, B electron beams emitted from the electron gun 209 provided in the neck tube 208N are deflected by the deflection yoke 207.

Further, as shown in FIG. 29, on a back surface 201RP of the rear cylindrical portion 201R of the separator 201, there are disposed multi-pole coils (VCR compensation coil) 206, 206' on a back surface 201RP of the rear cylindrical portion 201R of the separator 201 at positions close to the neck tube 208N interposed between the multi-pole coils 206, 206' so as to compensate the misconvergence VCR.

Each of the multi-pole coils 206, 206' comprises an E-shaped magnetic core 211, coils 212*a* to 212*c* (212*d* to 12*f*) each wound around a let of the E-shaped magnetic core 211.

FIG. 30 is a plan view showing a soft magnetic plate used in an E-shaped magnetic core of a multi-pole coil; and FIG. 31 is a plan view of the multi-pole coil.

As shown in FIG. 30, a soft-magnetic plate 210 having an E-shape is formed from a silicon steel plate or a permalloy plate by punching. The E-shaped magnetic core 211 is formed by stacking a plurality of the soft magnetic plate 210.

As shown in FIG. 31, the multi-pole coil 206 (206') is fabricated by winding coils 212*a*, 212*b*, 212*c* (212*d*, 212*e*, 212*f*) around legs of the E-shaped magnetic core 211.

FIG. 32 is a schematic back view of the deflection yoke for explaining an operation of the multi-pole coils, wherein the deflection of the electron beams is performed with respect to an upper half of the picture.

Each of the coils 212*a* to 212*f* is electrically connected as follows. When the deflection of the electron beams is performed with respect to an upper half of the picture, the magnetic poles of the E-shaped magnetic core 211 of the multi-pole coil 206 are made to be S (south) pole, N (north) pole and S (south) pole in this order downwardly, and the magnetic poles of the E-shaped magnetic core 211 of the multi-pole coil 206' are made to be N-pole, S-pole and N-pole in this order downwardly. When the vertical deflection magnetic field is zero, the R, G, B electron beams emitted from the electron guns disposed in a lateral (horizontal) direction are at a position between both central magnetic poles of the E-shaped magnetic cores 211 of the multi-pole coils 206, 206'.

When the deflection of the electron beams is performed with respect to the upper half of the picture, a positive direct vertical deflection current flows through the vertical coil 203 and multi-pole coils 206, 206'. By the current flowing through the multiple-pole coils 206, 206', there are generated a first magnetic field caused between the central pole (N pole) and both end poles (S pole) in a direction shown with an arrow 216, and a second magnetic field between both end poles (N pole) and a central pole (S pole) in a direction shown with an arrow 217.

Thus, the electron beams R, G, B behave according to the above magnetic fields as follows.

The R and B electron beams are respectively situated close to the central poles of the multi-pole coil 206 and 206'. The R electron beam is affected by the first magnetic field caused by the central pole (coil 212*b*) of the multi-pole coil 206 and the B electron beam is affected by the second magnetic field caused by the central pole (coil 212*e*) of the multi-pole coil 206'. Thus, the R electron beam moves downward in a direction shown with an arrow 213 and the B electron beam moves also downward in a direction shown with an arrow 214.

Further, a third magnetic field is generated between the both end poles (N poles: coil 212*d*, 212*f*) and the both end poles. (S pole: 212*a*, 212*c*) in a direction shown with arrows 218, 219. A magnetic field generated between the central N-pole of coil 212 band the central S-pole of coil 212*e* is cancelled by the third magnetic field shown with the arrows 218, 219.

Thus, the G electron beam is affected by only the third magnetic field, so that the G electron beam moves upward in a direction shown with an arrow 215.

As mentioned above, the R, G, B electron beams are affected by only the magnetic fields generated in a horizontal direction. Thus, the R, G, B electron beams are deflected in upward and downward directions. This enables to compensate the misconvergence VCR narrow.

Upon compensating the VCR narrow, as the G electron beam is situated at the center of the three electron beams, an amount of deflection is apt to be small. Therefore, there may be generated other misconvergence, so-called greened loop, wherein an amount of deflection at the center portion does not coincide with an amount of deflection in the peripheral portion, so that the G color line becomes a bow shape compared with the R and B color lines. This misconvergence can be compensated by superimposing a parabola current having the horizontal deflection period modulated by the vertical deflection period.

As mentioned in the foregoing, the multi-pole coils 206, 206' are provided on the back surface 201RP of the rear cylindrical portion 201R of the separator 201 at positions close to the neck tube 208N interposed between the multi-pole coils 206, 206'. Thus, a part of the horizontal deflection magnetic field (flux) is distributed to each of the E-shaped magnetic cores 211, resulting in a generation of the eddy current in each of the E-shaped magnetic cores 211.

The horizontal deflection magnetic field is generated by causing the sawtooth current shown in FIG. 26 to flow through the horizontal deflection coil 202.

The repetition period T of the sawtooth current is determined by a horizontal deflection frequency. In the high definition display, a high horizontal deflection frequency is selected. The value of the return trace term tr is ⅕ as small as that of the scanning term ts, i.e., the scanning frequency is 5 times as large as that of the return trace frequency, because the electron beam has to be quickly returned to the left side of the picture. Thus, the value of the eddy current generated in the E-shaped core 211 becomes maximum at a beginning and an end of the return trace term tr, and is gradually decreased as the current becomes zero at the center of the picture. Then, the value of the eddy current is gradually increased as the current becomes maximum at the right side of the picture.

FIG. 33 is a schematic view showing a magnetic field generated by an eddy current of the E-shaped magnetic core.

Here, when the electron beams are deflected from the left side to the center of the picture, a magnetic field ϕE in a direction shown with an arrow in FIG. 33 is generated by the eddy current caused in the E-shaped magnetic core 211. The magnetic field ϕE is superimposed to the horizontal deflection magnetic field generated by the horizontal deflection coil 202 in the same direction thereof. Thus, as it comes to a position close to an end of the picture, the horizontal deflection magnetic field distribution at the rear portion becomes a strong pincushion compared with one at the front portion. Especially, this inclination is stronger at the left side of the picture (at the beginning of electron beam scan) than other portion thereof.

Accordingly, when a deviation (misconvergence $X_H$) of a vertical R line from a vertical B line generated at respective ends of the picture in the direction of the X axis is compensated, a vertical G line is deviated from the vertical R/B line at the respective ends of the picture as shown in FIG. 25. In addition, an amount of the deviation at the left side of the picture is larger than at the right side thereof, resulting in a degradation of the compensation quality of the misconvergence. This phenomenon occurs in other type magnetic cores other than the E-shaped magnetic core.

SUMMARY OF THE INVENTION

Accordingly, a general object of the present invention is to provide deflection yokes and yoke cores, in which the above disadvantages have been eliminated.

A specific object of the present invention is to provide a deflection yoke for deflecting an electron beam emitted from an electron gun of a CRT (cathode ray tube), the deflection yoke being mounted on a part between a neck tube having a small diameter section and a funnel having a large diameter section of the CRT, the deflection yoke comprising: a horizontal deflection coil for deflecting the electron beam in a horizontal direction in the CRT; a vertical deflection coil for deflecting the electron beam in a vertical direction in the CRT; and a yoke core having a cone shape with a large diameter part at one end thereof in a side of the funnel and a small diameter part at another end thereof in a side of the neck tube to allow the yoke core to cover the horizontal and vertical deflection coils, the yoke core being made of a molded material cured by heating, the molded material including a binder comprising a resin and a magnetic powder treated with a surface treatment agent comprising a compound having an aminoquinone group as a constitution unit, the aminoquinone group being selected from a group of the aminoquinone groups shown with formulas (1) and (2), (1)

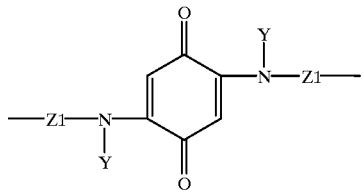

(2)

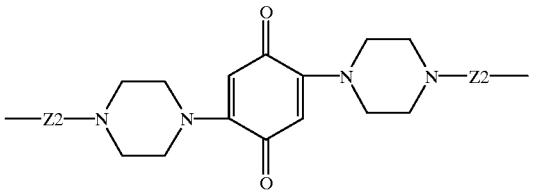

wherein

Y: hydrogen atom, $C_1$~$C_6$ alkyl group having at least one selected from a group of a straight chain, a cyclic chain, and a branched chain, aralkyl group, phenyl group, Z1: $C_2$~$C_{16}$ alkylene group, phenylene group, aralkyl group, alkarilene group, —$(CH_2CH_2—O)_n$—$CH_2$—$CH_2$— (n: integer 1–50), and Z2: $C_1$~$C_6$ alkylene group having at least one selected from a group of a straight chain and a branched chain.

Another and more specific object of the present invention is to provide a yoke core used in a deflection yoke for deflecting an electron beam emitted from an electron gun of a CRT (cathode ray tube), the yoke core being mounted on a part between a neck tube and a funnel of the CRT, wherein the yoke core has a cone shape with a large diameter part at one end thereof in a side of the funnel and a small diameter part at another end thereof in a side of the neck tube to allow the yoke core to cover the horizontal and vertical deflection coils, and the yoke core is made of a molded magnetic material cured by heating, and the molded magnetic material includes a binder comprising a resin and a magnetic powder treated with a surface treatment agent which comprises a compound having an aminoquinone group as a constitution unit, and the aminoquinone group is selected from a group of the aminoquinone groups shown with the formulas (1) and (2).

Other and more specific object of the present invention is to provide a deflection yoke mounted on a color CRT (cathode ray tube) for deflecting plural electron beams emitted from electron guns disposed in line in the color CRT, the deflection yoke being equipped with a compensation magnetic plate for compensating a misconvergence generated on a display panel of the CRT, wherein the compensation magnetic plate is made of a molded magnetic product cured by heating, and the molded magnetic product includes a binder comprising a resin and a magnetic powder treated with a surface treatment agent which comprises a compound having an aminoquinone group as a constitutional unit, and the aminoquinone group is selected from a group of the aminoquinone groups shown with the formulas (1) and (2).

Other and more specific object of the present invention is to provide a yoke core used for a deflection yoke mounted on a color CRT (cathode ray tube) for deflecting plural electron beams emitted from electron guns disposed in line in the color CRT, the deflection yoke being equipped with a magnetic core on which coils are wound for compensating a misconvergence generated on a display panel of the CRT, wherein the magnetic core is made of a molded magnetic product cured by heating, and the molded magnetic product includes a binder comprising a resin and a magnetic powder treated with a surface treatment agent which comprises a compound having an aminoquinone group as a constitutional unit, and the aminoquinone group is selected from a group of the aminoquinone groups shown with the formulas (1) and (2). Other objects and further features of the present invention will be apparent from the following detailed description.

DETAILED DESCRIPTION OF THE PREFERRED EMBODIMENT

Figure 1:
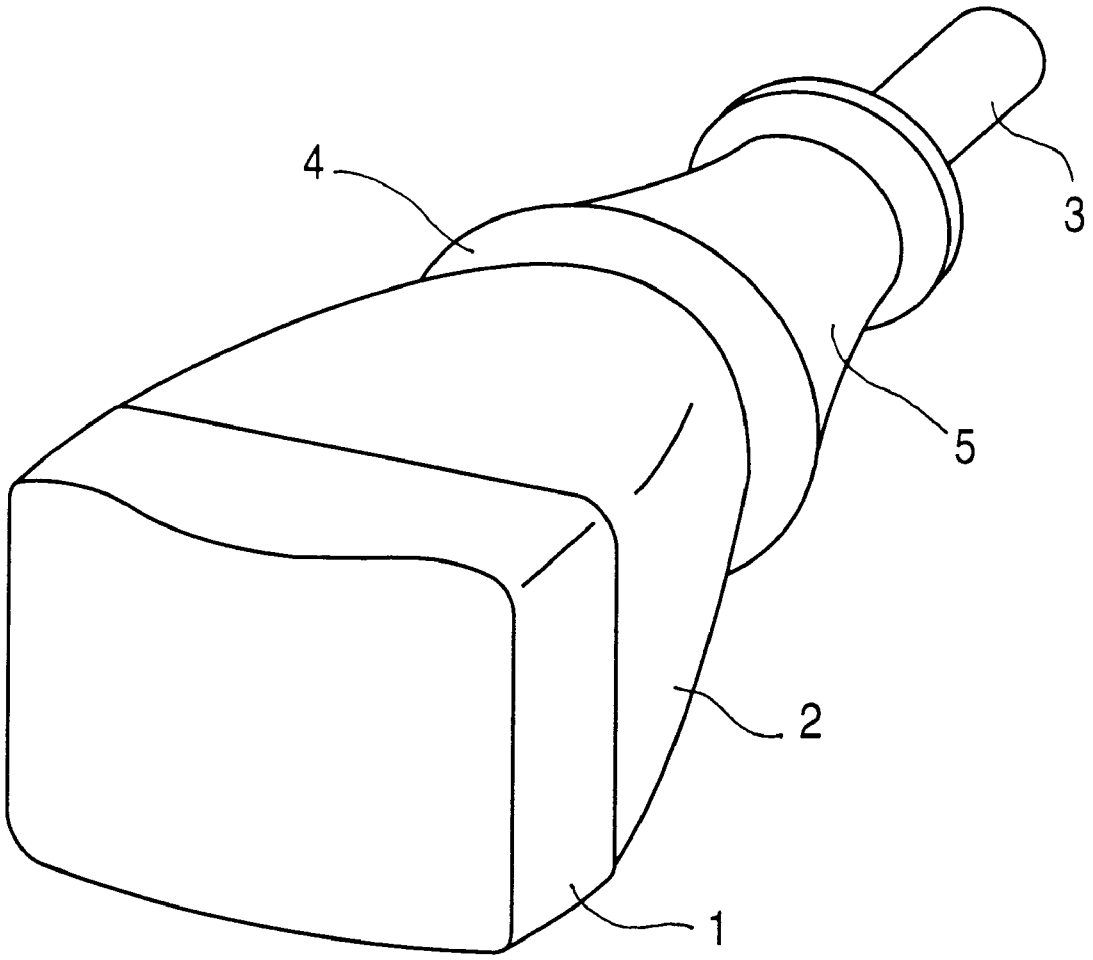
FIG. 1 is a perspective view of a CRT mounted with a deflection yoke.
Figure 2:
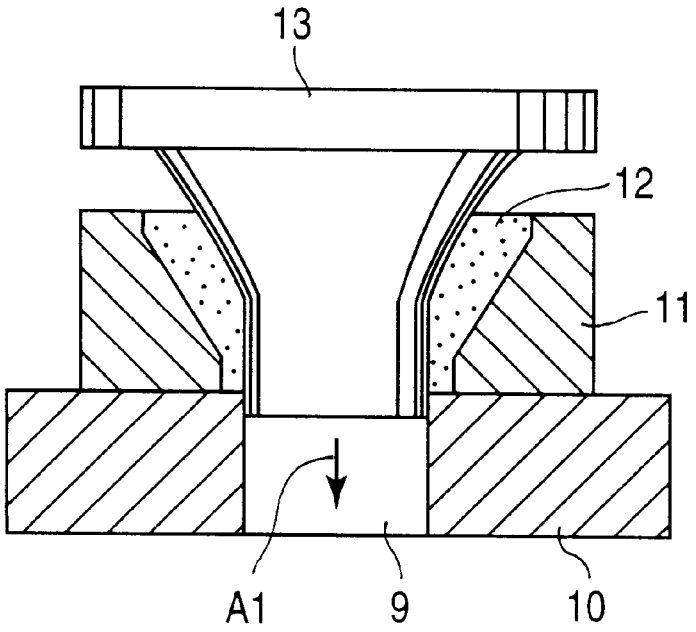
FIG. 2 is a section showing a metal mold for a yoke core.
Figure 3:
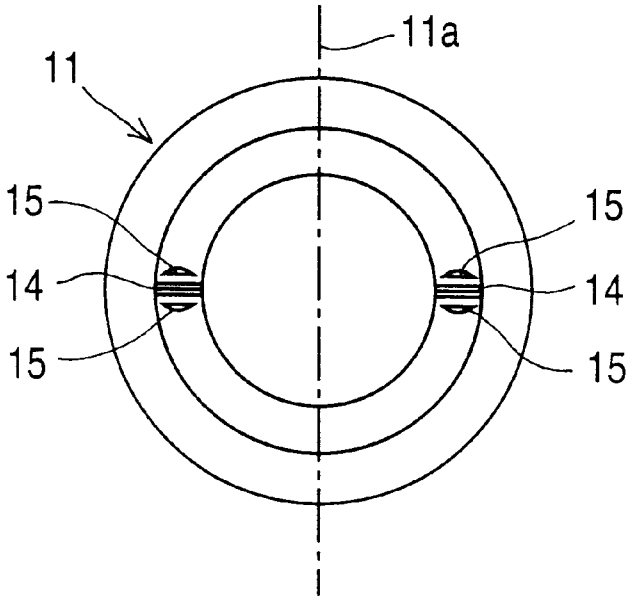
FIG. 3 is a plan view showing a lower metal mold of the metal mold shown in FIG. 2.
Figure 4:
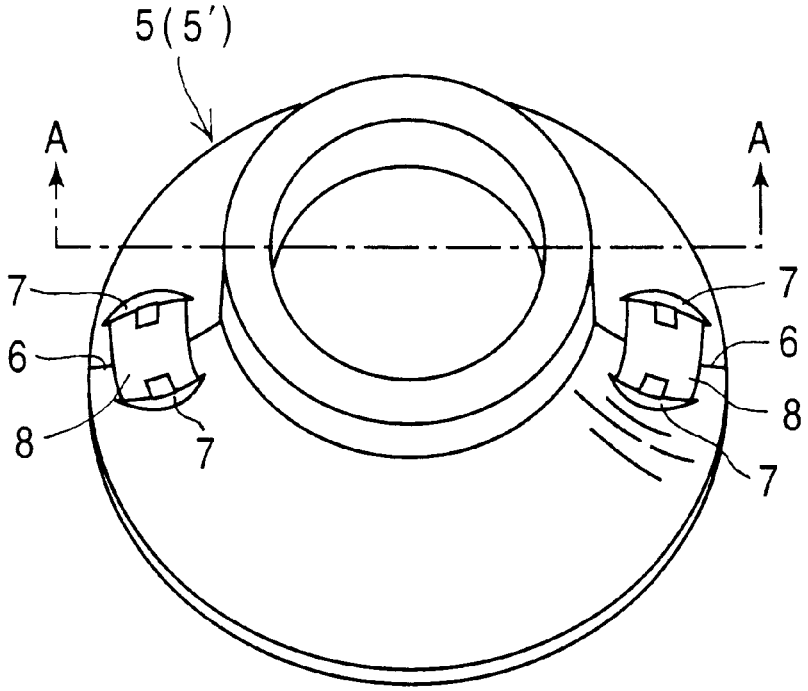
FIG. 4 is a perspective view of a molded magnetic product for the yoke core.
Figure 5:
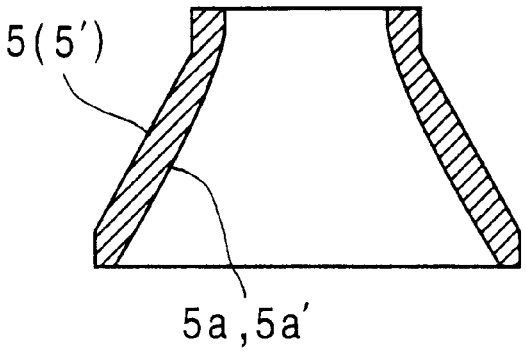
FIG. 5 is a section along an A—A line shown in FIG. 4.
Figure 6:
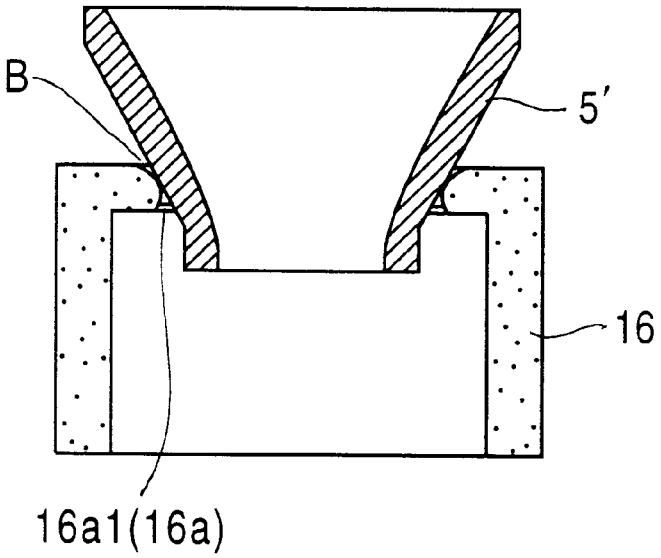
FIG. 6 is a section of the molded magnetic product before sintered.
Figure 7:
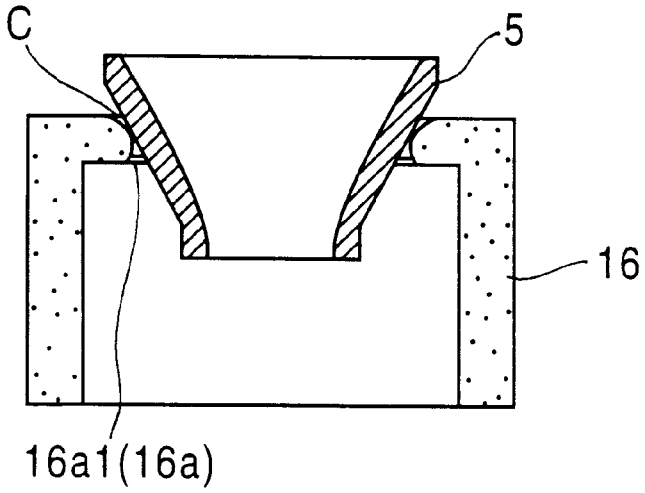
FIG. 7 is a section of the molded magnetic product after sintered.
Figure 8:
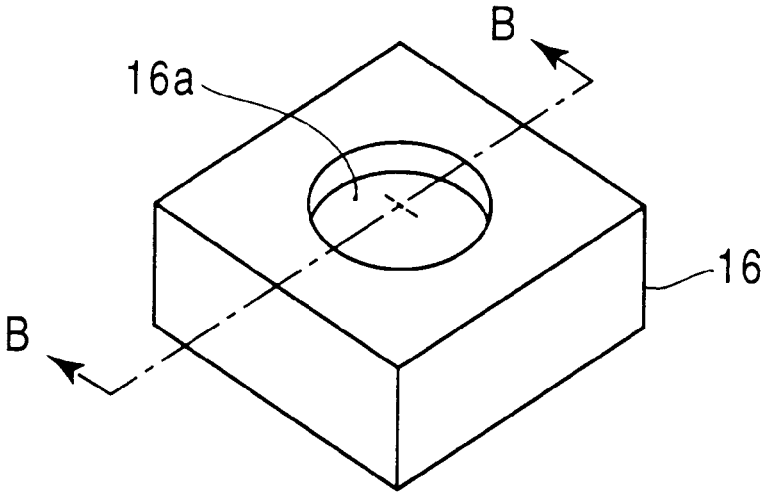
FIG. 8 is a perspective view of a sintering holder.
Figure 9:
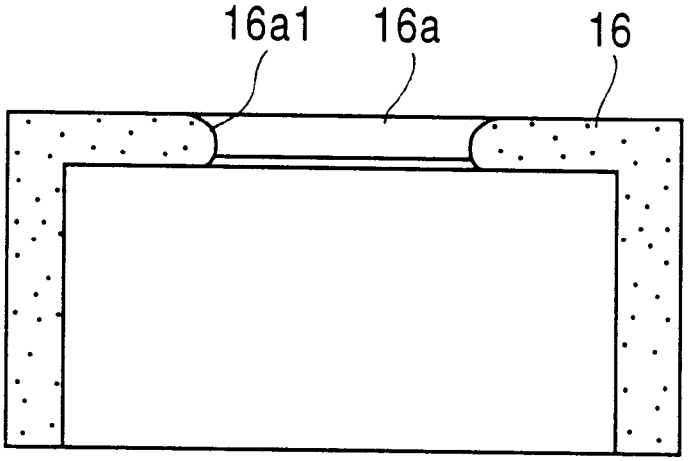
FIG. 9 is a section along a B—B line shown in FIG. 8.
Figure 10:
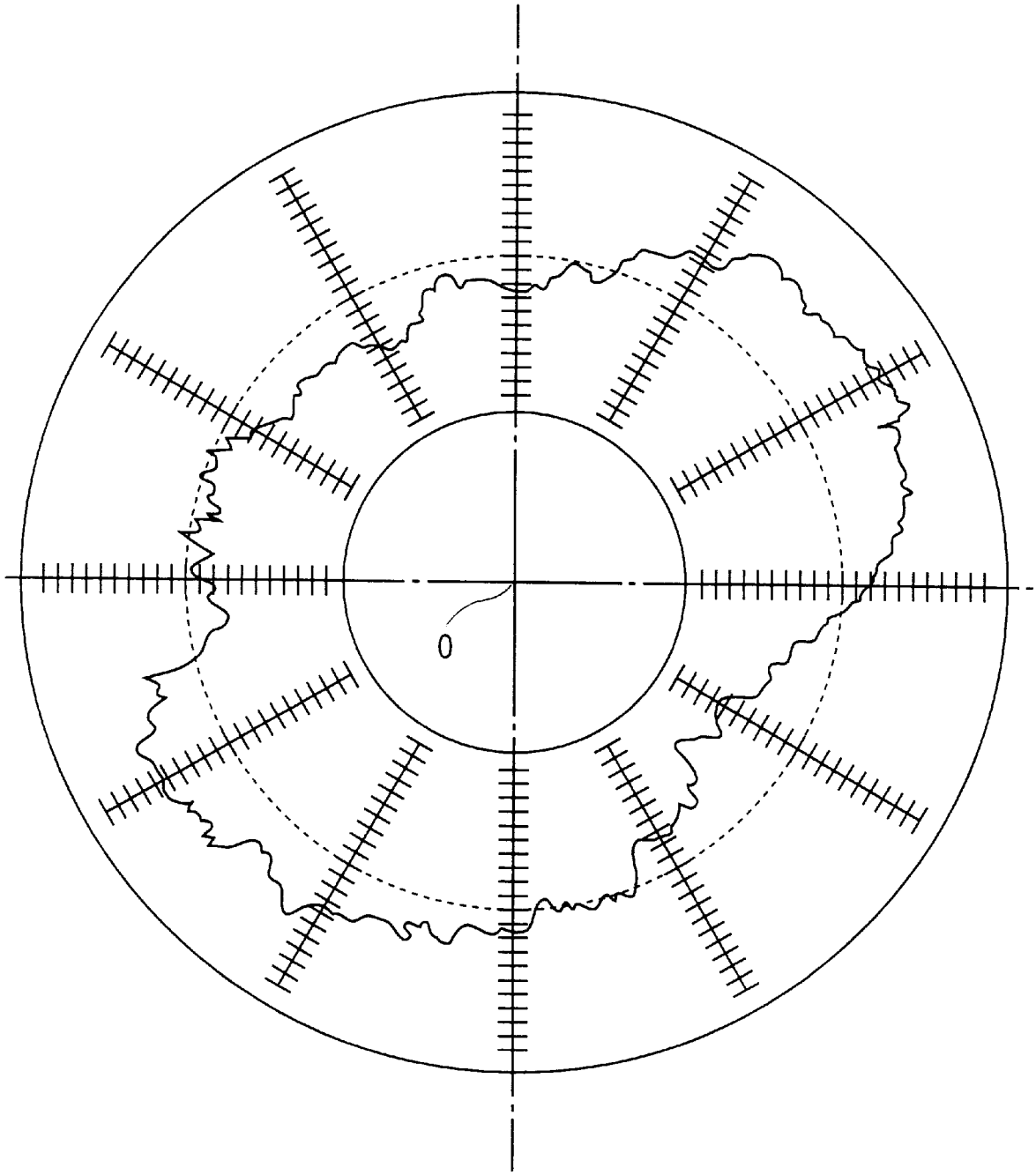
FIG. 10 shows a measured shape of an edge of an opening defined as a holding section in the sintering holder.
Figure 11A:
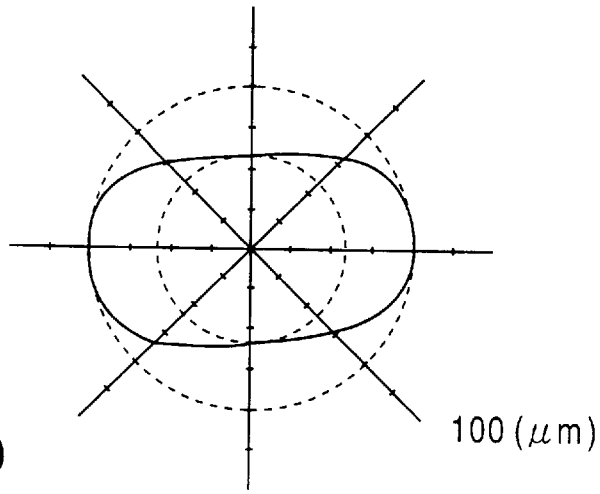
FIG. 11(A) shows a measured section of the yoke core along a direction intersecting a tube axis nearby the small diameter.
Figure 11B:
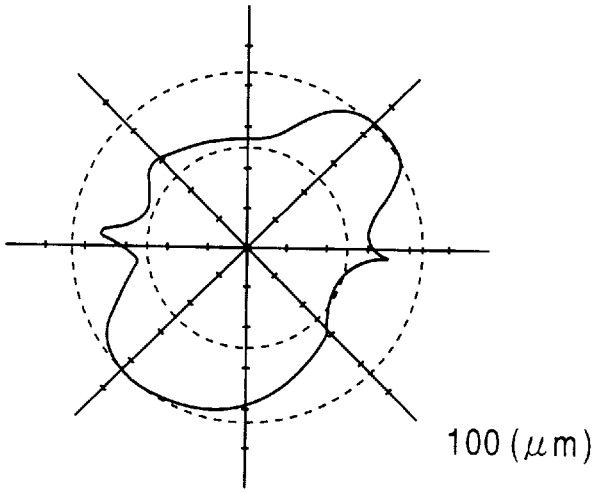
FIG. 11(B) shows a measured section of the yoke core along the direction intersecting the tube axis nearby the position shown with B after sintered in FIG. 6.
Figure 11C:
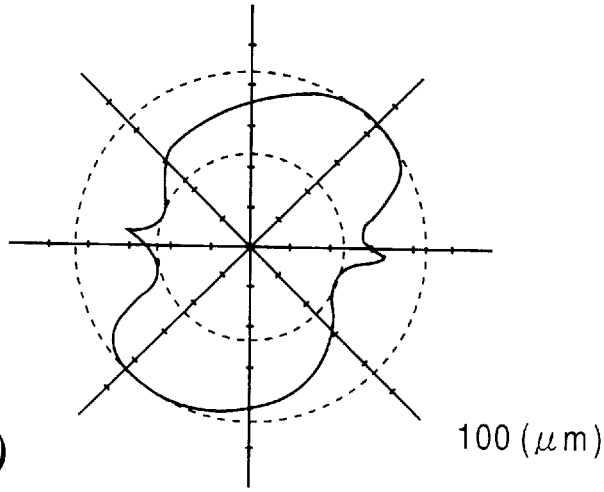
FIG. 11(C) shows a measured section of the yoke core along the direction intersecting the tube axis nearby the position shown with C after sintered in FIG. 7.
Figure 12:
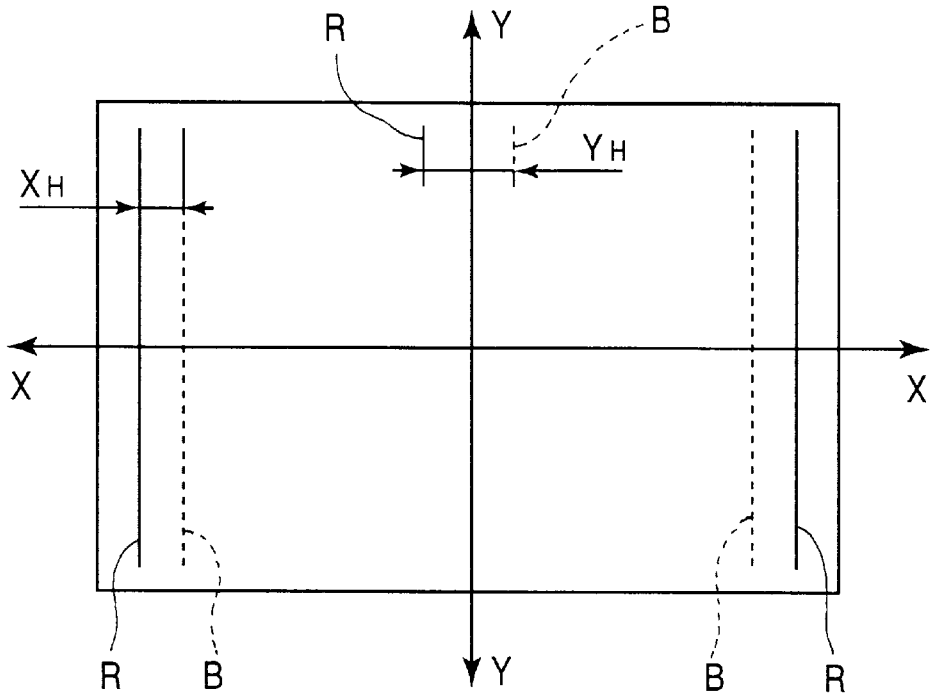
FIG. 12 is a schematic view for explaining a misconvergence $X_H$ and $Y_H$.
Figure 13:
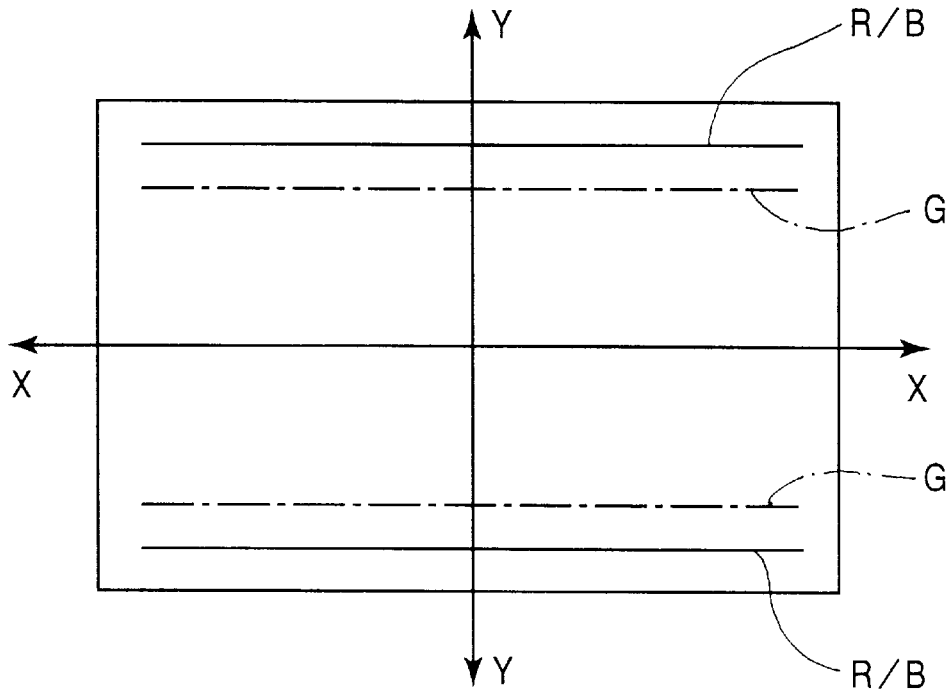
FIG. 13 is a schematic view for explaining VCR narrow.

Next, the description is given of embodiments of a deflection yoke and a deflection yoke core referred to Drawings.

First, the description is given of a processing method of the magnetic powder of the bond magnetic material used as deflection yoke cores.

As a surface treatment agent, a compound containing at least one of aminoquinone groups shown with a formula (1) and (2) as a constitutional unit is prepared. Then, a magnetic powder is treated with the surface treatment agent.

(1)

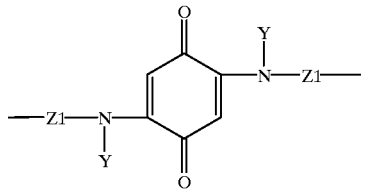

(2)

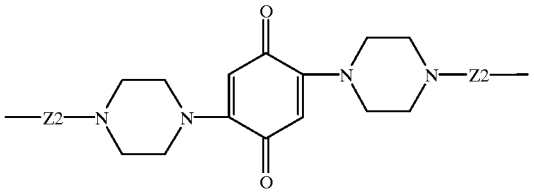

In the formula (1),

Y: hydrogen atom, $C_1$~$C_6$ alkyl group having at least one selected from a group of a straight chain, a cyclic chain, and a branched chain, aralkyl group, phenyl group.

Z1: $C_2$~$C_{10}$ alkylene group, phenylene group, aralkyl group, alkarilene group, —($CH_2CH_2$—O)n —$CH_2$—$CH_2$— (n: integer 1–50).

In the formula (2),

Z2: $C_1$~$C_6$ alkylene group having at least one selected from a group of a straight chain and a branched chain.

Specifically, the surface treatment agent is preferably a polymer such as polyurethane obtained by a reaction of diol and isocyanate containing the aminoquinone group represented by the formula (1) or (2).

A weight ratio of the compound containing the aminoquinone group to a 100 weight % of a magnetic powder is not more than 10 weight %. Preferably, the weight ratio of the compound is 0.1 to 10 weight %, and more preferably 0.1 to 5 weight %.

Either of the aminoquinone group represented with formula (1) or (2) or both of them may be contained in the compound. In the compound containing aminoquinone group, the weight ratio of the aminoquinone group as monomer is preferably not less than 50 weight %, more preferably not less than 40 weight %.

It is effective to increase the weight ratio of the aminoquinone group as the monomer for the purpose mentioned above, however, an excessive weight ratio thereof invites a difficulty of the polymerization of the monomer. Thus, the upper limit of the weight ratio of the aminoquinone group is at most 50 weight %

In this invention, the weight ratio of the aminoquinone group as the monomer is preferably 5 to 40 weight %.

The surface treatment agent for the magnetic powder is adjustablly obtained by dissolving the compound containing the aminoquinone into a solvent.

Polyurethane is adjustablly obtained by causing a diol monomer which was obtained by introducing hydroxy groups to both distal ends of the aminoquinone group represented by the formulas (1) and (2), to other kinds of diol and to diisocyanates.

As other kinds of diol mentioned above, butane diol, butylene adipate, caprolactone, polyester, polyether, glycol, polycaprolactone, polyester amid, polyalkanediol, polybutane diol and polyacetal can be used.

As diisocyanate, methylene diisocyanate, toluen diisocianate can be used.

As mentioned above, the surface treatment agent for the magnetic powder is obtained by dissolving the polyurethane polymer mentioned in the foregoing into a solvent such as anone.

More specifically, as tin aminoquinone (AQ) monomer, there is used a compound containing at least one selected from a group of a diol monomer (AQ-01) represented by a formula (3) and another diol monomer (AQ-02) represented by a formula (4) as a constitutional unit.

(3)

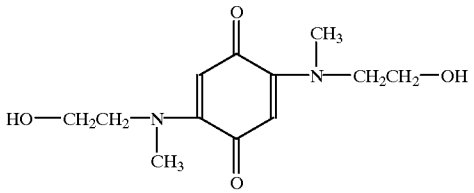

(4)

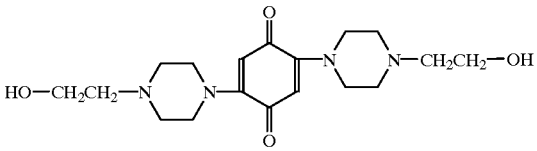

The surface treatment agent is made as follows:

First, the polyurethane polymer having a molecular weight of 5,000 to 50,000 is made by causing the compounds mentioned above to react to many kinds of diol having a molecular weight of 500 to 5,000 and diisocyanates. Then, the solvent density of the surface treatment agent is adjusted so that the weight ratio of the polyurethane becomes to be 0.1 to 10.0 weight % to 100 weight % of the magnetic powder, resulting in the surface treatment agent.

The surface treatment agent of 250 g is dispersed into the magnetic powder of 1 kg. Then, the solvent therein is evaporated. Thus, the surface treatment of the magnetic powder is completed.

Further, the above magnetic powder is mixed with a thermosetting resin, for instance, an epoxy resin, resulting in a granular powder having a predetermined grain diameter. The granular powder is molded by using a metal mold, resulting in a bond magnetic material having a predetermined shape after heated.

Here, the bond magnetic material is not necessary to be sintered like the usual ferrite material but heated for 1 to 2 hours in a comparatively lower temperature.

As a result, it was found that a specific resistance value of the bond magnetic material treated with the surface treatment agent containing the aminoquinone group is 6 to 2600 times as high as that of a bond magnetic material which is not treated with the surface treatment agent.

Further, It was found that a specific resistance value of the bond magnetic material treated with the surface treatment agent containing the aminoquinone group is 3 to 1300 times as high as that of a bond magnetic material which is treated with a surface treatment agent containing no aminoquinone group.

In other words, the bond magnetic material having undergone the above surface treatment has high specific resistance values of $10^8$ to $10^9$ [$\mu\Omega$.cm]. This improves the drawback of the softmagnetic powder that has lower specific resistance values of 10 to 100 [$\mu\Omega$.cm]. As a result, it is possible to take full advantage of the excellent magnetic characteristics which the softmagnetic power inherent has, even in a high frequency range.

Further, in order to increase the specific resistance values of the bond magnetic material and to improve a mechanical strength thereof, it is effective to surface-treat the magnetic powder with silane coupling agent in prior to the surface treatment with the surface treatment agent of the compound containing the aminoquinone group. After that it may be surface-treated with the silane coupling agent again. Instead, a surface treatment agent in which the silane coupling agent of 0.1 to 6 % is integrally blended, may be used.

Thereby, it is possible to uniformly coat the surface treatment agent to surfaces of particles of the magnetic powder because of an interaction of the aminoquinone group and the silane coupling agent, resulting in a further increase of the specific resistance value of the bond magnetic material by more than 10 times.

Further, it is possible employ a polymer resin containing the silane coupling agent as the binder for the mold of the bond magnetic material.

When the silane coupling agent is used, the mechanical strength of the bond magnetic material can be improved because of an improvement of coupling force between the magnetic powder and the polymer resin.

Next, the description is given of an embodiment of the deflection Yoke and the deflection yoke core (referred to as yoke core).

Figure 34:
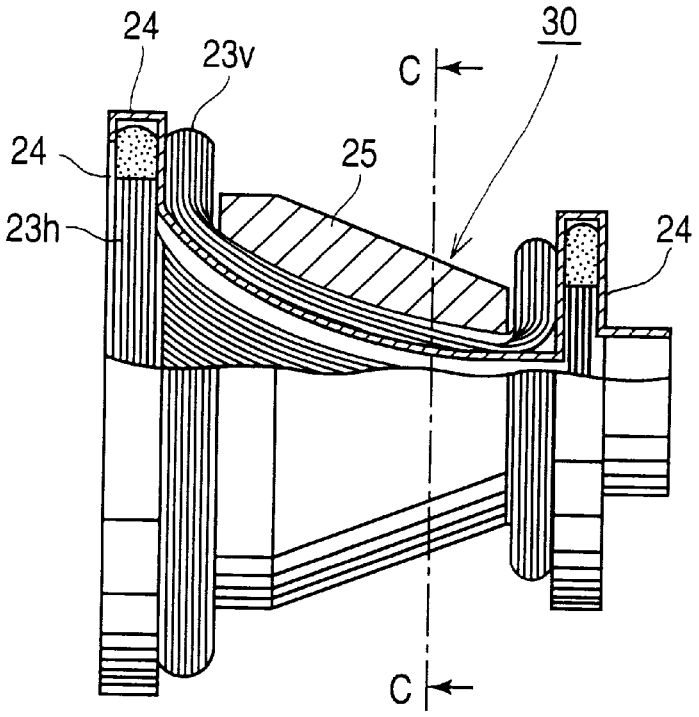
FIG. 34 is a side view, partially in cross-section, of a deflection yoke of the present invention.
Figure 35:
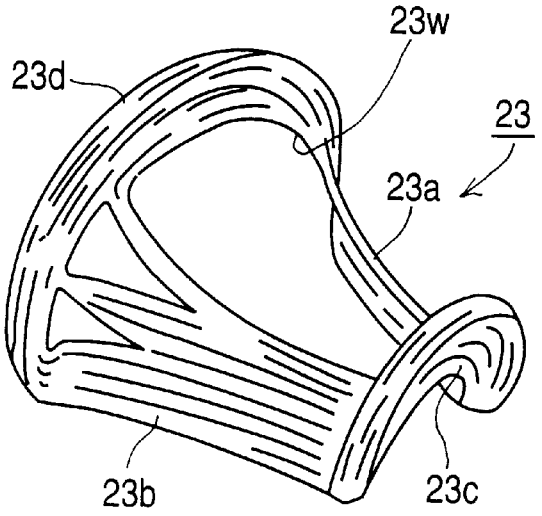
FIG. 35 is a perspective view of a saddle type deflection coil.

FIG. 34 is a side view, partially in cross-section, of a deflection yoke of the present invention;

FIG. 35 is a perspective view of a saddle type deflection coil, and

Figure 36:
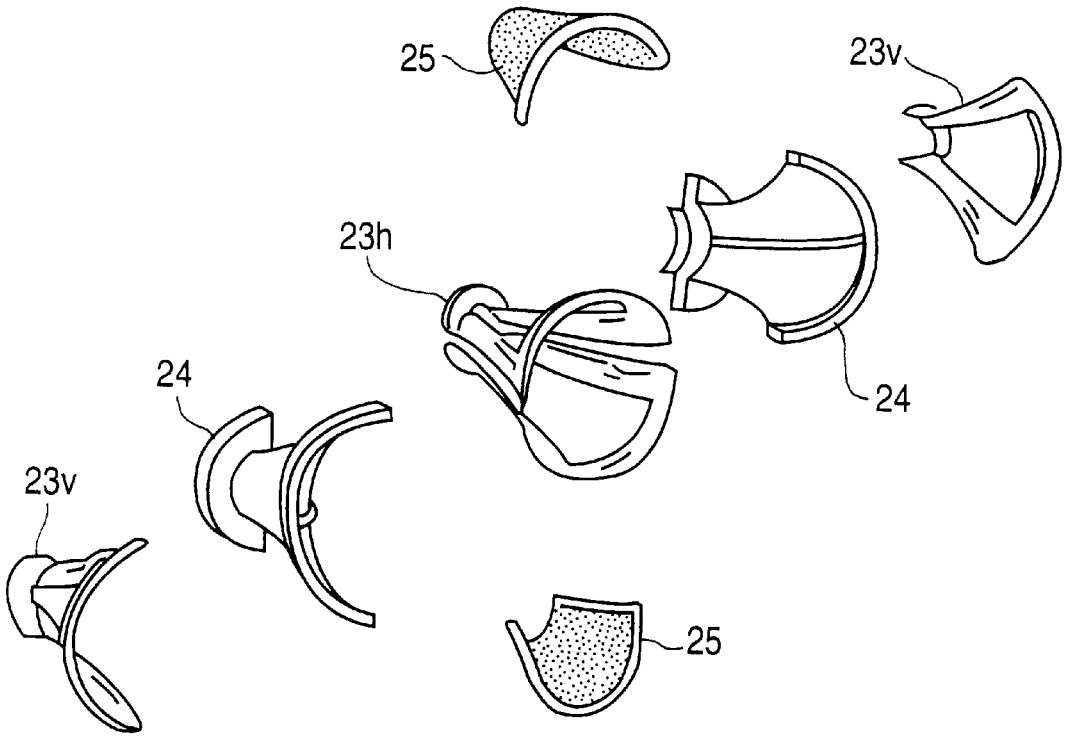
FIG. 36 is an exploded view of the deflection yoke of the present invention.

FIG. 36 is an exploded view of the deflection yoke of the present invention.

Generally, the deflection yoke for the high definition display is equipped with saddle type deflection coils 23 as a set of a pair of them. Each of the saddle type deflection coils 23 has intermediate sections 23*a*, 23*b* approximately in parallel to an axis (not shown) of the color CRT, a small diameter section 23*c* and a large diameter section 23*d*, each intersecting the axis of the color CRT in right angles, and a window 23*w* is defined being surrounded by the intermediate sections 23*a*, 23*b*, the small diameter section 23*c* and the large diameter section 23*d*.

Further, as shown in FIG. 36, the deflection yoke comprises a pair of horizontal deflection coils 2*h* and a pair of vertical deflection coils 23*v*, each made of saddle type deflection coils 23. The horizontal deflection coils 2*h* are mounted on an inside of a separator 24, and the vertical deflection coils 23*v* are mounted on an outside of the separator 24. Further, the vertical deflection coils 23*v* are covered by a pair of yoke cores 25, 25, resulting in a saddle-saddle type deflection yoke 30 as shown in FIG. 34.

In the saddle-saddle type deflection yoke 30, inductance values of the intermediate sections 23*a*, 23*b* of each of the coils 23*h*, 23*v* are much affected by the yoke cores 25 due to the constructive feature thereof, however, inductance values of the small diameter sections 23*c* and the large diameter sections 23*d* are not affected so much.

Figure 37:
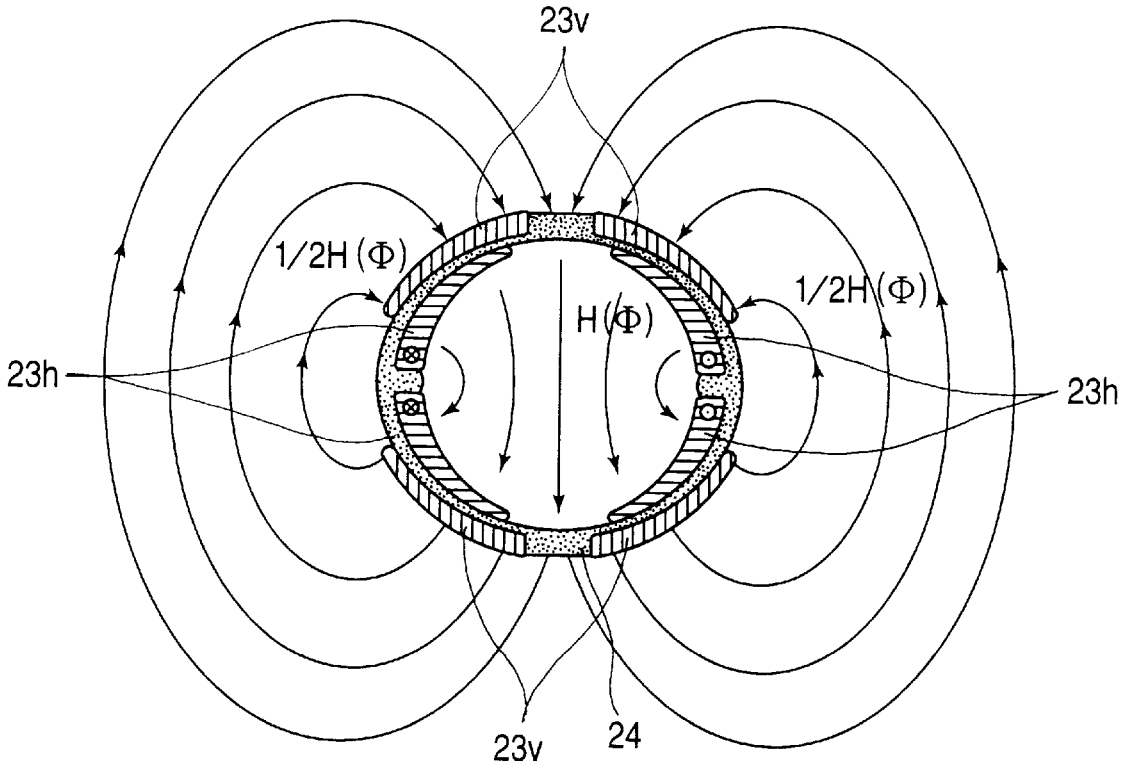
FIG. 37 is a sectional view taken along line C—C of FIG. 34, showing a horizontal deflection magnetic field distribution of the horizontal deflection coils when the yoke core is not provided in the deflection yoke.
Figure 38:
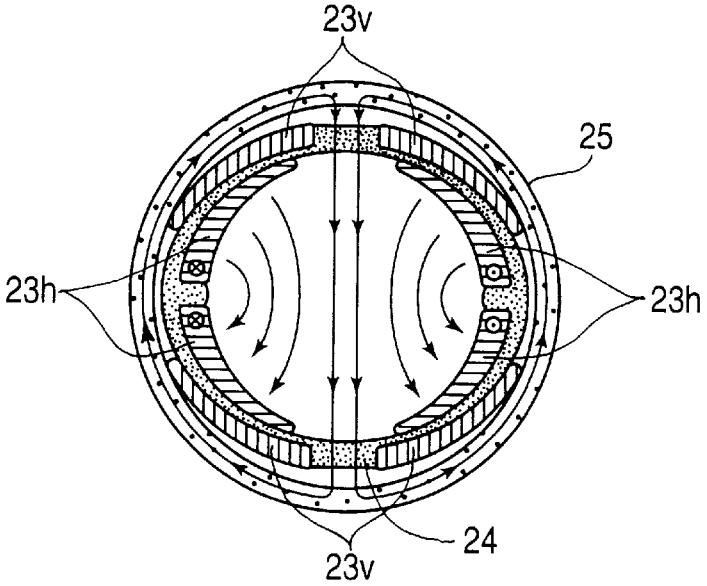
FIG. 38 is a sectional view taken along a line C—C of FIG. 34, showing a horizontal deflection magnetic field distribution of the horizontal deflection coils when the horizontal deflection yoke cores are provided in the deflection yoke.

FIG. 37 is a sectional view taken along a line C—C of FIG. 34, showing a horizontal deflection magnetic field distribution of the horizontal deflection coils when the yoke core is not provided in the deflection yoke; and FIG. 38 is a sectional view taken along line C—C of FIG. 34, showing a horizontal deflection magnetic field distribution of the horizontal deflection coils when the horizontal deflection yoke cores are provided in the deflection yoke.

As shown in FIGS. 37 and 38, in the deflection yoke 30 shown in FIG. 34, the deflection magnetic field distribution of the deflection coils is largely affected by the existence of the yoke cores 25.

As shown in FIG. 37, when an amount of magnetic flux flowing inside the deflection yoke 30 is $\phi$ and the magnetic field inside the deflection yoke is H, an amount of magnetic flux of $\frac{1}{2}\phi+\frac{1}{2}\Phi$ leaks from the deflection yoke and flows to an outside of the deflection yoke 30.

As shown in FIG. 38, when the yoke cores 25 are provided in the deflection yoke 30, the abovementioned magnetic flux of $\frac{1}{2}\phi+\frac{1}{2}\Phi$ flows through the yoke core 25, resulting in a large deflection magnetic field H inside the deflection yoke 30. This deflection magnetic field contributes to the deflection of the electron beam.

As seen from the above, the current required for deflecting the electron beam, i.e., the intensity of the deflection magnetic field, is more affected by the yoke core 25 itself than the inductance of the yoke cores 25.

Accordingly, a symmetry of the deflection magnetic field distribution in the deflection yoke is much affected by dimensional deviations such as an inner diameter and a thickness or the yoke core 25 deviation and physical deviations such as a deviation of distribution of magnetic permeability in the yoke core 25.

As to the permeability of the yoke core 25, it may be required to be larger than a predetermined value, however, the uniform distribution in the core is more important than the value itself.

As to the core loss, the less the core loss becomes, the better the magnetic characteristics becomes. However, a an amount of heat generation caused by the deflection coils 23 is much larger than that caused by the core loss. Thus, the contribution of heat generation caused by the core loss to the total amount thereof is comparatively small. When replacing a Ni—Zn ferrite core with a Mn—Zn ferrite core, the core loss of the Mn—Zn ferrite core becomes 3 times as large as that of the Ni—Zn ferrite core. However, the peak temperature of the deflection yoke rises only 15%. Thus, as to the core loss, it is enough to be less or the same degree as that of the Mn—Zn ferrite core which is usually used.

Figure 39A:
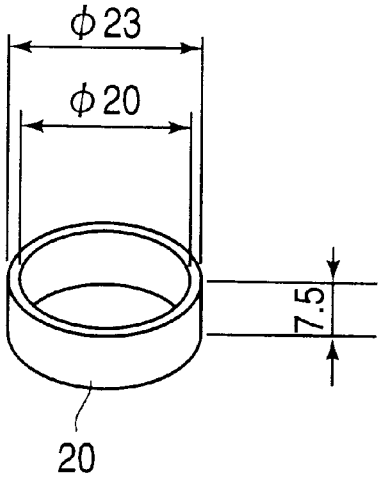
FIGS. 39(*a*) and 39(*b*) are perspective views showing a ring made of a AQ bond magnetic material of the present invention.
Figure 39B:
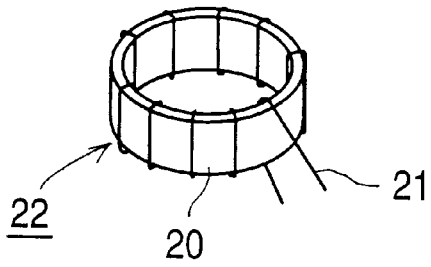

FIGS. 39(*a*) and 39(*b*) are perspective views showing a ring made of an AQ bond magnetic material of the present invention.

In order to evaluate the magnetic characteristic of the bond magnetic material, a plurality of ring cores shown in FIG. 39(*a*) were made and tested as follows.

Here, a reduction iron powder having an average particle of 70 $\mu$m is used as the magnetic powder.

The reduction iron powder is pre-treated as follows:

reduction iron powder: 1 kg surface treatment agent: 40 g (polyurethane containing AQ monomer of 30%)

Next, epoxy (containing a curing agent) of 20 g is added to the pre-treated reduction iron powder of 1 kg, and they are mixed to be dispersed, resulting in a granular powder having an average grain diameter of 74 $\mu$m.

The granular powder is molded by a metal mold, and the molded magnetic product is cured by being heated for 1 hour under a temperature of 160° C. As a result, as shown in FIG. 39(*a*), plural test pieces of an AQ bond magnetic material 20 (outer diameter: 23 mm, inner diameter; 20 mm and height: 7.5 mm) are obtained.

In FIG. 39(*b*), a reference character 22 denotes a test piece of the AQ bond magnetic material 20 with a coil, wherein a ritz wire 21 of 13 magnet wires (each having $\phi$0.1 mm, 2 UEW (urethane enamel wire)) is wound around the AQ bond magnetic material 20 bond magnetic material 20 by 10 turns.

Figure 40:
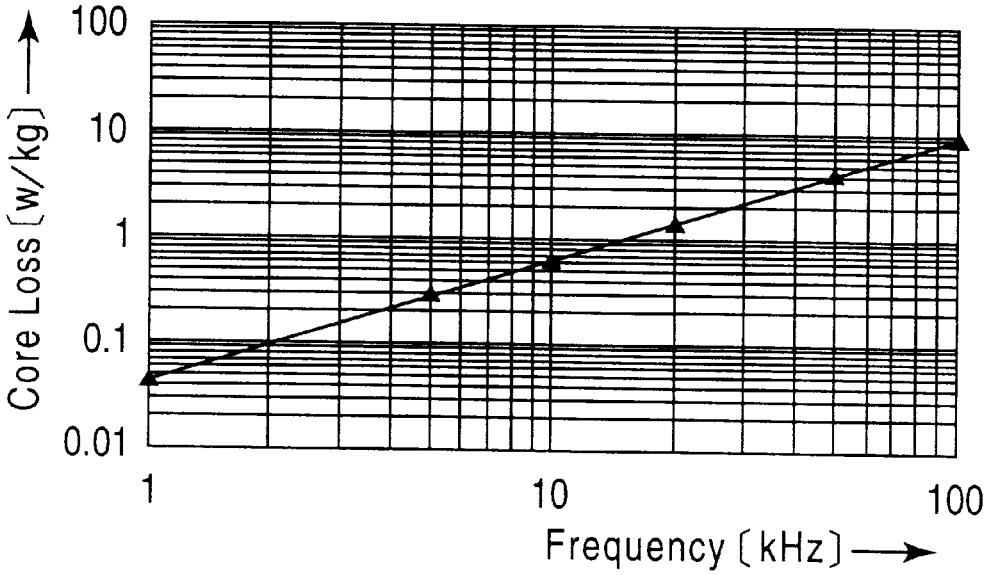
FIG. 40 is a graph showing a core loss characteristic of the AQ bond magnetic material.

As shown in FIG. 40, the core loss of the test piece 22 is measured in the frequency range of 1–100 kHz.

The dimensions of the test pieces 22 at predetermined is are shown in Tables 1-1, and 1-2.

TABLE 1-1

| | $\phi$d (mm) | | | $\phi$d (mm) | | |
|---|---|---|---|---|---|---|
| No. | a | b | c | a | b | c |
| 1 | 19.96 | 19.96 | 19.97 | 22.96 | 22.97 | 22.97 |
| 2 | 19.96 | 19.96 | 19.97 | 22.96 | 22.96 | 22.97 |
| 3 | 19.96 | 19.96 | 19.97 | 22.96 | 22.97 | 22.97 |
| 4 | 19.96 | 19.96 | 19.97 | 22.96 | 22.96 | 22.96 |
| 5 | 19.96 | 19.96 | 19.97 | 22.96 | 22.97 | 22.97 |

TABLE 1-2

| | h (mm) | | | |
|---|---|---|---|---|
| No. | 0° | 90° | 180° | 270° |
| 1 | 7.51 | 7.51 | 7.51 | 7.51 |
| 2 | 7.51 | 7.52 | 7.51 | 7.51 |
| 3 | 7.51 | 7.51 | 7.51 | 7.51 |
| 4 | 7.51 | 7.51 | 7.51 | 7.51 |
| 5 | 7.51 | 7.51 | 7.51 | 7.51 |

Figure 41:
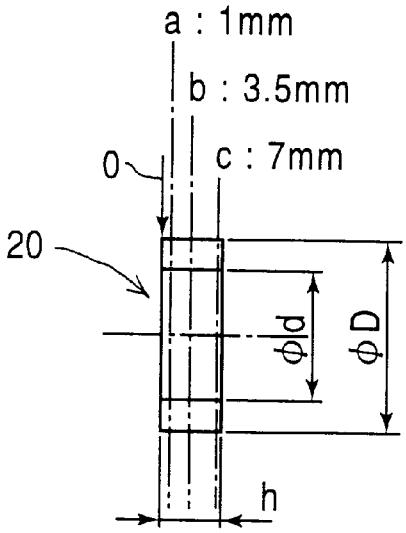
FIG. 41 is a side view showing measuring positions of the AQ bond magnetic material.

FIG. 41 is a side view showing measuring positions of the AQ bond magnetic material.

In Table 1-1, as shown in FIG. 41, reference characters a, b, c respectively represent positions of 1 mm, 3.5 mm, 7 mm apart from an distal end (a reference surface) of the AQ bond magnetic material 20, and reference characters $\phi$d, $\phi$D respectively represent an inner diameter and an outer diameter of the AQ bond magnetic material 20. The inner diameters and outer diameters of test pieces 1–5 are shown at every position mentioned above.

In Table 1-2, a character h represents a height of the AQ bond magnetic material 20. The height h of each of the test pieces 1–5 is shown at a 90° interval.

Figure 42:
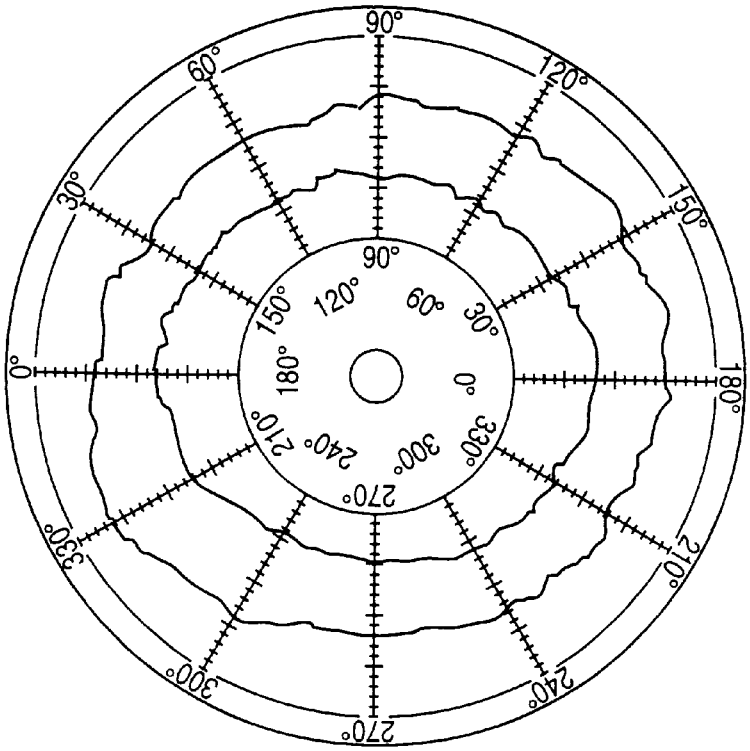
FIG. 42 is a graph showing inner diameter and outer diameter values measured with respect to an example selected from test pieces 1–5.

FIG. 42 is a graph showing inner diameter and outer diameter values-measured with respect to an example selected from test pieces 1–5.

As seen from Tables 1-1, 1-2 and FIG. 42, the AQ bond magnetic material 20 has a small dimensional deviation at each part, and has a precise cylindrical shape.

Incidentally, a density of pressed powder was 6.95 [g/cm$^3$] and permeability thereof was 72.

FIG. 40 is a graph showing a core loss characteristic of the AQ bond magnetic material.

As shown in FIG. 40, the core loss characteristic of the bond magnetic material 20 is comparable to that of the Mg—Zn ferrite which is widely used as the yoke core. Thus, it is clear that the bond magnetic material 20 can be employed as the yoke core for the high definition display CRT because the horizontal scanning frequency used in the high definition display CRT mainly ranges 24 to 100 kHz.

In the embodiment, the reduction iron powder is used, however, other soft ferromagnetic material such as Fe—Al alloy, Fe—Si—Al alloy, Ni—Fe alloy, Fe—Si alloy and a combination of the soft ferromagnetic material can be used as well.

The average grain size of the magnetic powder is not limited to 70 $\mu$m but it is optionally selected to meet the required magnetic characteristics such as core loss characteristics in the frequency region used, magnetic saturation and permeability.

Further, the yoke core of the present invention is applicable not only to the saddle-saddle type deflection yoke but also a semi-toroidal deflection yoke and a toroidal deflection yoke.

As mentioned in the foregoing, the yoke core of the present invention has a comparatively small core loss, and has an excellent mechanical strength because of strong bonding force between the surface-treated magnetic powder and the epoxy resin used as the binder, even when the weight ratio of the epoxy in the yoke core is small.

Thus, it is possible to increase the packing rate of the magnetic powder in the yoke core, resulting in a reduction of percentage of contraction caused by curing. Therefore, the yoke core holds a small deviation of permeability at every position, and has precise dimensions, which realizes a stable magnetic field distribution in the deflection yoke without additional cutting and grinding processes As a result, according to the present invention, it is possible to provide yoke cores having many kinds of shapes which have not been realized in the prior arts.

Next, the description is given of embodiments of the yoke core referred to drawings.

First Embodiment

Figure 43:
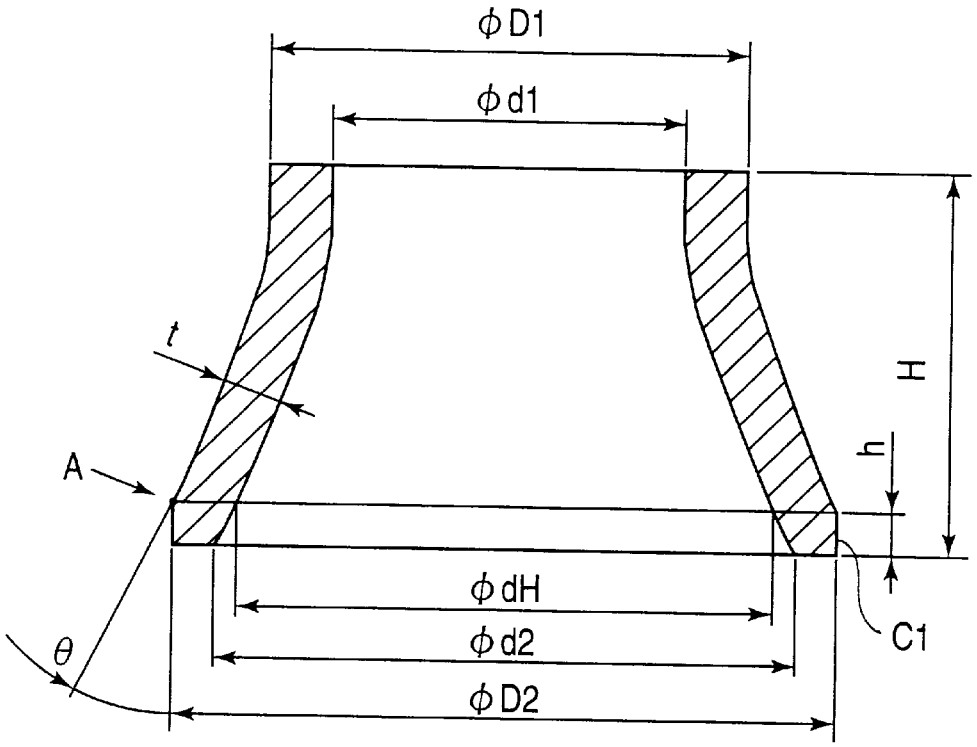
FIG. 43 is a sectional view showing an exemplary configuration of an ordinary circular conical deflection yoke core.
Figure 44:
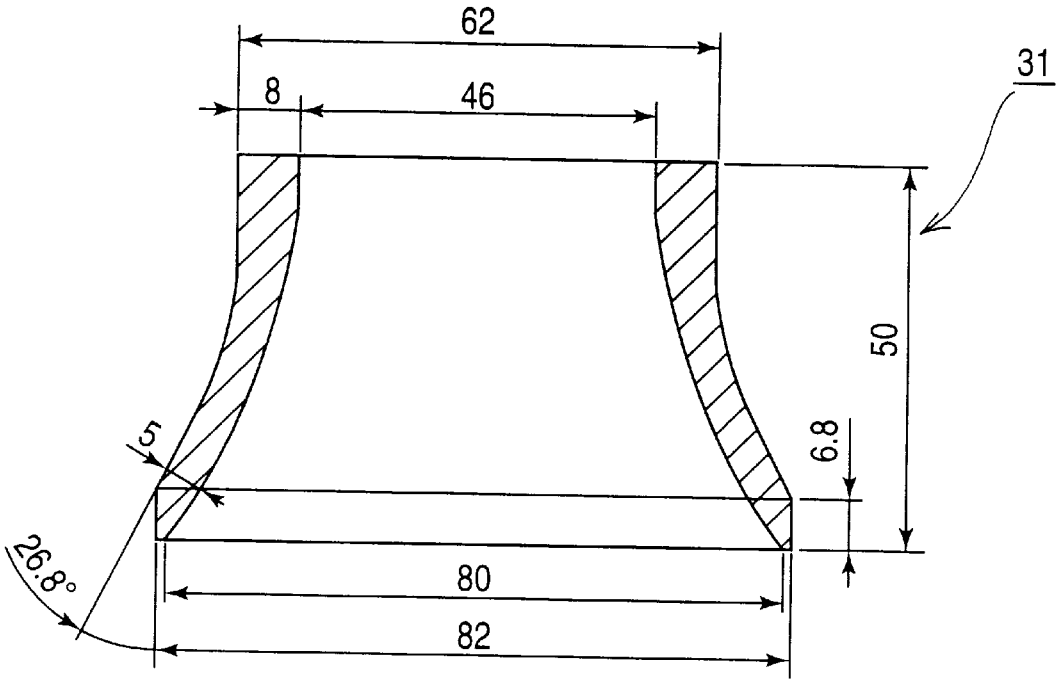
FIG. 44 is a sectional view showing an exemplary configuration and dimensions of a circular conical deflection yoke core of the present invention.

FIG. 43 is a sectional view showing an exemplary configuration of an ordinary circular conical deflection yoke core; and FIG. 44 is a sectional view showing an exemplary configuration and dimensions of a circular conical deflection yoke core of the present invention.

As shown in FIG. 43, an exemplary configuration of an ordinary circular conical deflection yoke core (referred to as yoke core) is generally determined by an inner diameter ϕd1 and an outer diameter ϕD1 of a distal end of a small diameter section and an inner diameter ϕd2 and an outer diameter ϕD2 of a distal end of a large diameter section and a height H of the yoke core. Further, a cylindrical part C1 having a length of h is defined at the distal end of the outer diameter ϕD2 so as to be parallel to a center axis (not shown) in a height direction (longitudinal direction) of the yoke core. The thickness t of the conical section is determined by an angle θ defined by an extended line of the conical part and the cylindrical part C1, wherein a reference character ϕdH represents an inner diameter at an intersecting point A of an extended line of the conical part and an extended line of the cylindrical part C1.

In the prior arts, the angle θ is determined so that the thickness t of the conical part is uniform.

Thus, when a deflection operation is performed by flowing a horizontal and a vertical current through the deflection coils, the maximum magnetic flux density flowing through the yoke core is more reduced as the magnetic flux comes close to the large diameter section from the small diameter section.

Further, the magnetic density in a circumferential direction at an arbitrary height of the yoke core is different to each other.

TABLE 2

| position | saddle-saddle type | | semi-toroidal type | |
|---|---|---|---|---|
| of height measured | max. mag. flux dnsty | comparison | max. mag. flux dnsty | comparison |
| *1 | 80 mT | 1 | 151 mT | 1 |
| *2 | 72 | 0.9 | 129 | 0.85 |
| *3 | 65 | 0.81 | 101 | 0.67 |
| *4 | 57 | 0.71 | 90 | 0.60 |

*1: at the distal end of the small diameter part
*2: at a position close to the small diameter part
*3: at a position close to the large diameter part
*4: at the distal end of the large diameter part Table 2 shows the maximum magnetic flux density at a certain position in a direction of the height h of the yoke core.

As shown in Table 2, in the saddle-saddle type deflection yoke, the maximum magnetic flux density at a position close to the large diameter part is reduced to be 80% compared to that at the distal end of the small diameter part, and in the semi-toroidal deflection Yoke where the horizontal and vertical deflection coils are directly wound around the yoke core in a toroidal shape, the maximum magnetic flux density at the position close to the large diameter part is reduced to be not more than 70% compared with that at the distal end of the small diameter part.

In this embodiment, the yoke core is produced by employing the magnetic powder treatment technique mentioned above where a magnetic powder molded material having an optional configuration can be produced by only curing an epoxy resin at such a low temperature as 160° C. Thus, it is possible to produce the yoke core of which thickness is gradually made smaller in the height direction from the small diameter part to the large diameter part,with a small deviation in the dimensions in the production process. Thereby, the magnetic flux density through the yoke core can be made uniform by controlling the thickness t of the yoke core.

FIG. 44 is a section showing an exemplary dimensions of the yoke core in the present invention.

Specifically, as shown in FIG. 44, in the saddle-saddle type deflection yoke 31, the ratio of the thickness t at the position close to the distal end portion of the large diameter part to that of the small diameter part is made to be 80%, and in the semi-toroidal deflection yoke, the ratio of the thickness t at the position close to the distal end portion of the large diameter part to that of the small diameter part is made to be 70%.

Figure 45:
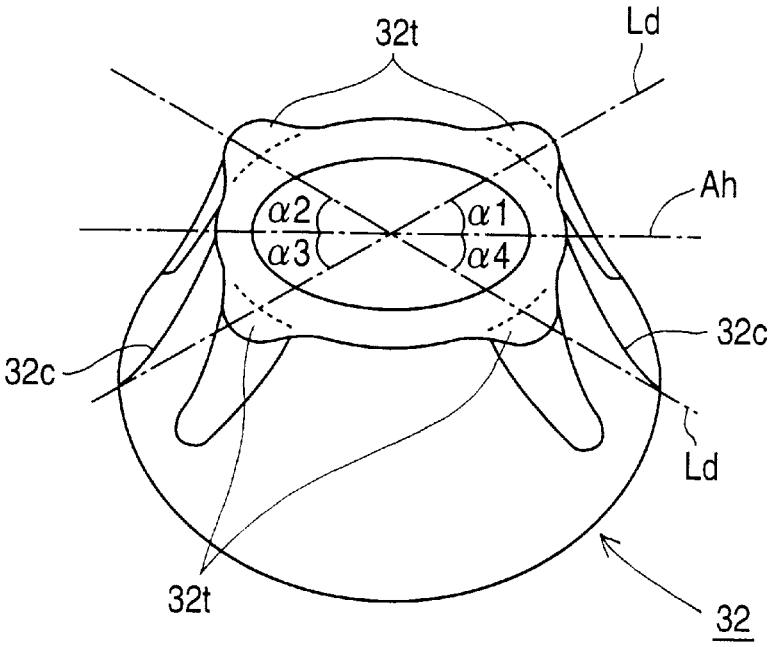
FIG. 45 is a perspective view showing one of another pair of yoke cores in the present invention.
Figure 46:
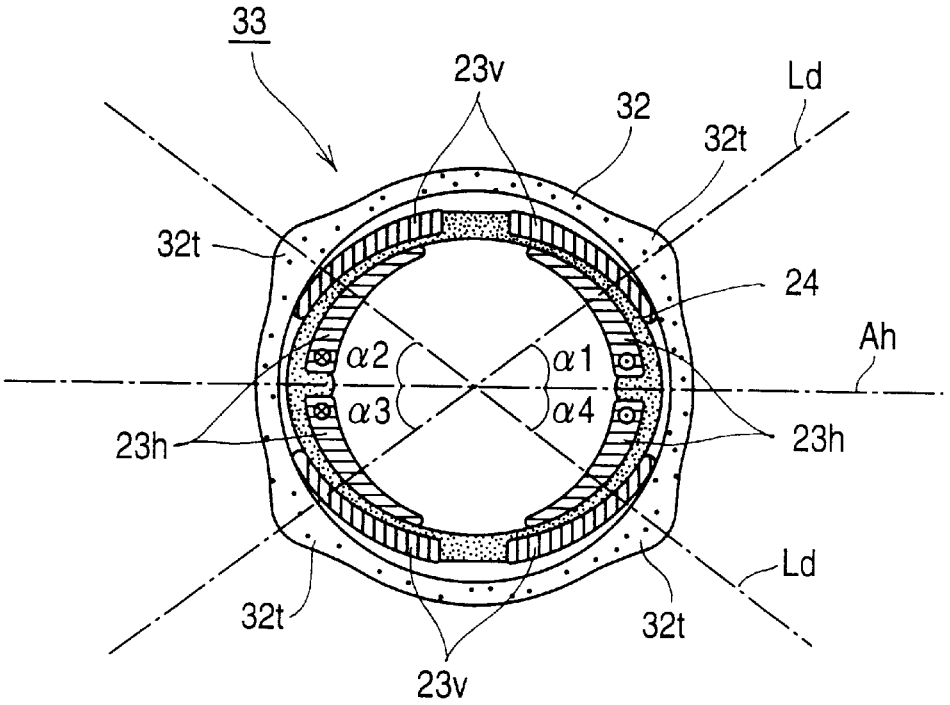
FIG. 46 is a sectional view of a deflection yoke in which the yoke core shown in FIG. 45 is mounted.

FIG. 45 is a perspective view showing one of another pair of yoke cores in the present invention, and FIG. 46 is a sectional view of a deflection yoke in which the yoke core shown in FIG. 45 is mounted, As shown in FIG. 45, in this embodiment, the yoke core 32 has four humps 32*t* on the conical surface at positions corresponding to a pair of diagonal lines Ld with respect to a display face of the CRT on a section at the small diameter part in such a manner that a height of each of the humps 32*t* is reduced gradually from the small diameter part toward the large diameter part of the yoke core 32. Thereby, the magnetic flux density in the yoke core 32 is kept approximately constant at any section of the yoke core. In this embodiment, the height of each of the humps 32*t* is made to be zero before reaching to the large diameter part.

In FIG. 45, there are shown angles α1 to α4 defined between the diagonal lines Ld and a horizontal axis Ah of the yoke core 32. In a CRT having an aspect ratio of 4:3, each of the angles α1 to α4 is made to be 37°, and in a CRT having an aspect ratio of 16:9, each of the angles α1 to α4 is made to be 30°. In FIG. 46, there is shown a section of the deflection yoke 33 in which the yoke core 32 shown in FIG. 45 is mounted, at a position close to the small diameter part of the yoke core 32.

According to the deflection yokes 31, 32 shown in FIGS. 44 and 45, upon operation it is possible to make the magnetic flux density in the yoke core to be uniform at any position from the small diameter part to the large diameter part in the height direction (CRT's longitudinal axis direction) and in the section of the yoke core.

In addition, it is possible to effectively reduce an amount of the magnetic powder used, a weight of the yoke core, the deflection electric power, and a rise of temperature of the yoke core.

Figure 47:
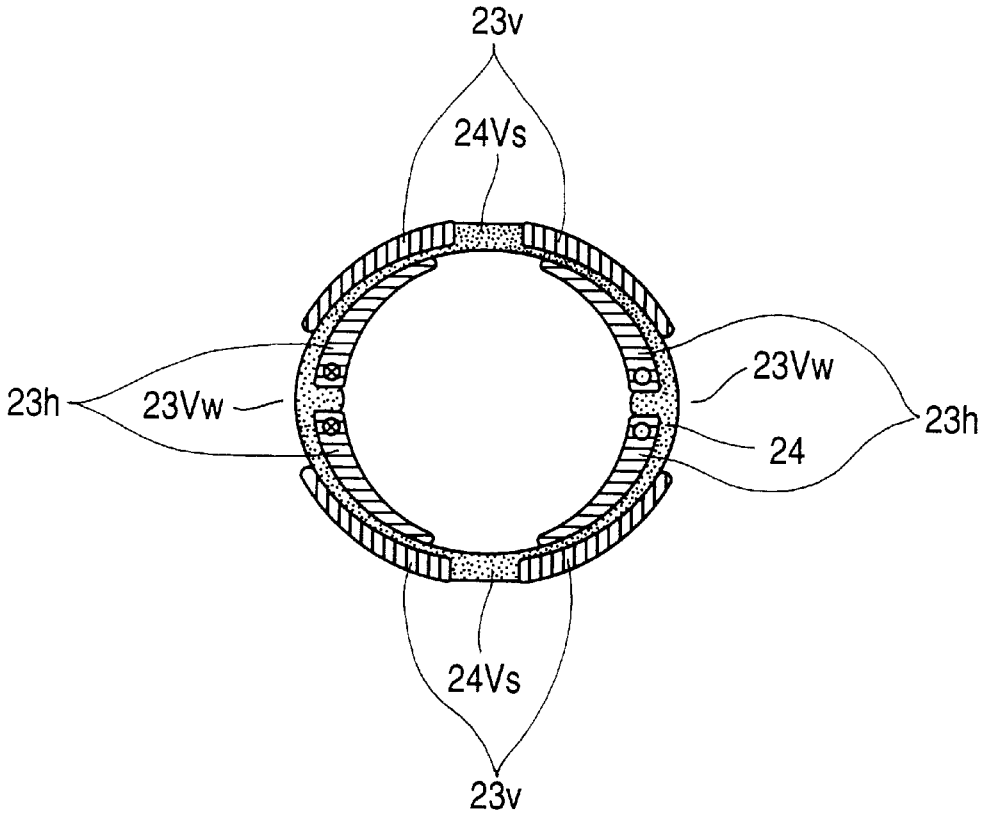
FIG. 47 is a sectional view close to a neck of a deflection yoke of the CRT (a deflection yoke assembly) where the yoke core is removed.
Figure 48:
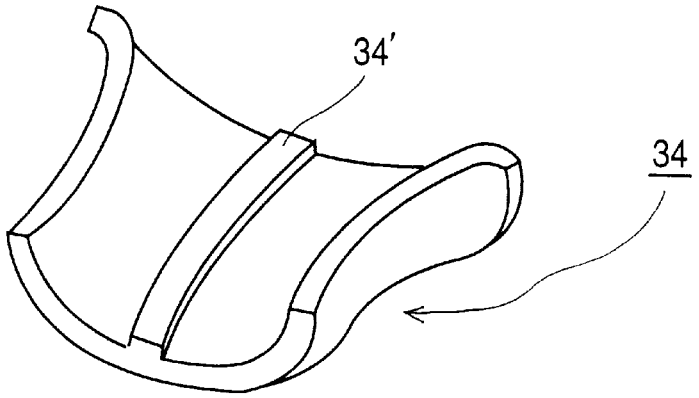
FIG. 48 is a perspective view of one of the yoke cores in the present invention having a convex portion in the inner surface thereof to be mounted on the deflection yoke assembly shown in FIG. 47.

FIG. 47 is a sectional view close to a neck of a deflection yoke of the CRT (a deflection yoke assembly) where the yoke core is removed;

FIG. 48 is a perspective view of one of the yoke cores In the present invention having a convex portion in the inner surface thereof to be mounted on the deflection yoke assembly shown in FIG. 47.

Next, the description is given of an example of a further improvement of the yoke core.

As shown in FIG. 47, a deflection yoke assembly comprises a separator 24, a pair of vertical deflection coils 23*v*, 23*v* defining windows 23V*w*, 23V*w*between the pair and a pair of horizontal deflection coils 23*h*, 23*h* defining windows 23*hw*, 23*hw* between the pair. The vertical deflection coils 23*v*, 23*v* are provided on an outer surface of a separator 24 and the horizontal deflection coils 23*h*, 23*h* are provided on an inner surface of the separator 24. In FIG. 47, reference characters 24V*s*, 24V*s* denote protruding parts for positioning the vertical deflection coils 23*h*, 23*h* to a predetermined position of the separator 24.

Figure 49:
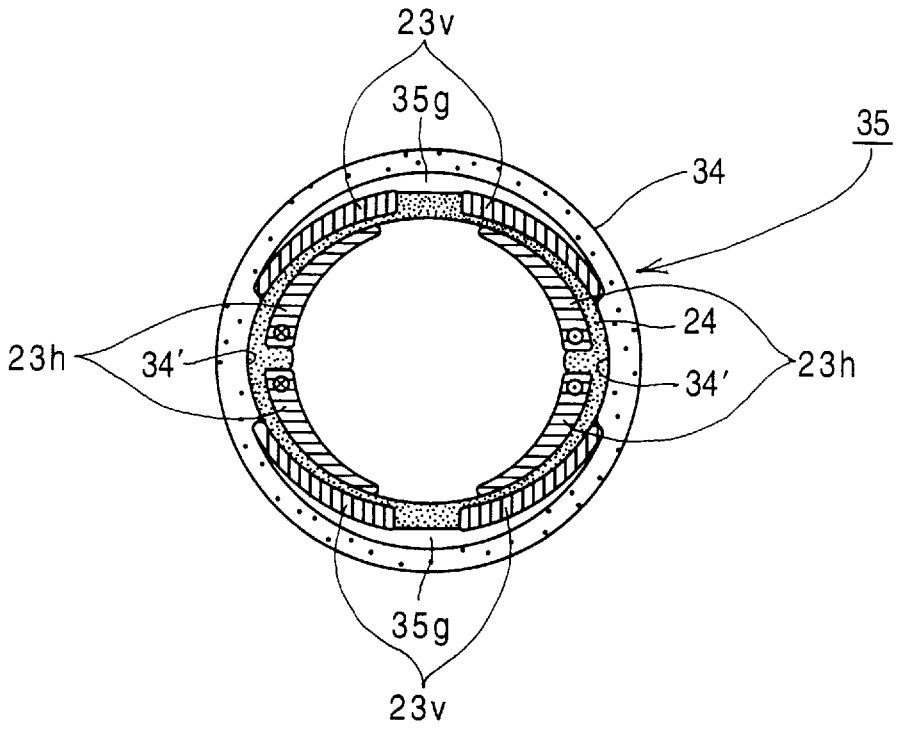
FIG. 49 is a sectional view showing the deflection yoke having the yoke core shown in FIG. 48 in the present invention.

FIG. 49 is a sectional view showing the deflection yoke having a yoke core shown in FIG. 48 in the present invention.

On the deflection yoke shown in FIG. 49, a yoke core 34 shown in FIG. 48 is mounted. The yoke core 34 has a rib 34' on an inner surface of the yoke core 34 along a center line (not shown) from the small diameter part to the large diameter part. As shown in FIG. 49, when a pair of the yoke cores 34, 34 is mounted on a deflection yoke 35, the ribs 34', 34' are positioned in the windows 23V*w*, 23V*w* of the vertical deflection coils 23*v*, 23*v*, and defines gaps 35*g*, 35*g* between the yoke cores 34, 34 and the vertical coils 23*v*, 23*v*.

Figure 50:
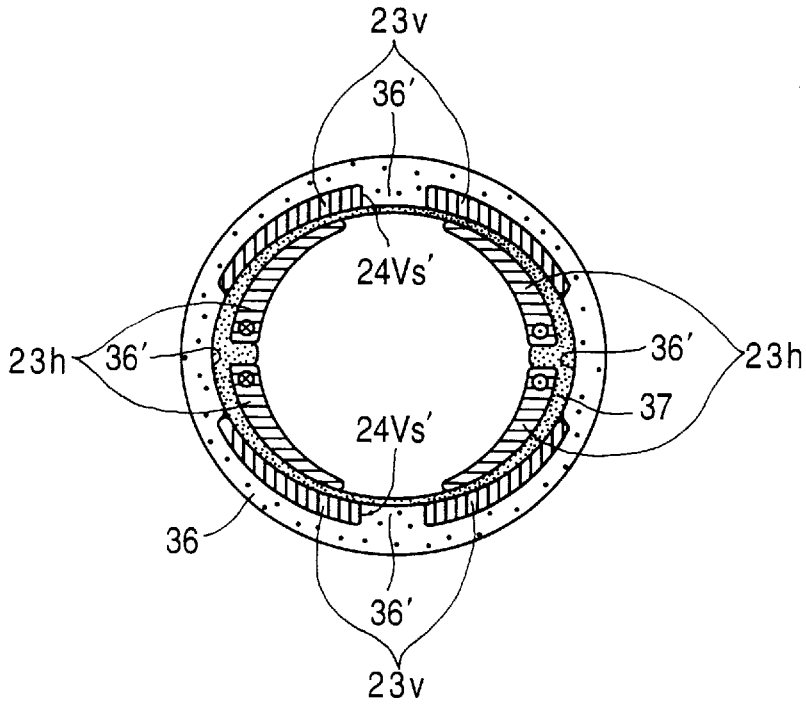
FIG. 50 is a sectional view of the deflection yoke shown in FIG. 47 wherein a pair of another yoke cores is mounted thereon.

FIG. 50 is a sectional view of the deflection yoke shown in FIG. 47 wherein a pair of another yoke cores is mounted thereon.

Figure 51:
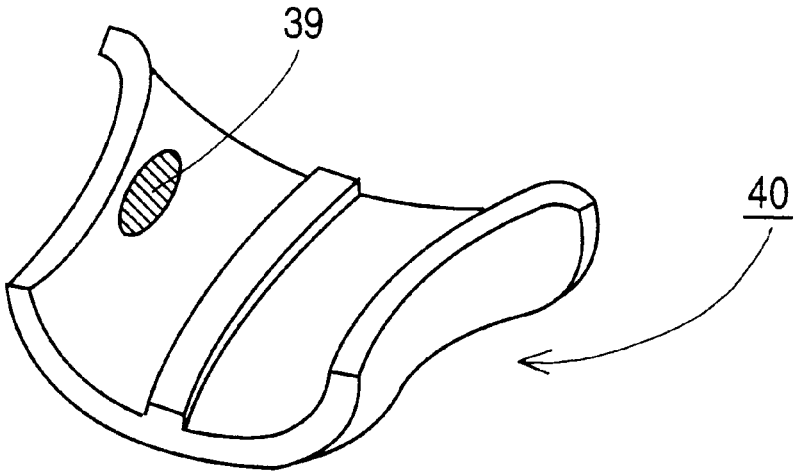
FIG. 51 is a perspective view showing one of other pair of yoke cores in the present invention having a concave portion in the inner surface thereof.

As shown In FIG. 50, a yoke core 36 is provided with ribs 36', 36' and 36", 36" on the inner surface thereof, and is mounted on another deflection coil assembly having a separator 37, the vertical deflection coils 23*v*, 23*v* and the horizontal deflection coils 23*h*, 23*h*. The ribs 36', 36' are positioned on the windows 23V*w*, 23V*w* as well, and the ribs 36", 36" are fitted to spaces 24V*s'*, 24V*s'* corresponding to positions of the protruding parts 24V*s*, 24V*s* shown in FIG. 47. In other words, the separator 37 is not provided with the protruding parts 24V*s*, 24V*s* for positioning. Further, the yoke core 36 has an ellipsoidal shape to allow the gaps 35*g*, 35*g* shown in FIG. 48 to be eliminated. FIG. 51 is a perspective view showing one of other pair of yoke cores in the present invention.

As shown in FIG. 51, a dent 39 can be provided on a certain position in the inner surface of one of a pair of yoke core 40.

According to the above-mentioned embodiments of the yoke cores where the protruding parts 34', 36' and 36" and the dent 39 are provided on the inner surface thereof, it is possible to enhance or weaken the intensity of magnetic field of the corresponding portions. This fact enables a partial compensation of a horizontal and vertical magnetic field distribution which can not be realized by only changing a distribution of winding coil of the deflection coil 23.

Accordingly, it is possible to effectively obtain a desired magnetic field distribution by employing a combination of the compensation of the winding coil distribution and the shape of the yoke cores and a selective combination of the protruding parts 34', 38', 36" and the dent 39, resulting in an excellent deflection yoke having less color deviation and distortion without increasing the production cost.

Further, it is possible to increase the deflection sensitivity by providing the protruding parts 34', 36' at such positions having no winding as the windows 23V*w* of the vertical deflection coil 23*v* because of shortening the inner diameter at the corresponding positions.

Further more, the horizontal deflection power can be reduced by placing the inner surface of the yoke core possibly close to the vertical deflection coils 23*v*, 23*v* because of the ellipsoidal shape of the Yoke core of which inner diameter in an upper and lower direction thereof is made to be shorter.

Second Embodiment

Next, the description is given of a yoke core having a rectangular cone shape as a second embodiment of the present invention.

Figure 62:
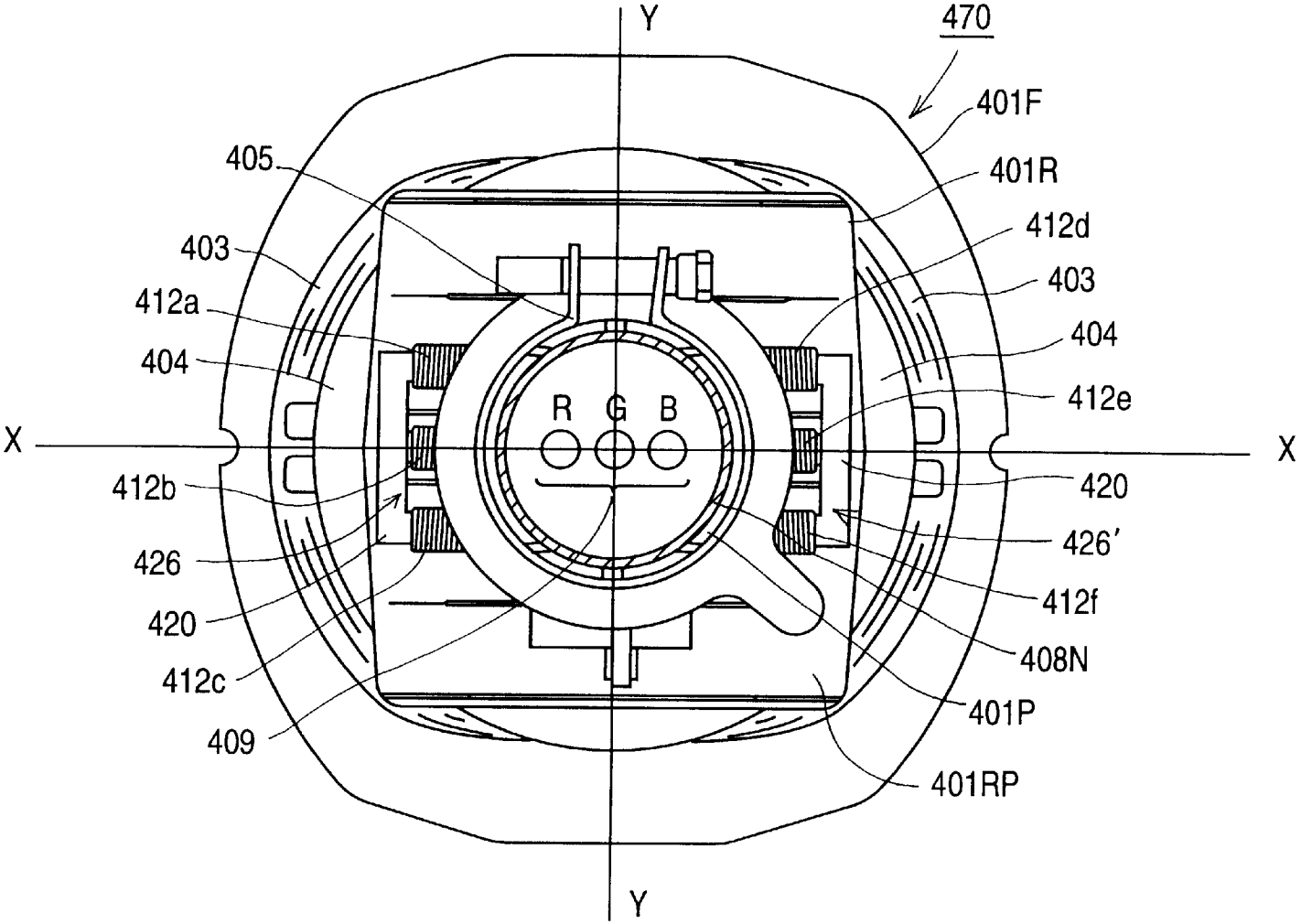
FIG. 62 is a back view of a deflection yoke of the fifth embodiment of the present invention.

FIG. 62 is a perspective view showing a color CRT having a rectangular cone.

Figure 52:
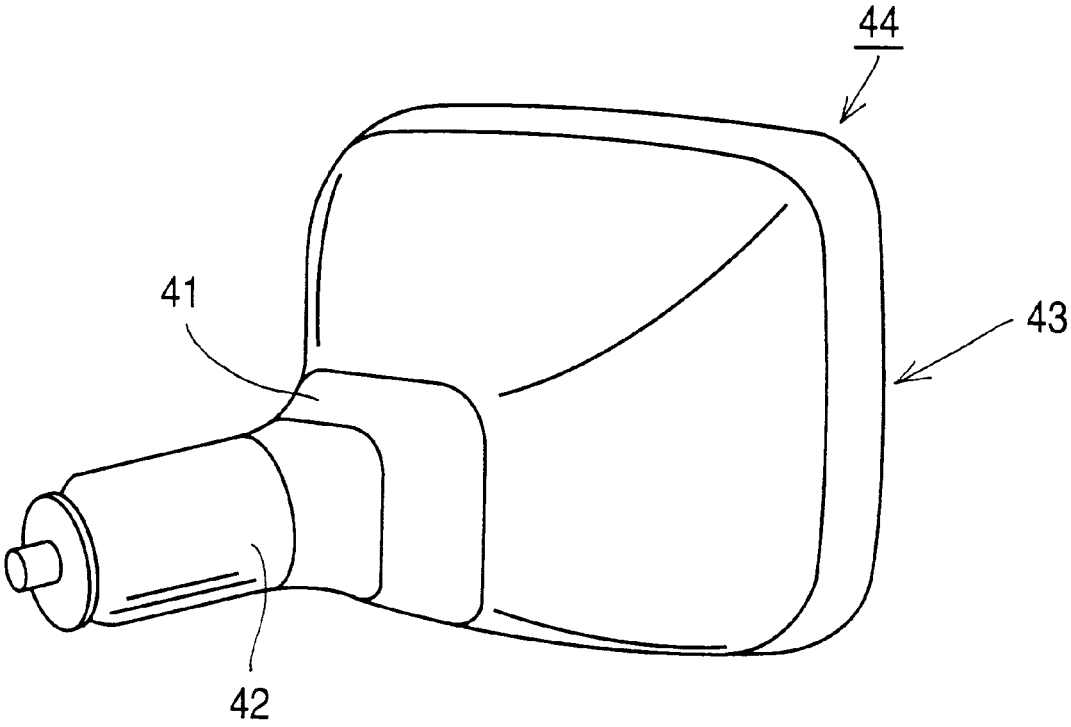
FIG. 52 is a perspective view showing a color CRT having a rectangular cone.

As shown in FIG. 52, there is proposed a color CRT 44 having a rectangular cone section 41 as a RIS (rectangular cone, in-line gun system) type color CRT, wherein the rectangular cone section 41 has a rectangular shape similar to a display surface 43 of the color CRT at a large diameter side (a display surface side of the color CRT) and an about circular shape at a small diameter side (a neck tube side 42).

Figure 53:
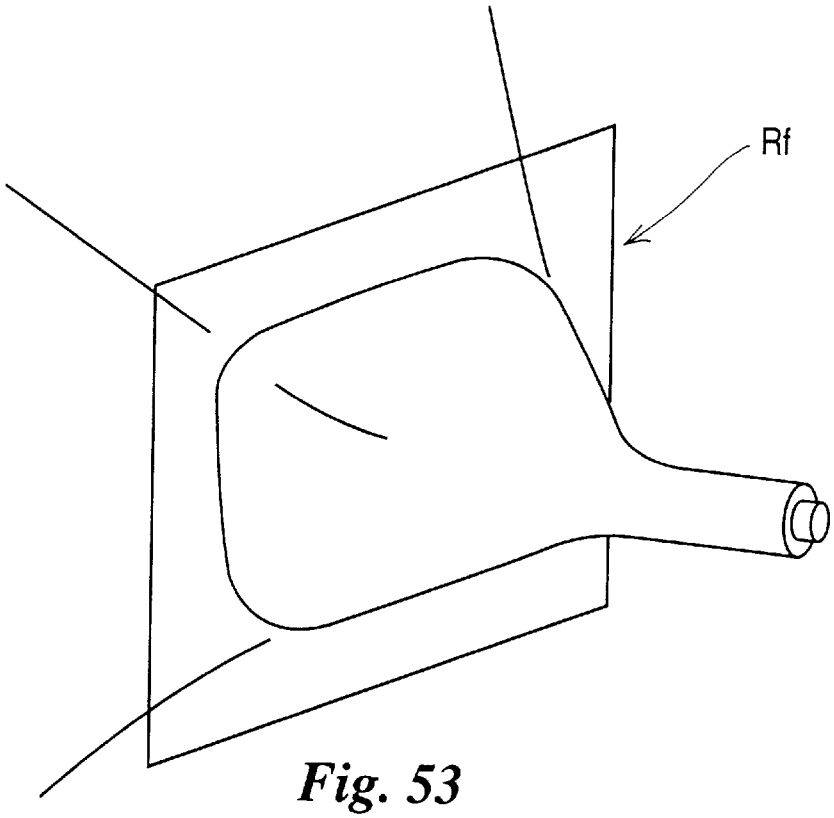
FIG. 53 is an enlarged view of the rectangular cone section shown in FIG. 52.
Figure 54:
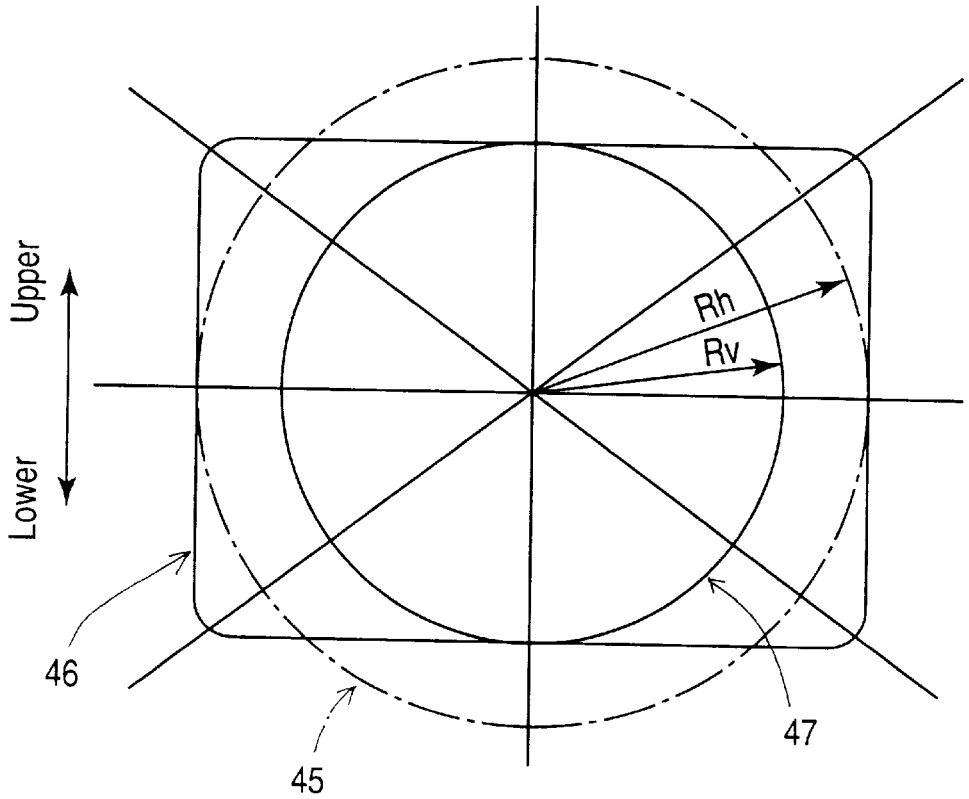
FIG. 54 is a diagram showing a comparison of shape with respect to a reference surface Rf between the circular cone and the rectangular cone.

FIG. 53 is an enlarged view of the rectangular cone section 41 shown in FIG. 52, and FIG. 54 is a diagram showing a comparison of shape with respect to a reference surface Rf between the circular cone and the rectangular cone.

As shown in FIG. 54, the circular cone has a circular shape 45 having a radius of Rh as shown with one dotted chain line at a reference surface Rf shown in FIG. 53. On the other hand, the rectangular cone has a rectangular shape 46 having a long line In a horizontal direction as shown with a real line, wherein a reference character 47 represent an inscribed circle having a radius Rv of the rectangular shape, of which top and bottom contact respective long lines in the horizontal direction. Further, a ratio, Rv:Rh, is approximately determined to be a ratio of a lateral length to a longitudinal length of the display surface 43.

As the rectangular cone section 41 of the color CRT has such a rectangular cone shape, the deflection yoke used has such a rectangular cone at the large diameter part and a circular cone at the small diameter part. Thus, the yoke core used has also the same shape as that of the deflection yoke.

Figure 55:
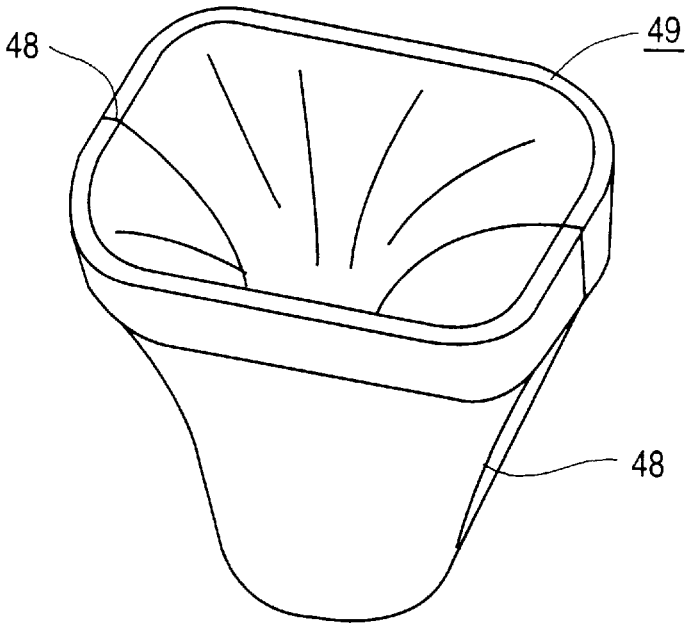
FIG. 55 is a perspective view of a yoke core used in the in-line gun system (RIS) type color CRT shown in FIG. 52.

FIG. 55 is a perspective view of a yoke core used in the RIS type color CRT shown in FIG. 52.

As shown in FIG. 55, the shape of the yoke core 49 is made to have a rectangular cone at the large diameter part. The shape at the small diameter part thereof is optionally selected from a group of a circular cone, an elliptical cone and a rectangular in accordance with the aspect ratio, the beam deflection angle, the diameter of the neck tube and the magnetic field distribution required. In FIG. 55, a reference character 48 denotes a separation line of the yoke core 49.

In a ferrite core in the prior art, cracks often occur when sintered. Thus, it was impossible to mass-produce such a shape yoke core as having the rectangular cone at a low cost.

According to the present invention, however, it is possible to mass-produce the yoke core 49 at a low cost.

In the yoke core 49 having the rectangular cone shape, the size in an upper and lower direction (FIG. 54) thereof is reduced to 75% at the aspect ratio of 4:3, and to 56% at the aspect ratio of 16:9 compared with the size of the yoke core having the circular cone shape. This means that a magnetic pole distance of the horizontal deflection magnetic field is reduced according to the reduction of the size in the upper and lower direction.

As the horizontal deflection electric power required is increased in proportion to the magnetic pole distance, the electric power of the yoke core 49 is reduced to 75% at the aspect ratio of 4:3 and to 56% at the aspect ratio of 16:9 compared with that of the yoke core having a circular cone.

Further, the diagonal of the rectangular cone is increased to 1.2 times as large as that of the circular cone. Thus, the neck shadow caused by butting of the electron beam against the cone is improved. Accordingly, it is possible to reduce the deflection electric power by increasing the length of the deflection coil or to reduce a size of the CRT in a depth direction (or a height direction) by increasing a deflection angle by increasing the deflection electric power a little.

Third Embodiment

Figure 56:
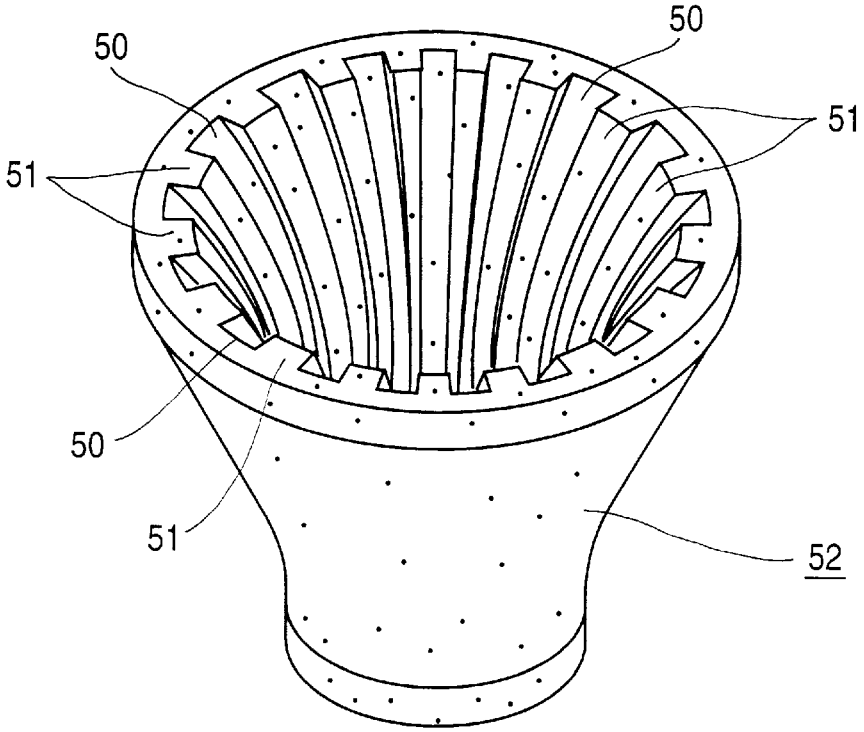
FIG. 56 is a perspective view of a yoke core of other embodiment of the present invention.

FIG. 56 is a perspective view of a yoke core of other embodiment of the present invention.

As shown in FIG. 56, a yoke core 52 of this embodiment has a plurality of ditches 50 and ribs 51 distributed radially over the inner surface of the yoke core 52 extending in the tube axis direction to improve the deflection sensitivity and the magnetic field distribution in the CRT for a super high definition display. The ditches 50 are used for winding deflection coils.

Figure 57:
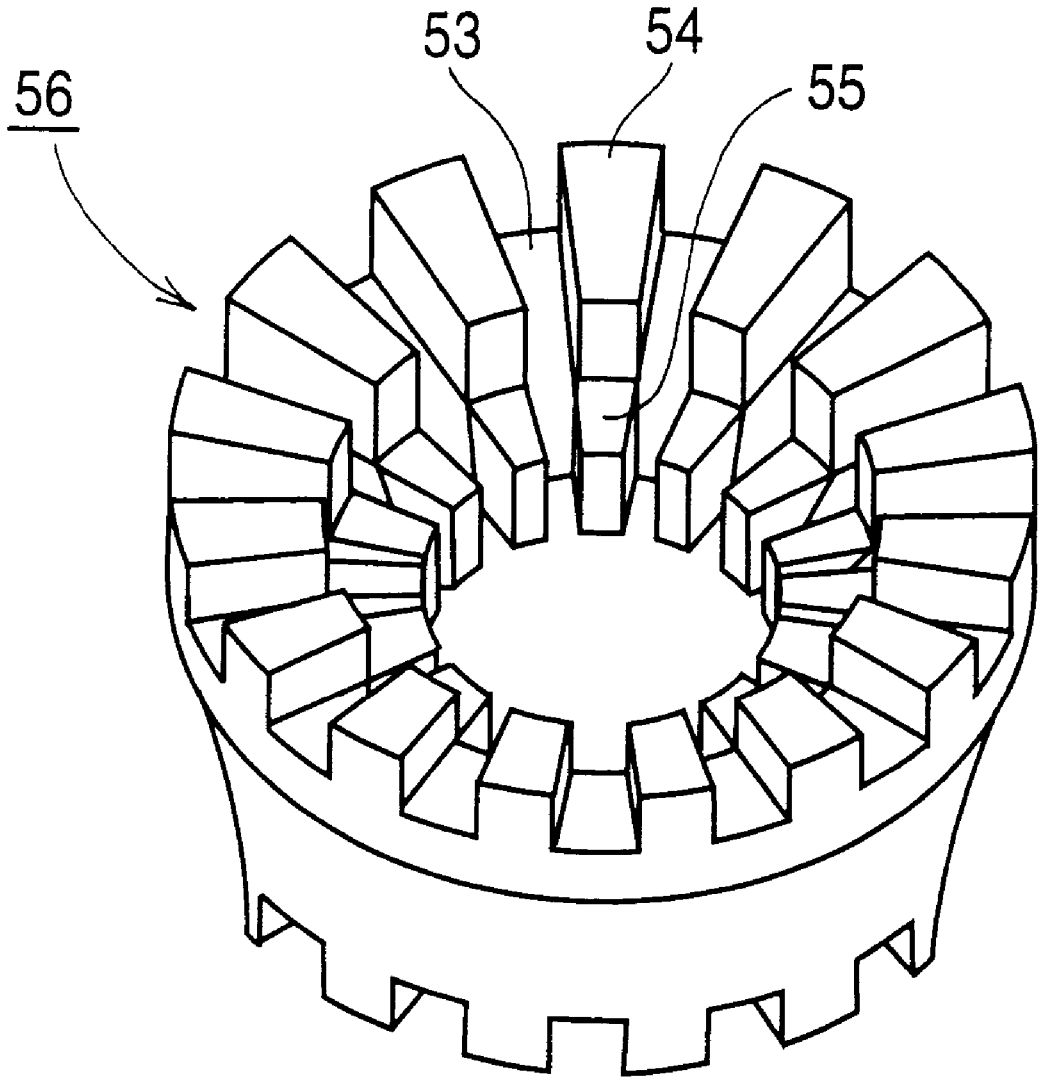
FIG. 57 is a perspective view of a yoke core of other embodiment of the present invention.

FIG. 57 is a perspective view of a yoke core of other embodiment of the present invention.

As shown in FIG. 57, a yoke core 56 of this embodiment has a plurality of radially distributed ditches 53 on the inner surface of the yoke core 56 extending in the tube axis direction. Further, a plurality of cutouts 55 are defined circularly across a plurality of ribs 54 formed alternately with the ditches 53.

The yoke cores 52, 56 having such a complicated shape are used as the yoke core of the CRT for the super high definition display.

In a high horizontal deflection frequency range of more than 100 kHz, abnormal heat generation is apt to be develop at many parts of the deflection yoke caused by an eddy current loss and a skin effect loss in the horizontal and vertical deflection coils. However, these yoke cores 52, 56 prevent the abnormal heat development.

In the ferrite yoke core in the prior arts, it was necessary to increase the thickness of the yoke core to prevent the deformation thereof caused by sintering, and was impossible to obtain the precise dimensions thereof.

According to the present invention, it is possible to obtain such yoke cores without increasing an extra thickness. This fact enables the mass-production of the yoke cores having such complicated shapes as mentioned in the foregoing.

Specifically, according to the yoke cores 52, 56 of the present invention, it is possible to minimize a distance between the inner surfaces of the yoke cores 52, 56 and the cone section 41 of the CRT, and yet the magnetic path of the magnetic fluxes within the yoke cores 52, 56 is well secured, resulting in a reduction of the deflection current. This lowers the heat development in the deflection yokes 52, 56.

As mentioned in the foregoing, according to the present invention, the yoke core has precise dimensions because the yoke core is obtained from a heat-cured molded magnetic material of the magnetic powder surface-treated with the surface treatment agent containing a compound having an aminoquinone group as a composition unit, and the binder of a resin. Thus, it is possible to produce many kinds of yoke cores without an additional working process, resulting in a low production cost of the yoke core. In addition, the yoke core has excellent magnetic characteristics due to its less eddy current loss.

Fourth Embodiment

Figure 58:
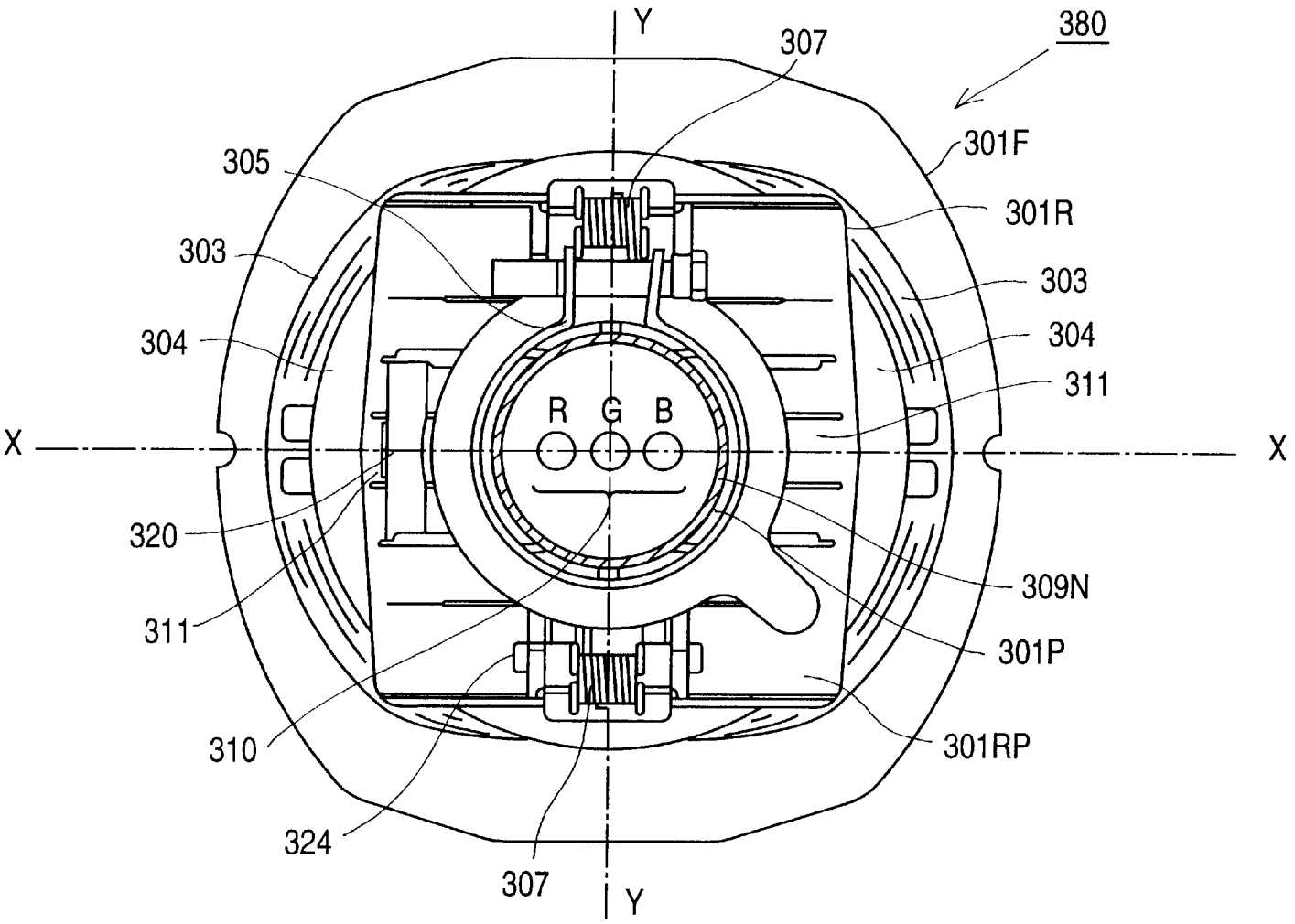
FIG. 58 is a rear view of a deflection yoke of a fourth embodiment of the present invention.
Figure 59:
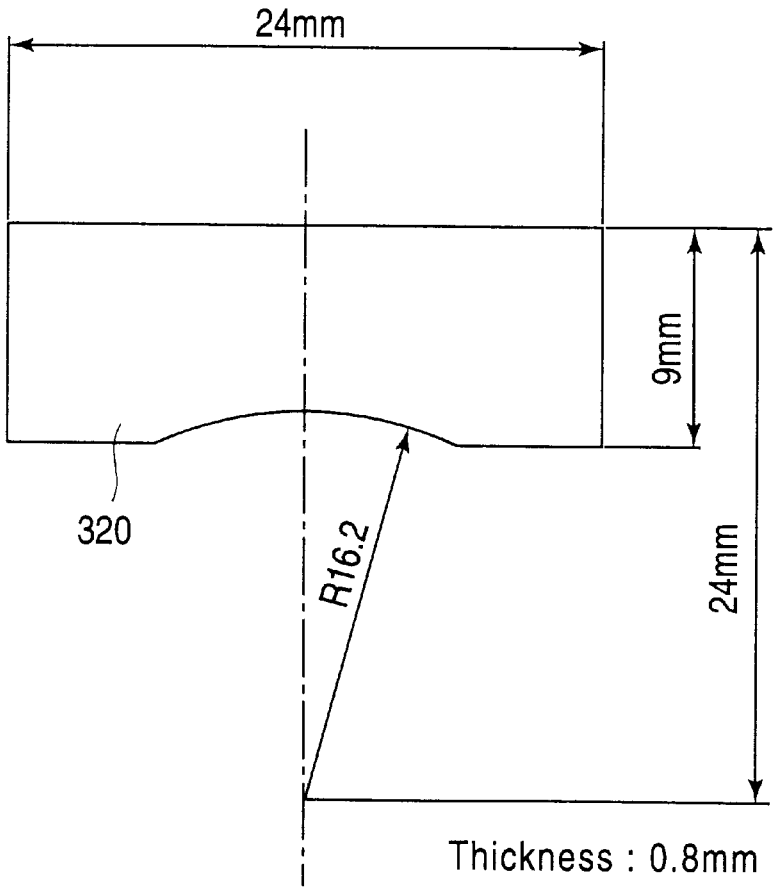
FIG. 59 is a plan view showing a compensation magnetic plate used in the deflection yoke shown in FIG. 58.
Figure 60:
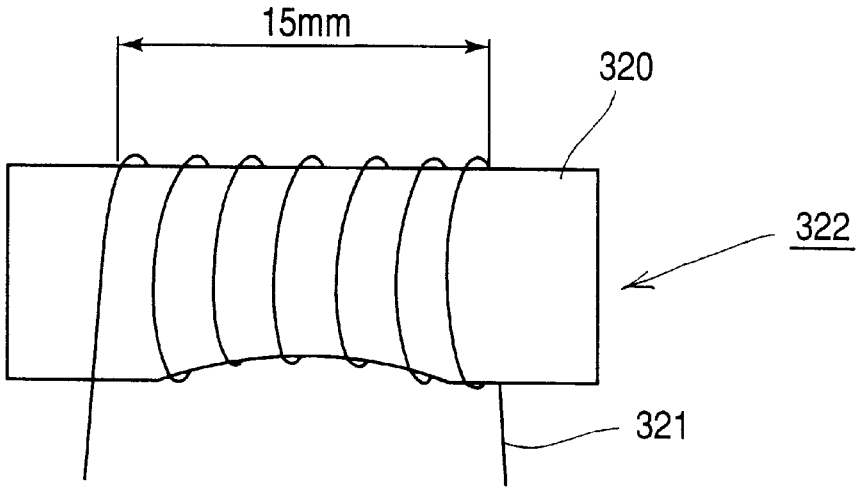
FIG. 60 is a plan view showing the compensation magnetic plate shown in FIG. 69, around which a coil is wound.
Figure 61:
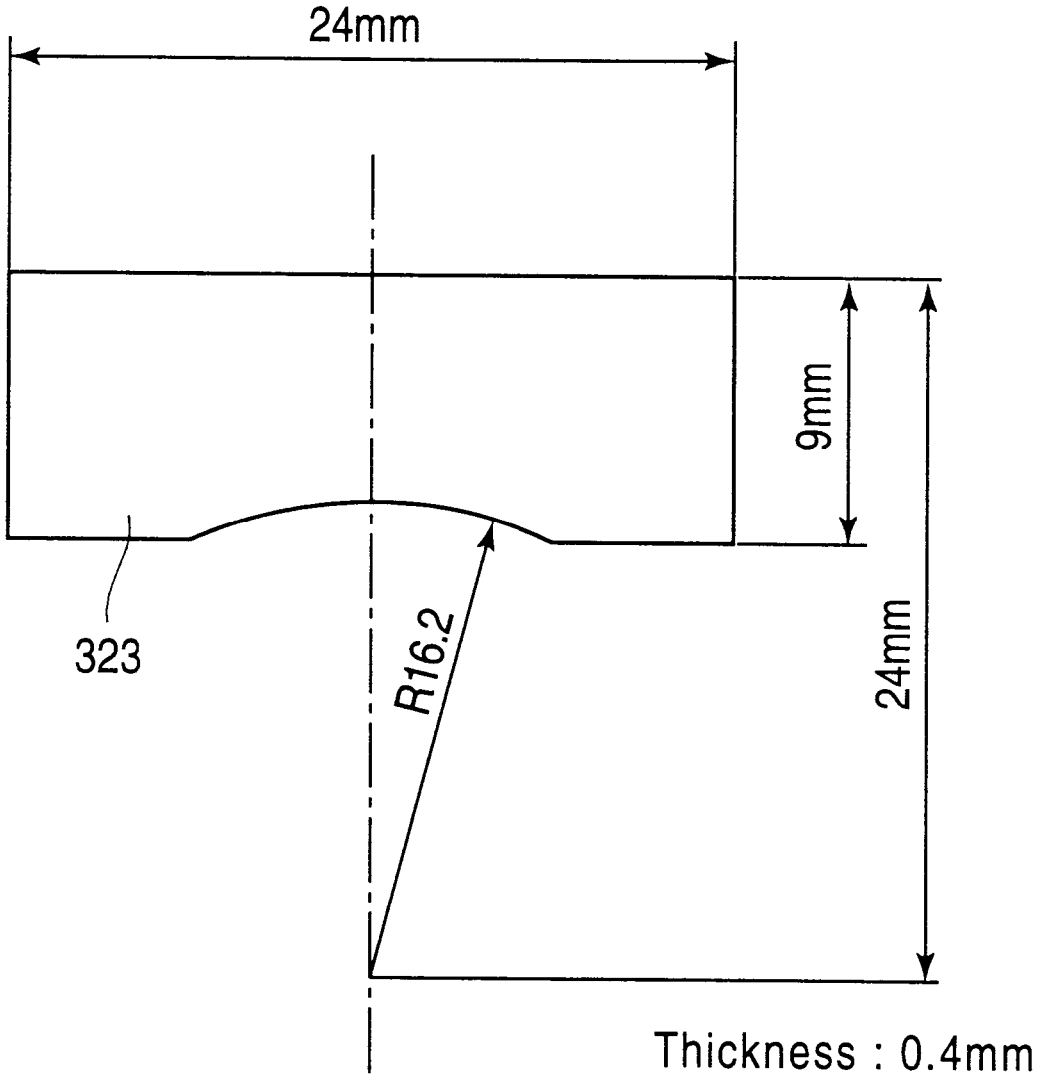
FIG. 61 is a plan view showing a compensation magnetic plated used in a deflection yoke as a comparative example.

FIG. 58 is a rear view of a deflection yoke of a fourth embodiment of the present invention;

FIG. 59 is a plan view showing a compensation magnetic plate used in the deflection yoke shown in FIG. 58;

FIG. 60 is a plan view showing the compensation magnetic plate shown in FIG. 59, around which a coil is wound, and FIG. 61 is a plan view showing a compensation magnetic plated used in a deflection yoke as a comparative example.

Figure 14:
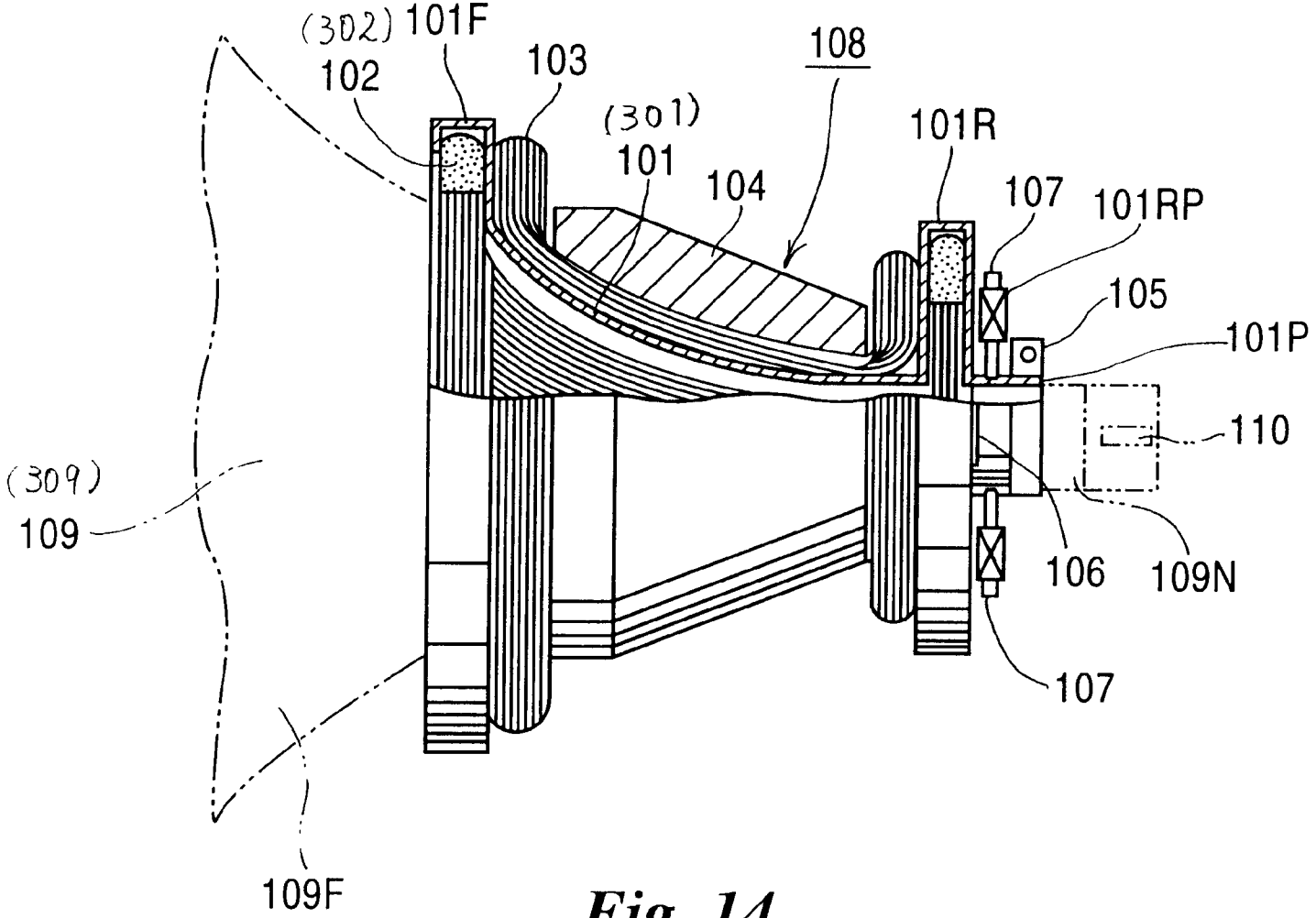
FIG. 14 is a partially broken section showing a deflection yoke mounted on the CRT.
Figure 15:
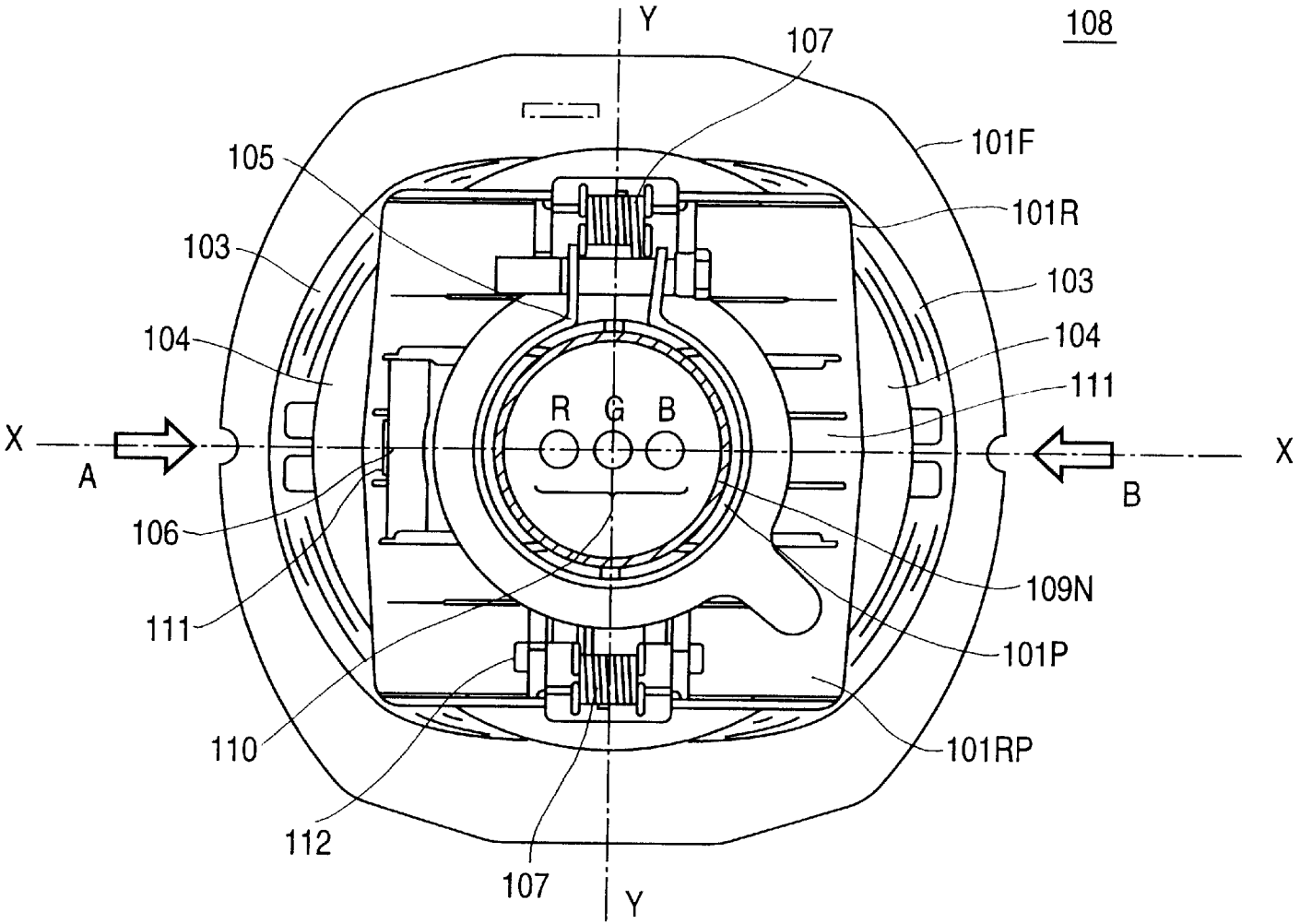
FIG. 15 is a right side view of FIG. 14.
Figure 16:
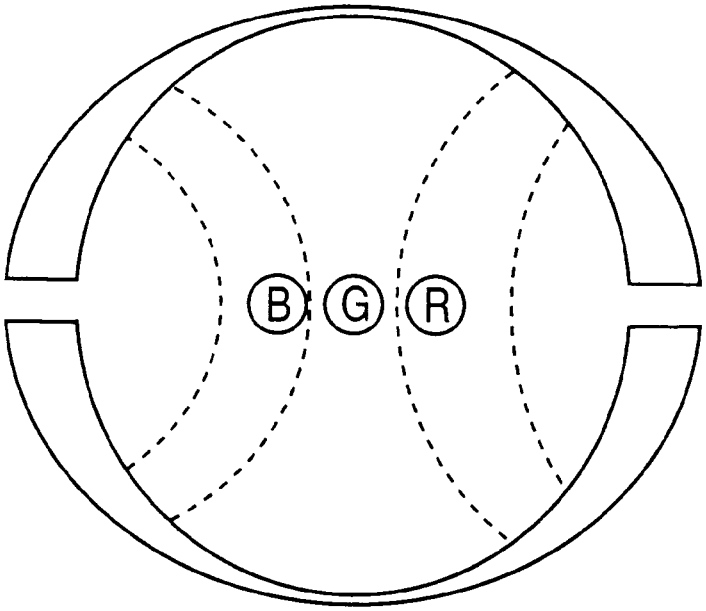
FIG. 16 is a schematic view showing an example of an unsymmetrical horizontal magnetic field.
Figure 17:
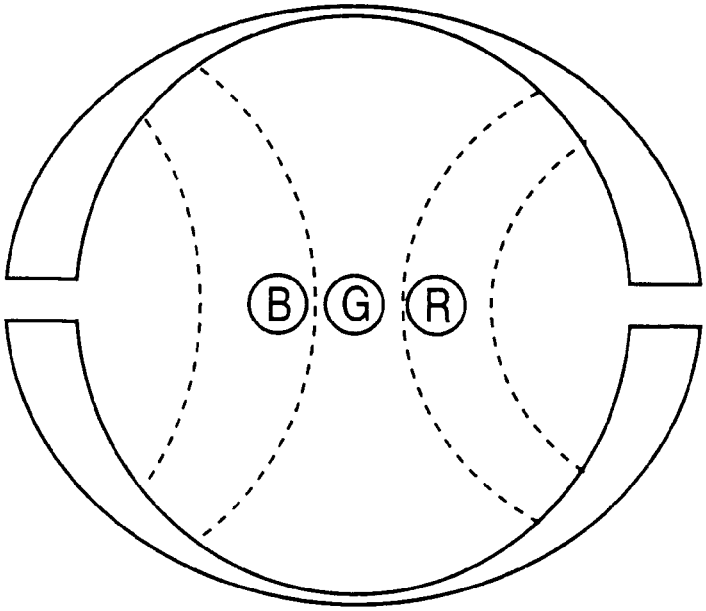
FIG. 17 is a schematic view showing another example of an unsymmetrical horizontal magnetic field.
Figure 18:
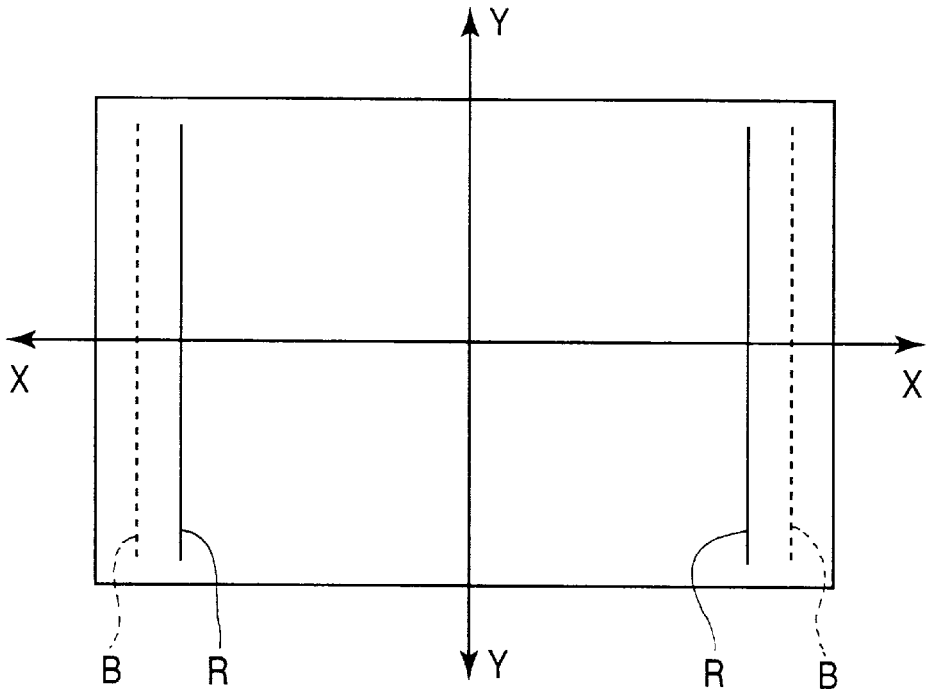
FIG. 18 is a schematic view showing an example of the misconvergence $X_H$ according to the unsymmetrical horizontal magnetic field shown in FIG. 16.
Figure 19:
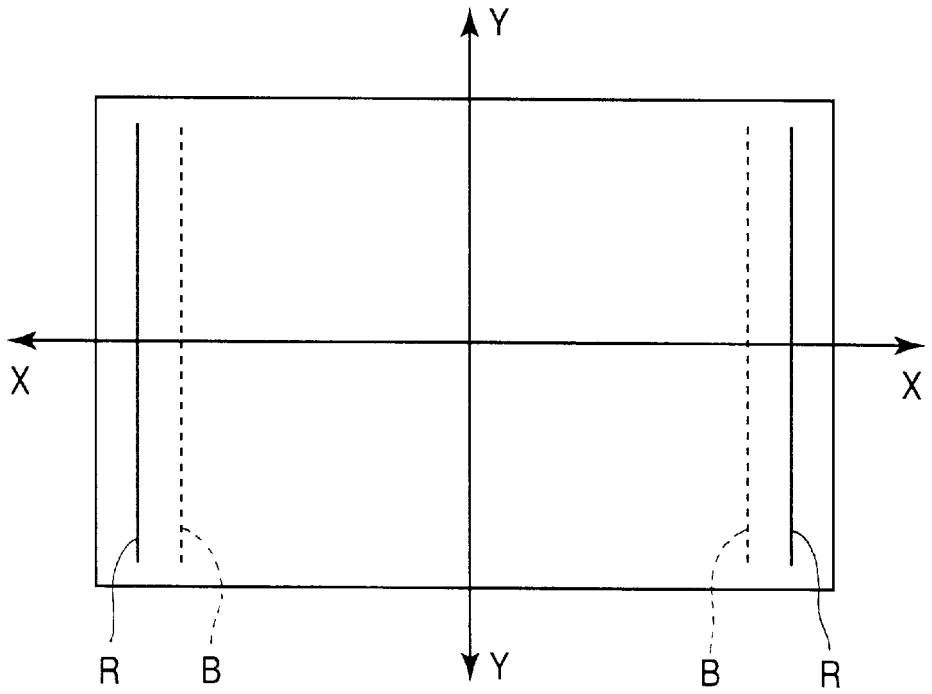
FIG. 19 is a schematic view showing another example of the misconvergence $X_H$ according to the unsymmetrical horizontal magnetic field shown in FIG. 17.
Figure 20:
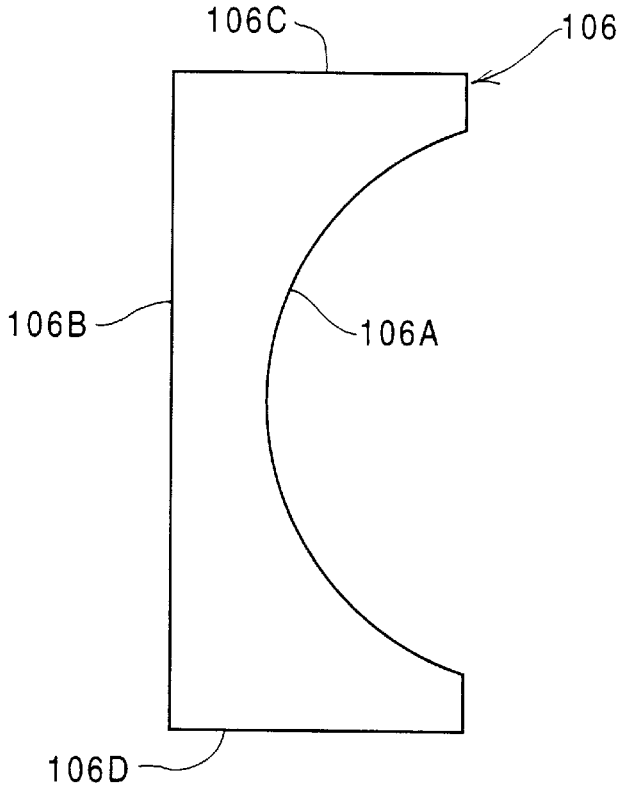
FIG. 20 is a plan view showing a compensation magnetic plate.
Figure 21:
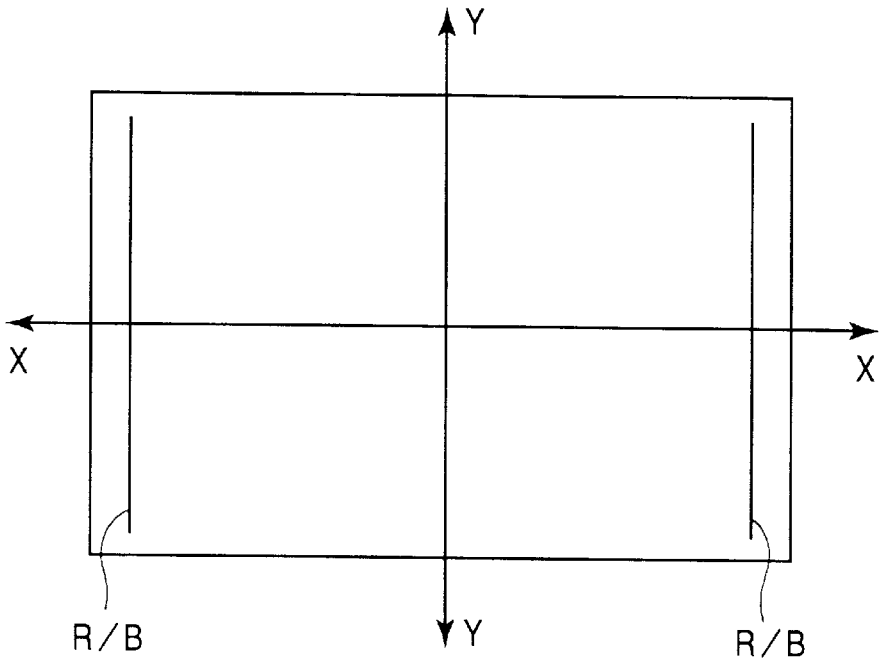
FIG. 21 is a schematic view showing a state where the misconvergence $X_H$ is compensated.

Referring to FIG. 14 and FIG. 58, a deflection yoke 308 generally comprises a separator 301 (101), a pair of saddle type horizontal deflection coils 302 (102) provided on an inner surface of the separator 301, a pair of saddle type vertical type horizontal deflection coils 303 on an outer surface of the separator 301 and a yoke core 304 to cover both the horizontal and vertical deflection coils as mentioned in the foregoing.

As explained referring to FIG. 14, the separator 301 (101) has a circular cone shape extended so as to have a bore gradually widened toward a front funnel 309F thereof. The separator 301 comprises a rear cylindrical portion 301R at a rear portion thereof for accommodating a rear bent-up portion of the horizontal deflection coils 302, an attachment portion 301P extended rearward from the rear cylindrical portion 301R, and a front cylindrical portion 301F provided at a front portion of the separator 301 for accommodating a front bent-up portion of the horizontal deflection coils 302. The deflection yoke 308 is mounted on the CRT between the front funnel 309F and the neck tube 309N and fixed to the CRT 309 by using a band 305 and the attachment portion 301P. The R, G, B electron beams emitted from the electron gun 310 provided in the neck tube 309N are deflected by the deflection yoke 380.

Further, as shown in FIG. 58, on a back surface 301RP of the rear cylindrical portion 301R of the separator 301, there is formed a pair of slots 311 at positions close to the neck tube 309N interposed therebetween, the slots 311extend along an X axis of the CRT 309 for holding a pair of first compensation magnetic plates 320 for compensating a misconvergence $X_H$. Further, a pair of VCR compensation coils 307 is provided on the back surface 301RP close to the neck tube 309N interposed therebetween, and the pair of VCR compensation coils 307 is arranged on a Y axis of the CRT 309.

Furthermore, a pair of second compensation magnetic plates 324 is provided at positions close to the neck tube 309N interposed therebetween, and the pair of second compensation magnetic plates 324 is arranged on the Y axis for compensating a misconvergence $Y_H$.

Next, the description is given of the compensation magnetic plates 320 Which is a main part of the fourth embodiment used in the deflection yoke of the present invention.

The compensation magnetic plates 320 are made of the same bond magnetic material mentioned in the first embodiment of the present invention.

As mentioned in the foregoing, in order to evaluate the magnetic characteristic of the bond magnetic material, a plurality of the compensation magnetic plates 320 shown in FIG. 59 were made and tested as follows.

Here, a reduction iron powder having an average particle diameter of 70 μm is used as the magnetic powder.

The reduction iron powder is pre-treated as follows:

reduction iron powder: 1 kg surface treatment agent: 40 g (polyurethane containing AQ monomer of 30 wt % and, the solvent density of the agent is 3 wt %)

Next, epoxy (containing a curing agent) of 20 g is added to the pre-treated reduction iron powder of 1 kg, and they are mixed to be dispersed, resulting in a granular powder having an average grain diameter of 74 μm.

The granular powder is molded by a metal mold, and the molded magnetic products were cured by being heated for 1 hour under a temperature of 160° C.

As a result, a compensation magnetic plate 320 of the AQ bond magnetic material having a thickness of 0.8 mm was obtained as shown in FIG. 59.

Around each of the compensation magnetic plate 320, a coil 322 of 20 turns was formed at an equal pitch to have a length of 15 mm by winding a magnet wire 321 of 2UEW (polyurethane enamel wire) having a diameter 0.3 mm as shown in FIG. 60.

The effective permeability μe of the compensation magnetic plate 320 was calculated by measuring the inductance of the coil 322.

The effective permeability thereof was also evaluated with respect to the comparative 1 made of permally and the comparative 2 made of silicon steel, each having a thickness of 0.4 mm, in the same manner as mentioned in the above embodiment.

These results are shown in Table 3.

TABLE 3

| | effective permeability (μe) | *value of resist. (longit. direc.) | **deviation of G beam |
|---|---|---|---|
| emb. | 8.5 | 1.8 MΩ/100 V | ***none |
| exam. 1 | 7.4 | 0.7 mΩ | about 0.5 mm |
| exam. 2 | 9.8 | 3.1 mΩ | about 0.3 mm |

*a value of resistance between distal ends of the compensation plate in the longitudinal direction.
**deviation of G (green color) beam in a right direction.
***in the left direction.
The effective permeability μe was obtained as follows.

μe=inductance of the coil wound around the compensation magnetic plate/inductance of the coil without the compensation magnetic plate In Table 3, there is shown a value of resistance between the distal ends of each of the test pieces in a longitudinal direction, wherein the value thereof is measured by applying a voltage of 100 V therebetween.

Figure 22:
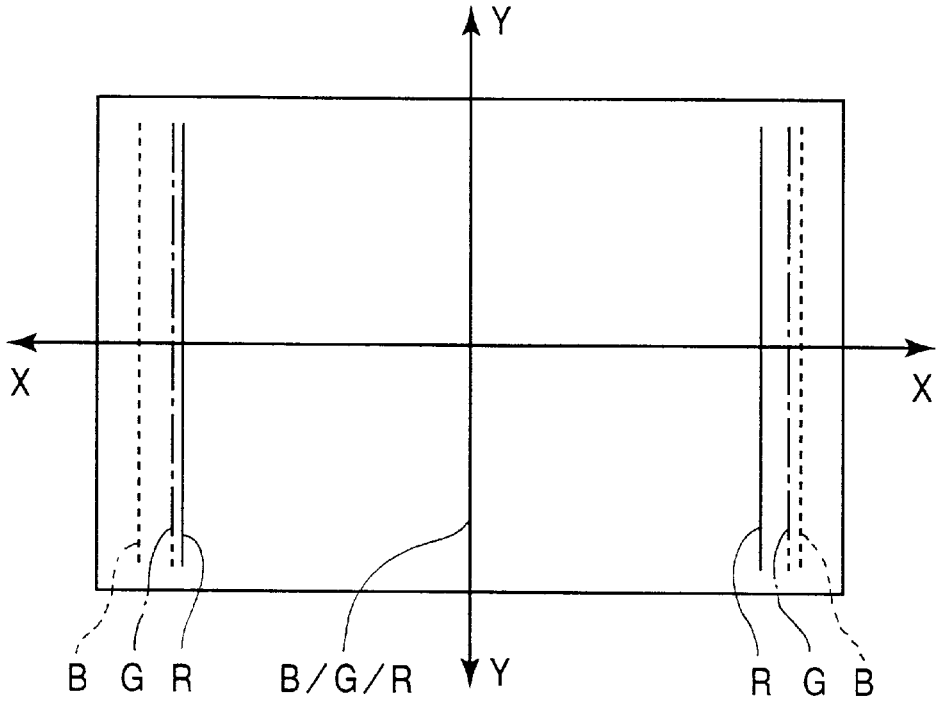
FIG. 22 is a schematic view showing a R, C, B misconvergence caused by the horizontal deflection magnetic field distribution shown in FIG. 16.
Figure 23:
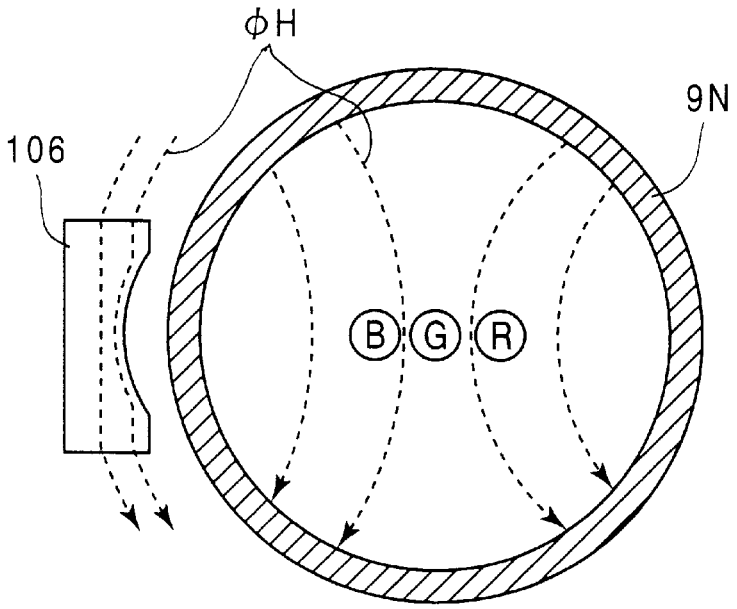
FIG. 23 is a schematic view showing a horizontal magnetic field distribution when the compensation magnetic plate is disposed closed to the B electron beam.
Figure 24:
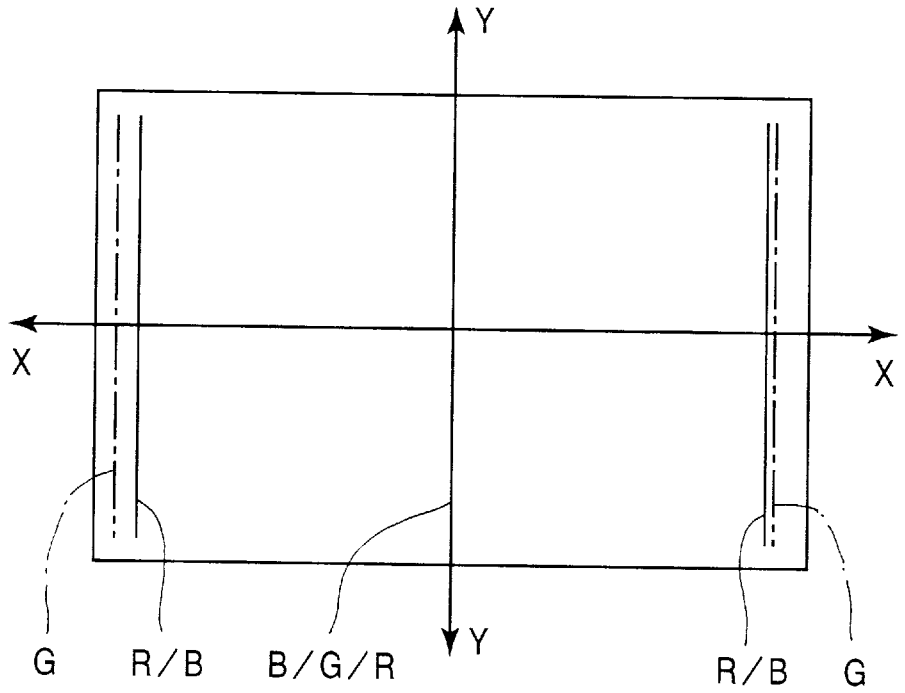
FIG. 24 is a schematic view showing a state neglecting an affect of an eddy current loss when the misconvergence $X_H$ is compensated by the compensation magnetic plate.

When the misconvergence $X_H$ shown in FIG. 22 is compensated by using the compensation magnetic plate 320 made of the AQ bond magnetic material, the permalloy or the silicon steel, an amount and the direction of deviation of the G electron beam to the R/B electron beam are shown in Table 3 as an embodiment, comparatives 1 and 2.

In the embodiment of the compensation magnetic plate 320, particles of the magnetic powder are uniformly coated with a thin layer containing the compound having aminoquinone group.

Thus, as seen from Table 3, the value of resistance between the both ends of the compensation magnetic plate 320 in the longitudinal direction of the embodiment is increased 10° times as large as that of the comparative 1 of the compensation magnetic plate 323 employing permalloy.

Thereby, the eddy current generated in the compensation magnetic plate 320 is extremely reduced in the high frequency range, so that the right-handed deviation of the G electron beam to the R/B electron beam is almost eliminated compared with the case where the compensation magnetic plate 323 is used. In addition, the symmetry of the misconvergence is improved because the G electron beams is deviated to the outside of the R/B electron beam to the same extent at the both distal ends of the picture.

Accordingly, even when a slight misconvergence is remained, it comes to readily eliminate it by using many kinds of compensation methods. Thus, it is possible to obtain the deflection yoke of the CRT having a high quality without a color deviation for a short time in a compensation process. Further, it is possible to reduce the production cost because fabrication yield increases.

Further, the surface treatment agent containing a compound having the aminoquinone group as a constitutional unit has a strong bonding force with polymers such as an epoxy resin used as a binder, resulting in a high mechanical strength and an excellent impact resistance even when a slight amount of the binder is used. Thus, it is easy to handle the compensation magnetic plate without generating crack and chipping. As a result, it is possible to reduce the thickness and the shape of the compensation magnetic plate because of a high charging density of the magnetic powder.

In the compensation magnetic plate 320 made of the AQ bond magnetic material, the larger the average particle diameter of the magnetic powder becomes, the larger the value of effective permeability becomes. However, on the contrary, the eddy current is increased. Thus, it is impossible to reduce the thickness thereof. This brings a problem of the mechanical strength. When the average particle diameter of the magnetic powder is as small as about 5 μm, the demagnetizing field is increased, so that the effective permeability is also decreased. This brings a difficulty of the required compensation of the misconvergence.

Accordingly, the average particle diameter of the magnetic powder used in the compensation magnetic plate 320 is preferably 10 μm to 200 μm.

In this embodiment, as the magnetic powder used in the compensation magnetic plate, the reducing iron powder is used, however, it is possible to use permalloy (Ni—Fe alloy), silicon iron or silicon steel (Fe—Si alloy), sendust (Fe—Si—Al alloy) and alperm (Fe—Al alloy) powders. The magnetic powder used is optionally selected among the above-mentioned materials in accordance with the specification.

These materials are referred to as soft ferromagnet, and the magnetic material used in the compensation magnetic plate is selected from such soft ferromagnet as an iron powder or iron-based magnetic powders.

Further, the concentration of the AQ monomer and a mixing rate of the thermosetting resin as the binder and the magnetic powder are not limited to those of the embodiment. When the mixing rate of the magnetic powder is less than 60 weight %, the effective permeability of the compensation magnetic plate is too small to maintain a necessary amount of the compensation. Thus, the mixing rate of the magnetic powder is preferably from not less than 60 weight % to less than 99.5 weight %.

As to the binder used, it is not limited to the epoxy resin irrespective of liquid or solid. As to the shape of the compensation magnetic plate, it is not limited to that of the embodiment. It is applicable to ones having the same operation and effectiveness as those of the embodiment.

In this embodiment, both the compensation magnetic plate 320 for the misconvergence $X_H$ and the soft magnetic plate 324 for the misconvergence $Y_H$ are formed by using the AQ bond magnetic material, however, it is possible to cause only one of them to be formed with the AQ bond magnetic material. Especially, it is preferable to form the compensation magnetic plate by using the AQ bond material to readily compensate the misconvergence $X_H$.

Fifth Embodiment

Figure 63:
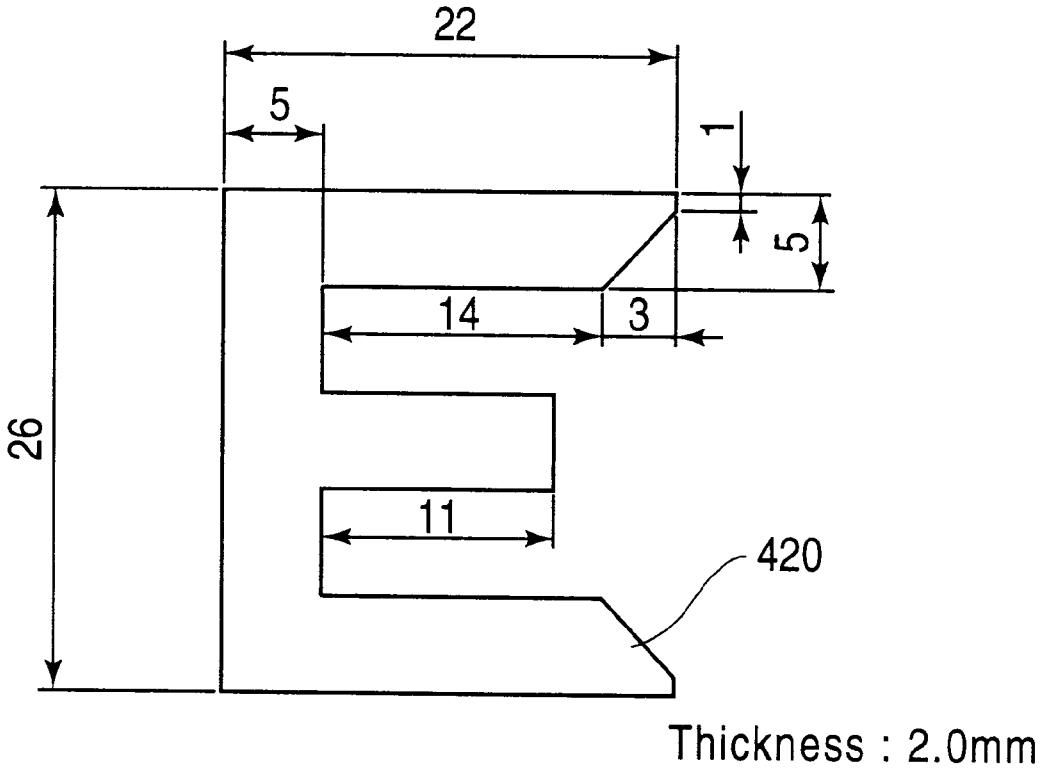
FIG. 63 is a plan view of an E-shaped magnetic core used in the deflection yoke of the present invention.

FIG. 62 is a back view of a deflection yoke of the fifth embodiment of the present invention;

FIG. 63 is a plan view of an E-shaped magnetic core used in the deflection yoke of the present invention.

In FIG. 62, a deflection yoke 470 of the fifth embodiment of the present invention generally comprises a separator 401 (corresponding to 201 in FIG. 28), a pair of saddle type horizontal deflection coils 402 (corresponding to 202 in FIG. 28) provided on an inner surface of the separator 401, a pair of saddle type vertical type horizontal deflection coils 403 on an outer surface of the separator 401 and a, yoke core 404 to cover both the horizontal and vertical deflection coils as mentioned in the foregoing.

Figure 28:
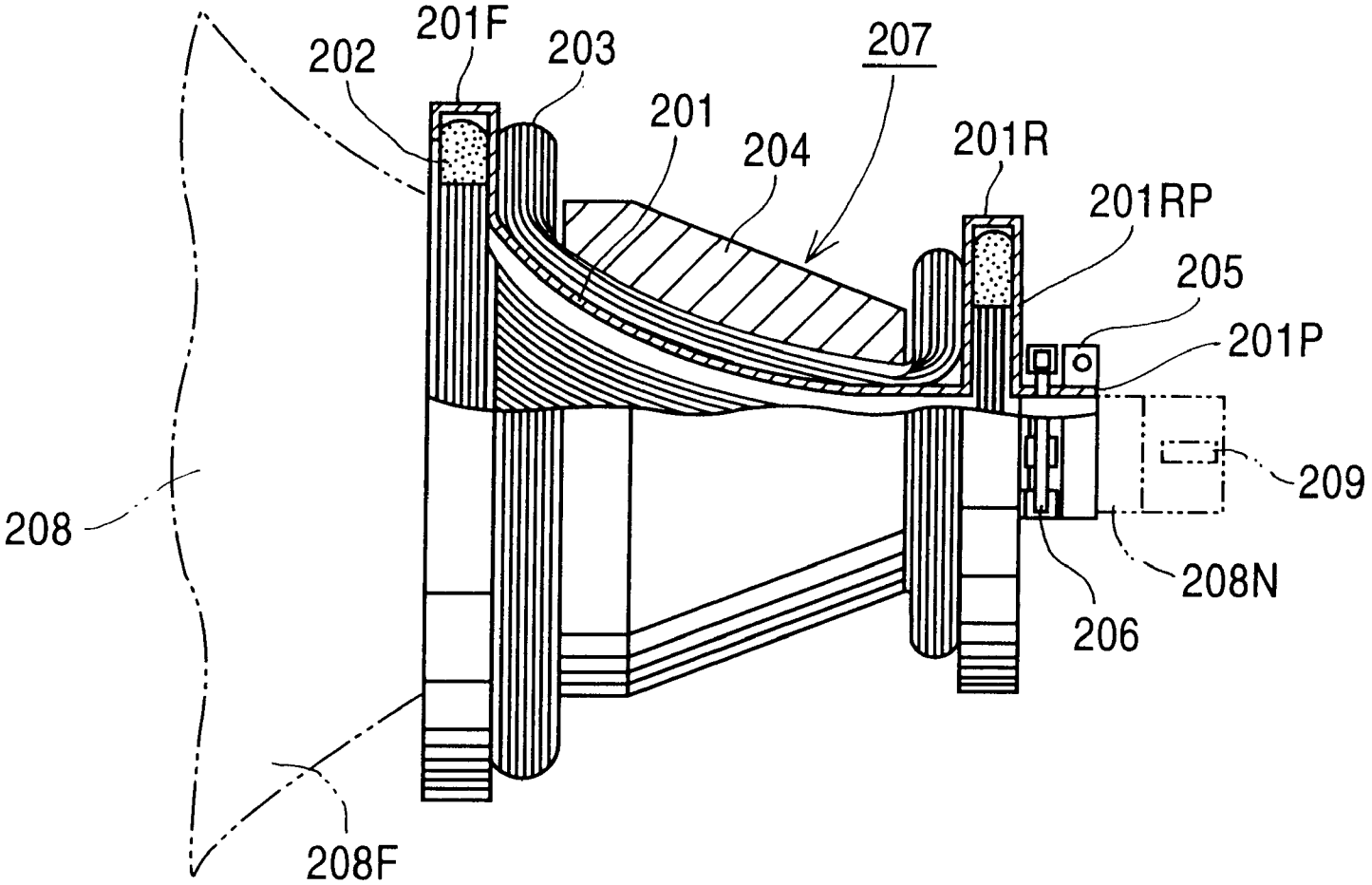
FIG. 28 is a partially broken section that is vertical to the section of FIG. 14, showing a deflection yoke mounted on the CRT.
Figure 29:
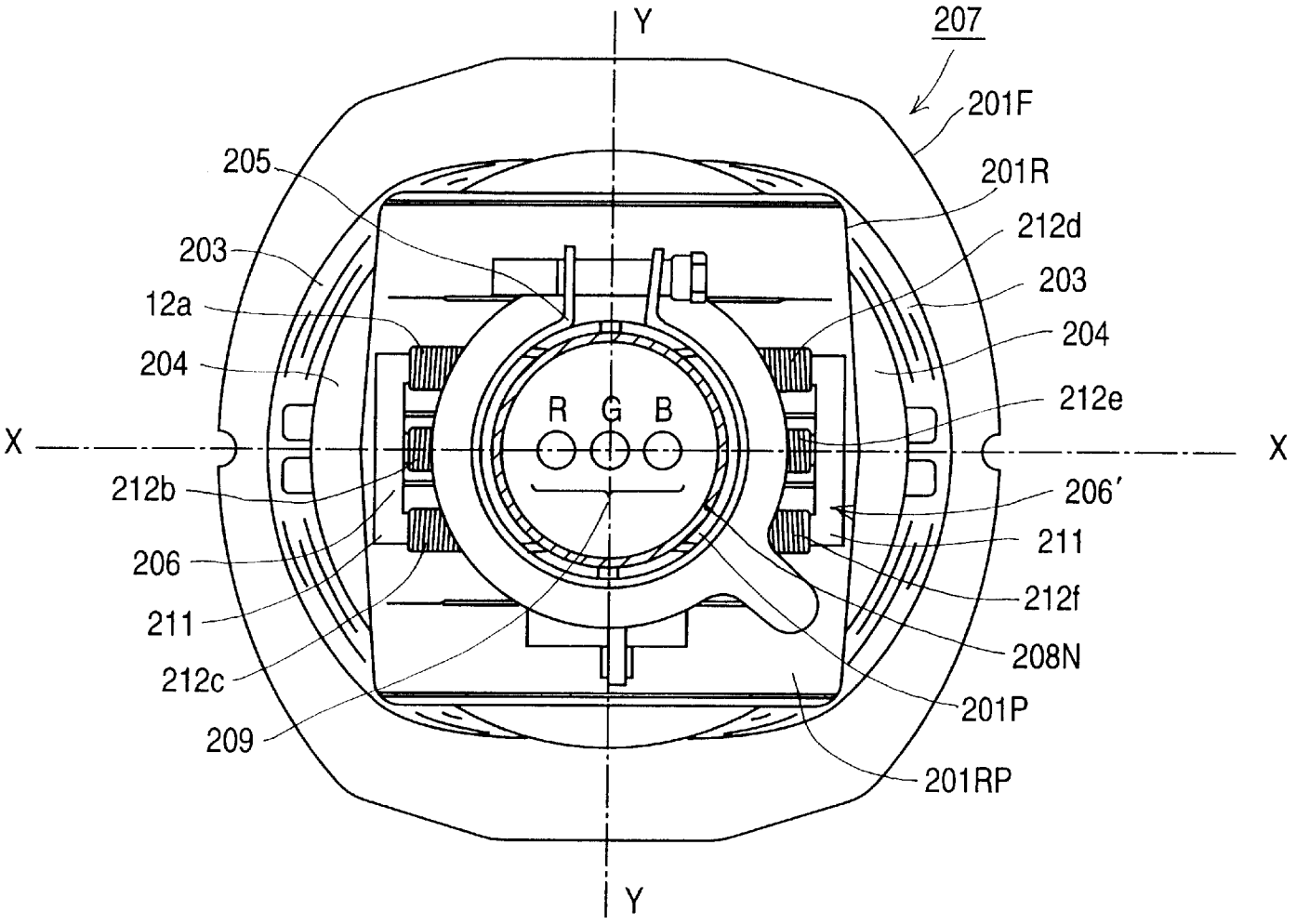
FIG. 29 is a right side view of FIG. 28.
Figure 30:
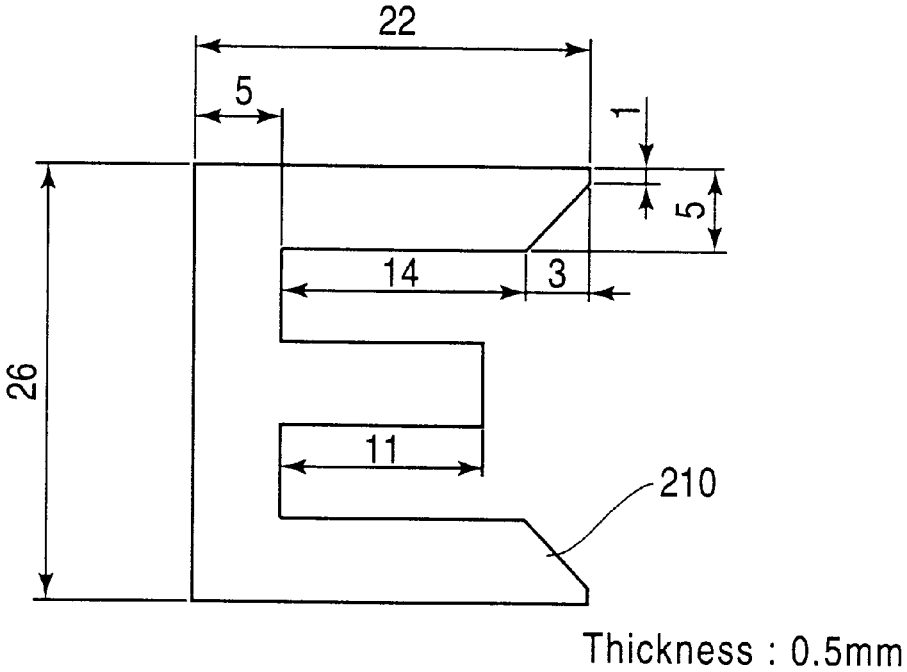
FIG. 30 is a plan view showing a soft magnetic plate used in an E-shaped magnetic core of a multi-pole coil.
Figure 31:
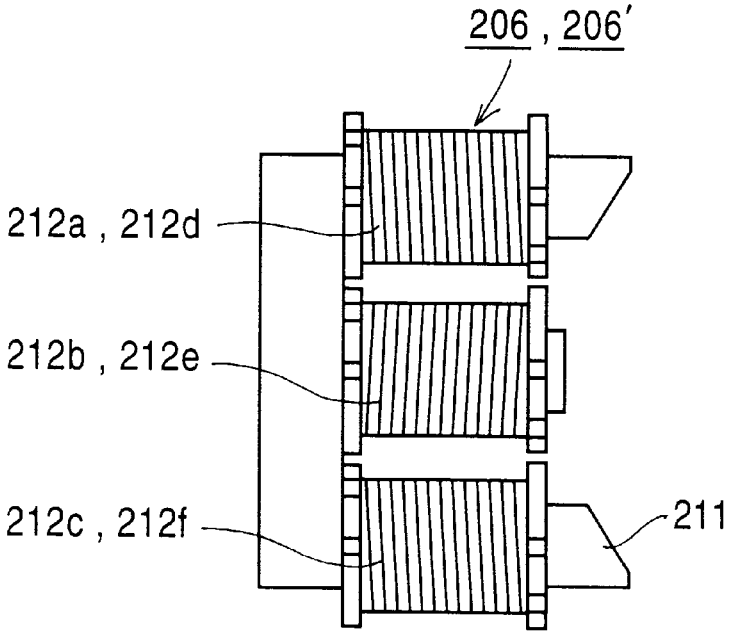
FIG. 31 is a plan view of the multi-pole coil.
Figure 32:
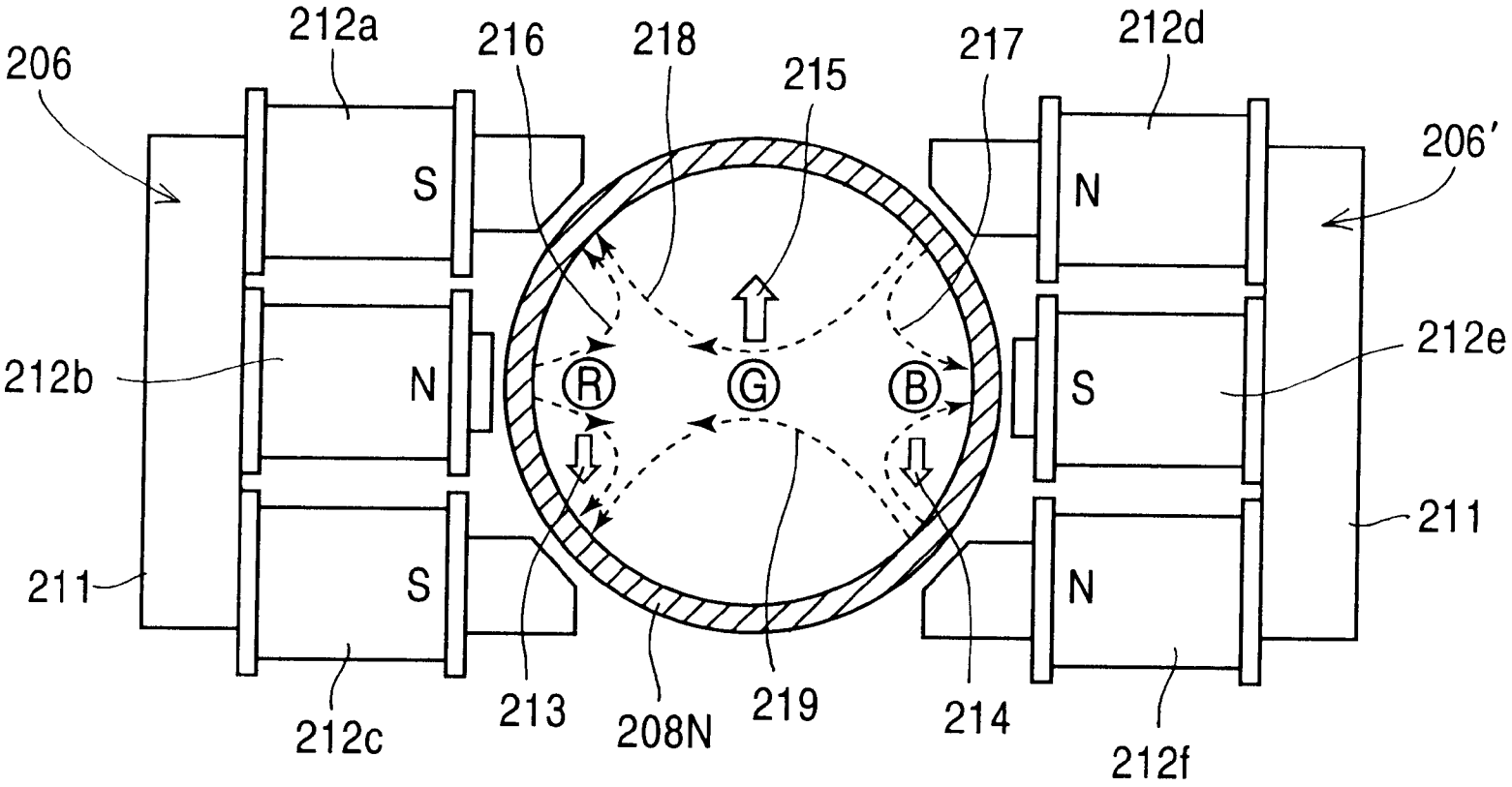
FIG. 32 is a schematic back view of the deflection yoke for explaining an operation of the multi-pole coils, wherein the deflection of the electron beams is performed with respect to an upper half of the picture.
Figure 33:
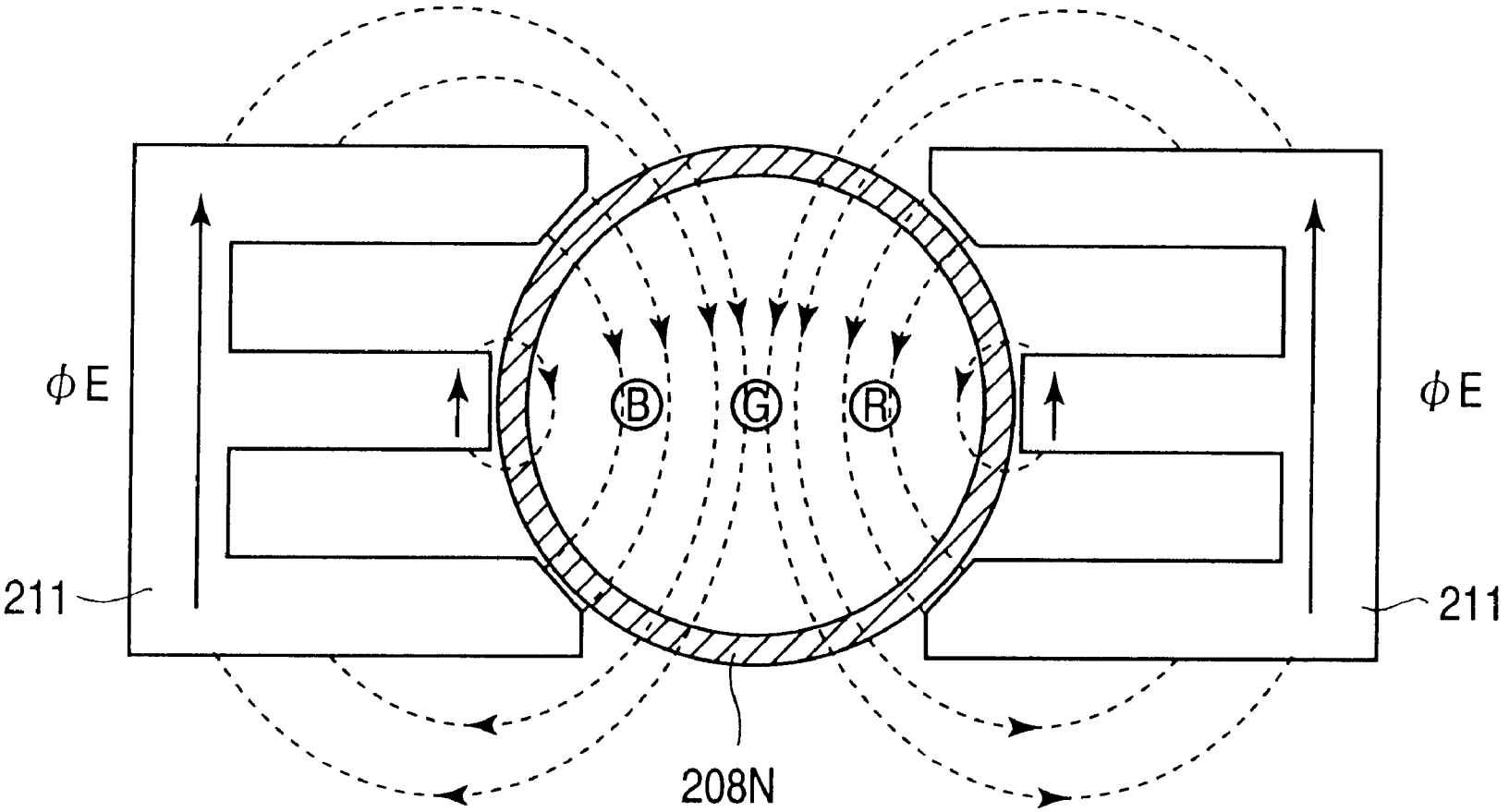
FIG. 33 is a schematic view showing a magnetic field generated by an eddy current of the E-shaped core.

As shown in FIG. 28, the separator 401 (corresponding to 201 in FIG. 28) has a circular cone shape extended so as to have a bore gradually widened toward a front funnel 408F (208F) thereof. The separator 401 (201) comprises a rear cylindrical portion 401R at a rear portion thereof for accommodating a rear bent-up portion of the horizontal deflection coils 403, an attachment portion 401P extended from the rear cylindrical portion 401R and a front cylindrical portion 401F provided at a front portion of the separator 401 (201) for accommodating a front bent-up portion of the horizontal deflection coils 402. The deflection yoke 470 is mounted on the CRT 408 (208) between the front funnel 408F, and the neck tube 408F and fixed to the CRT 408 by using a band 405 and the attachment portion 401P. The R, G, B electron beams emitted from the electron gun 409 provided in the neck tube 408N are deflected by the deflection yoke 470.

Further, as shown In FIG. 62, on a back surface 401RP of the rear cylindrical portion 401R of the separator 401 (201), there are disposed multi-pole coils (VCR compensation coil) 426, 426' on a back surface 401RP of the real cylindrical portion 401R of the separator 401 (201) at positions close to the neck tube 408N interposed between the multi-pole coils 426, 426' so as to compensate the misconvergence VCR.

Each of the multi-pole coils 426, 426' comprises an E-shaped magnetic core 420, coils 412*a* to 412*c* (412*d* to 412*f*) each wound around a leg of the E-shaped magnetic core 420.

In the same manner as mentioned in the magnetic compensation plate 320, the E-shaped magnetic core 420 having a thickness of 2.0 mm shown in FIG. 63 is made of the AC bond magnetic material.

The effective permeability μe of the E-shaped magnetic core 420 was calculated by measuring the inductance at the frequency of 1 kHz. As a comparative example, the E-shaped magnetic core 441 was obtained by stacking four sheets of soft magnetic plates made of a silicon steel having a thickness of 0.5 mm, and the effective permeability μe was calculated by measuring the inductance at the same frequency, by replacing the E-shaped core 420 in the same manner as mentioned above.

The results are shown in Table 4.

TABLE 4

| | effective permeability (μe) | *value of resist. (longit. direc.) | **deviation of G beam |
|---|---|---|---|
| emb. | 9.5 | 0.9 MΩ/100 V | ***none |
| exam. 1 | 10.0 | 0.09 mΩ | about 0.7 mm |

*a value of resistance between distal ends of the E-shaped magnetic core in the longitudinal direction.
**deviation of G (green color) beam in a right direction.
***in the left direction.

The effective permeability μe was obtained as follows.

μe=inductance of the coil wound around the E-shaped magnetic core/inductance of the coil without the E-shaped magnetic core In Table 4, there is shown a value of resistance between the distal ends of each of the test pieces in a longitudinal direction, wherein the value thereof is measured by applying a voltage of 100 V therebetween.

Figure 25:
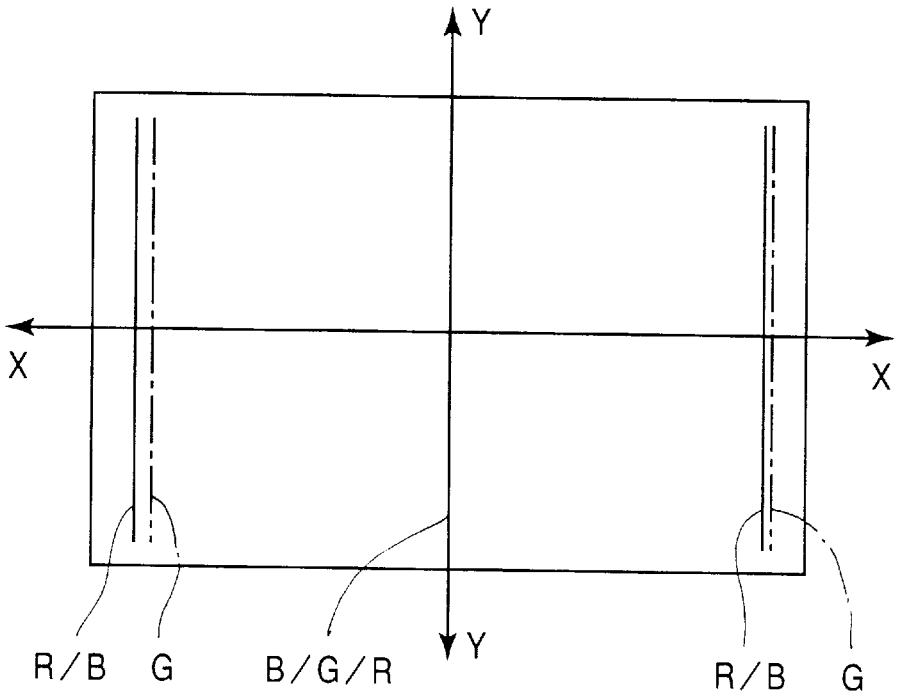
FIG. 25 is a schematic view showing a state considering an affect of an eddy current loss when the misconvergence $X_H$ is compensated by the compensation magnetic plate.
Figure 26:
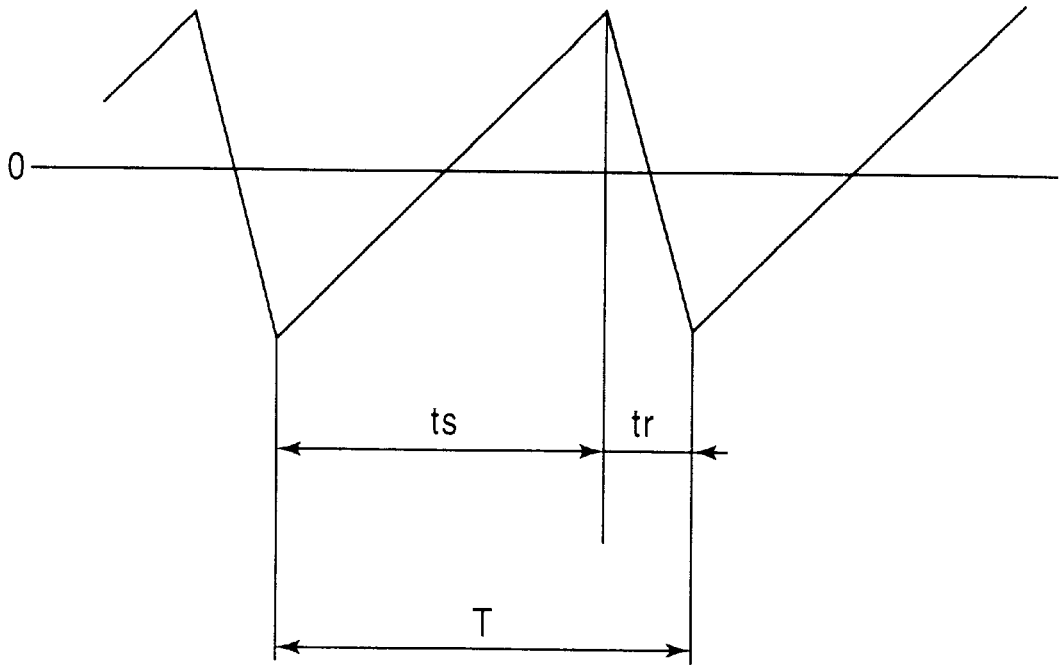
FIG. 26 is a schematic view showing a sawtooth current flowing through the horizontal deflection coil.
Figure 27:
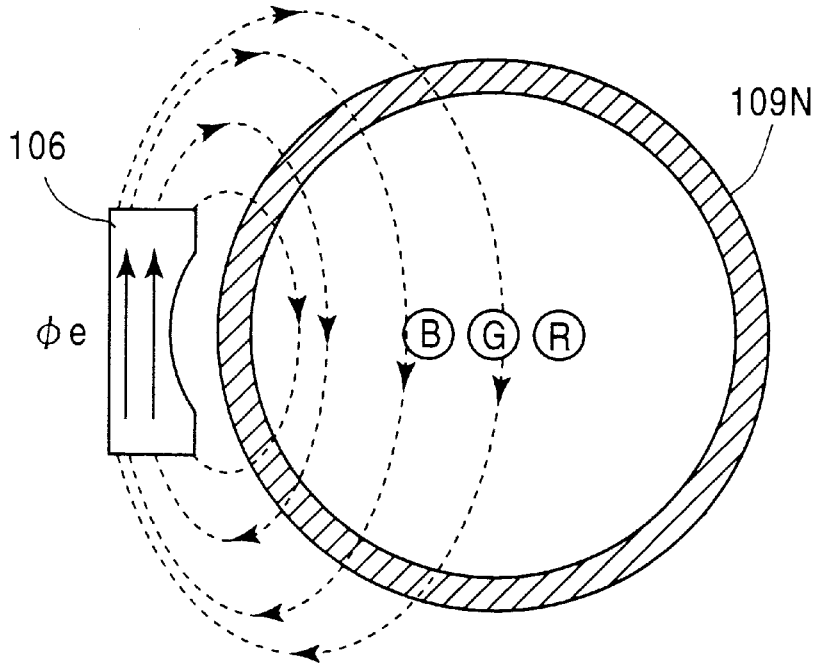
FIG. 27 is a schematic view showing a magnetic field caused by the eddy current flowing through the compensation magnetic plate.

When the misconvergence $X_H$ shown in FIG. 25 is compensated by using the E-shaped magnetic core 420 of the AQ bond magnetic material or the E-shaped magnetic core 211 of the silicon steel, an amount and the direction of deviation of the G electron beam to the R/B electron beam is shown in Table 4 with respect to the embodiment and the comparative. In the embodiment of the E-shaped magnetic core 420, particles of the magnetic powder are uniformly coated with a thin layer containing the compound having the aminoquinone group.

Thus, as seen from Table 4, the value of resistance between the both ends of the E-shaped magnetic core 420 in the longitudinal direction of the embodiment is increased 10° times as large as that of the comparative of the E-shaped magnetic core 211 employing silicon steel.

Thereby, the eddy current generated in the E-shaped magnetic core 420 is extremely reduced in the high frequency region, so that the right-handed deviation of the G electron beam to the R/B electron beam is almost eliminated compared with the comparative where the E-shaped magnetic core made of silicon steel plates is used.

Accordingly, even when a slight misconvergence is remained, it comes to readily eliminate it by using many kinds of compensation methods. Thus, it is possible to obtain the deflection yoke of the CRT having a high quality without a color deviation for a short time in a compensation process. Further, it is possible to reduce the production cost because fabrication yield increases.

Further, the surface treatment agent containing a compound having the aminoquinone group as a constitution unit has a strong bonding force with polymers such as an epoxy resin used as a binder, resulting in a high mechanical strength and an excellent impact resistance even when a slight amount of the binder is used. Thus, it is easy to handle the E-shaped magnetic core 420 without generating crack and chipping. As a result, it is possible to reduce the thickness and the shape of the E-shaped magnetic core because of a high charging density of the magnetic powder.

In the E-shaped magnetic core 420 made of the AQ bond magnetic material, the larger the average particle diameter of the magnetic powder becomes, the larger the value of effective permeability becomes. However, on the contrary, the eddy current is increased. Thus, it is impossible to reduce the thickness thereof. This brings a problem of the mechanical strength. When the average particle diameter of the magnetic powder is as small as about 5 $\mu$m, the demagnetizing field is increased, so that the effective permeability is decreased. This brings a difficulty of the required compensation of the misconvergence.

Accordingly, the average particle diameter of the magnetic powder used in the E-shaped magnetic core 420 is preferably 10 $\mu$m to 200 $\mu$m.

As to the effective permeability, it is large enough to compensate the misconvergence when the effective permeability is more than 8.

In this embodiment, as the magnetic powder used in the E-shaped magnetic core 420, the reducing iron powder is used, however, it is possible to use permalloy (Ni—Fe alloy), silicon iron or silicon steel (Fe—Si alloy), sendust (Fe—Si—Al alloy) and alperm (Fe—Al alloy) powders. The magnetic powder used is optionally selected among the above-mentioned materials in accordance with the specification.

These materials are referred to as soft ferromagnet, and the magnetic material used in the E-shaped magnetic core 420 is selected from such soft ferromagnet as an iron powder or iron-based magnetic powders.

Further, the density of the AQ monomer and a mixing rate of the thermosetting resin as the binder and the magnetic powder are not limited to those of the embodiment. When the mixing rate of the magnetic powder is less than 60 weight %, the effective permeability of the E-shaped magnetic core 420 is too small to maintain a necessary amount of the compensation. Thus, the mixing rate of the magnetic powder is preferably from not less than 60 weight % to less than 99.5 weight %.

As to the binder used, it is not limited to the epoxy resin irrespective of liquid or solid. As to the shape of the E-shaped magnetic core 420, it is not limited to that of the embodiment. It is applicable to ones having the same operation and effectiveness as those of the embodiment.

In this embodiment, the multi-pole tore 426, 426' equipped with the E-shaped magnetic core 420 is formed by using the AQ bond magnetic material, however, the shape of magnetic core is not limited to the E-shaped. U-shape or I-shape may be formed by using the AQ bond material.

What is claimed is:

1. A deflection yoke for deflecting an electron beam emitted from an electron gun of a CRT (cathode ray tube), the deflection yoke being mounted on the CRT at a position between a neck tube having a small diameter section and a funnel having a large diameter section of the CRT, the deflection yoke comprising:

a horizontal deflection coil for deflecting the electron beam in a horizontal direction in the CRT;

a vertical deflection coil for deflecting the electron beam in a vertical direction in the CRT; and a yoke core having a cone shape with a large diameter part at one end thereof in a side of the funnel and a small diameter part at another end thereof in a side of the neck tube to allow the yoke core to cover the horizontal and vertical deflection coils, the yoke core being made of a molded magnetic material cured by heating, the molded magnetic material including a binder comprising a resin and a magnetic powder treated with a surface treatment agent comprising a compound having an aminoquinone group as a constitution unit, the aminoquinone group being selected from a group of the aminoquinone groups shown with formulas (1) and (2), (1)

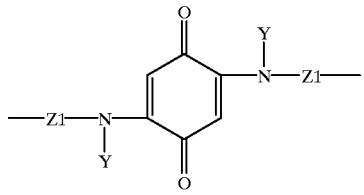

(2)

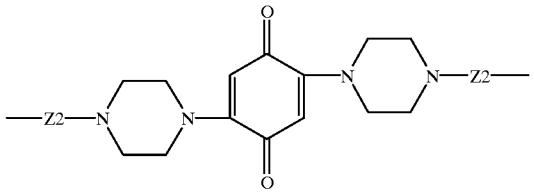

wherein

Y: hydrogen atom, $C_1$~$C_6$ alkyl group having at least one selected from a group of a straight chain, a cyclic chain, and a branched chain, aralkyl group, phenyl group, Z1: $C_2$~$C_{16}$ alkylene group, phenylene group, aralkyl group, alkarilene group, —($CH_2CH_2$—O)n —$CH_2$—$CH_2$— (n: integer 1–50), and Z2: $C_1$~$C_6$ alkylene group having at least one selected from a group of a straight chain and a branched chain.

2. A deflection yoke as claimed in claim 1, wherein the surface treatment agent further comprises a cylane coupling agent.

3. A deflection yoke as claimed in claim 1, wherein the binder further comprises a cylane coupling agent.

4. A deflection yoke as claimed in claim 1, wherein thicknesses of the small and large diameter parts of the yoke core are respectively determined so as to cause an operational magnetic flux density of magnetic flux flowing through the small diameter part of the yoke core being approximately equal to that flowing through the large diameter section.

5. A deflection yoke as claimed in claim 1, wherein the yoke core is provided with four humps at respective four diagonal positions on a conical surface of the cone shape, and the four diagonal positions radially correspond to a pair diagonal lines on a display surface of the CRT, and the four humps extend from the small diameter part in such a manner that a height of each of the humps is gradually reduced toward the large diameter part to allow a magnetic flux density of magnetic flux flowing through the yoke core to be approximately uniformed through the sections of the yoke core crossing perpendicular to an axis of the neck tube.

6. A deflection yoke as claimed in claim 1, wherein a protruding portion is provided on an inner surface of the yoke core.

7. A deflection yoke as claimed in claim 1, wherein a dent is provided in an inner surface of the yoke core.

8. A deflection yoke as claimed in claim 1, wherein a shape of the large diameter part of the yoke core is made to be approximately rectangular.

9. A deflection yoke as claimed in claim 1, wherein a shape of the large diameter part of the yoke core is made to be approximately ellipsoidal.

10. A deflection yoke as claimed in claim 1, wherein grooves are defined and distributed radially on an inner surface of the yoke core for winding a coil, and wherein the grooves extend from the small diameter part to the large diameter part of the yoke core.

11. A deflection yoke as claimed in claim 10, wherein a cutout is defined on a protruding portion interposed between adjacent grooves in such a manner that a plurality of the cutout constitutes a circular shape.

12. A yoke core used in a deflection yoke for deflecting an electron beam emitted from an electron gun of a CRT (cathode ray tube), the yoke core being mounted on the CRT at a position between a neck tube and a funnel of the CRT, wherein the yoke core has a cone shape with a large diameter part at one end thereof in a side of the funnel and a small diameter part at another end thereof in a side of the neck tube to allow the yoke core to cover the horizontal and vertical deflection coils, and the yoke core is made of a molded magnetic material cured by heating, and the molded magnetic material includes a binder comprising a resin and a magnetic powder treated with a surface treatment agent which comprises a compound having an aminoquinone group as a constitution unit, and the aminoquinone group is selected from a group of the aminoquinone groups shown with formulas (1) and (2), (1)

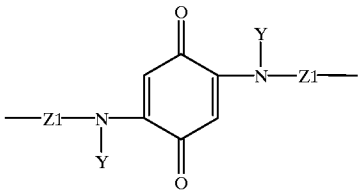

(2)

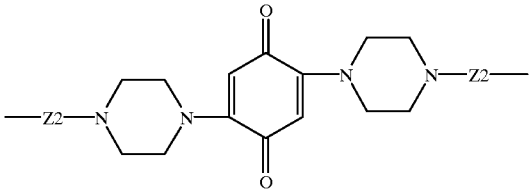

wherein

Y: hydrogen atom, $C_1$~$C_6$ alkyl group having at least one selected from a group of a straight chain, a cyclic chain, and a branched chain, aralkyl group, phenyl group, Z1: $C_2$~$C_{16}$ alkylene group; phenylene group, aralkyl group, alkarilene group, —($CH_2CH_2$—O)n —$CH_2$—$CH_2$— (n: integer 1–50), and Z2: $C_1$~$C_6$ alkylene group having at least one selected from a group of a straight chain and a branched chain.

13. A yoke core as claimed in claim 12, wherein the surface treatment agent further comprises a cylane coupling agent.

14. A yoke core as claimed in claim 12, wherein the binder further comprises a cylane coupling agent.

15. A yoke core as claimed in claim 12, wherein thicknesses of the small and large diameter parts of the yoke core are respectively determined so as to cause an operational magnetic flux density of magnetic flux flowing through the small diameter part of the yoke core being approximately equal to that flowing through the large diameter section.

16. A yoke core as claimed in claim 12, wherein the yoke core is provided with four humps at respective four diagonal positions on a conical surface of the cone shape, and the four diagonal positions radially correspond to a pair diagonal lines on a display surface of the CRT, and the four humps extend from the small diameter part in such a manner that a height of each of the humps is gradually reduced toward the large diameter part to allow a magnetic flux density of magnetic flux flowing through the yoke core to be approximately uniformed through the sections of the yoke core crossing perpendicular to an axis of the neck tube.

17. A yoke core as claimed in claim 12, wherein a protruding portion is provided on an inner surface of the yoke core.

18. A yoke core as claimed in claim 12, wherein a dent is provided in an inner surface of the yoke core.

19. A yoke core as claimed in claim 12, wherein a shape of the large diameter part of the yoke core is made to be approximately rectangular.

20. A yoke core as claimed in claim 12, wherein a shape of the large diameter part of the yoke core is made to be approximately ellipsoidal.

21. A yoke core as claimed in claim 12, wherein grooves are defined and distributed radially on an inner surface of the yoke core for winding a coil, and wherein the grooves extend from the small diameter part to the large diameter part of the yoke core.

22. A yoke core as claimed in claim 21, wherein a cutout is defined on a protruding portion interposed between adjacent grooves in such a manner that a plurality of the cutout constitutes a circular shape.

23. A deflection yoke mounted on a color CRT (cathode ray tube) for deflecting plural electron beams emitted from electron guns disposed in line in the color CRT, the deflection yoke being equipped with a compensation magnetic plate for compensating a misconvergence generated on a display panel of the CRT, wherein the compensation magnetic plate is made of a molded magnetic product cured by heating, and the molded magnetic product includes a binder comprising a resin and a magnetic powder treated with a surface treatment agent which comprises a compound having an aminoquinone group as a constitutional unit, and the aminoquinone group is selected from a group of the aminoquinone groups shown with formulas (1) and (2), (1)

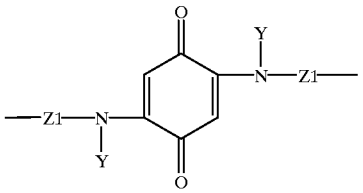

(2)

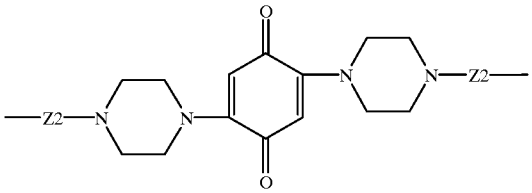

wherein

Y: hydrogen atom, $C_1$~$C_6$ alkyl group having at lest one selected from a group of a straight chain, a cyclic chain, and a branched chain, aralkyl group, phenyl group, Z1: $C_2$~$C_{16}$ alkylene group, phenylene group, aralkyl group, alkarilene group, —($CH_2CH_2$—O)n —$CH_2$—$CH_2$— (n: integer 1–50), and Z2: $C_1$~$C_6$ alkylene group having at least one selected from a group of a straight chain and a branched chain.

24. A deflection yoke as claimed in claim 23, wherein an average particle diameter of the magnetic powder is made to be 10 $\mu$m to 200 $\mu$m.

25. A deflection yoke as claimed in claim 23, wherein a weight ratio of the magnetic powder in the magnetic plate is made to be not less than 60%.

26. A deflection yoke as claimed in claim 23, wherein a weight ratio of the compound having the aminoquinone group as a constitutional unit to the magnetic powder is made to be not less than 0.1%.

27. A deflection yoke mounted on a color CRT (cathode ray tube) for deflecting plural electron beams emitted from electron guns disposed in line in the color CRT, the deflection yoke being equipped with a magnetic core on which coils are wound for compensating a misconvergence generated on a display panel of the CRT, wherein the magnetic core is made of a molded magnetic product cured by heating, and the molded magnetic product includes a binder comprising a resin and a magnetic powder treated with a surface treatment agent which comprises a compound having an aminoquinone group as a constitutional unit, and the aminoquinone group is selected from a group of the aminoquinone groups shown with formulas (1) and (2), (1)

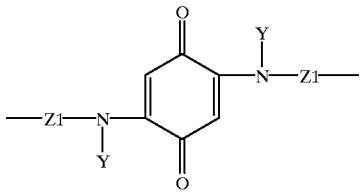

(2)

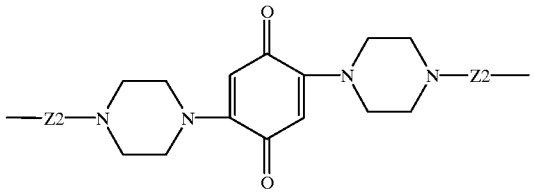

wherein

Y: hydrogen atom, $C_1$~$C_6$ alkyl group having at least one selected from a group of a straight chain, a cyclic chain, and a branched chain, aralkyl group, phenyl group, Z1: $C_2$~$C_{16}$alkylene group, phenylene group, aralkyl group, alkarilene group, —($CH_2CH_2$—O)n —$CH_2$—$CH_2$— (n: integer 1–50), and Z2: $C_1$~$C_6$ alkylene group having at least one selected from a group of a straight chain and a branched chain.

28. A deflection yoke as claimed in claim 27, wherein an average particle diameter of the magnetic powder is made to be less than 250 $\mu$m.

29. A deflection yoke as claimed in claim 27, wherein a weight ratio of the magnetic powder in the magnetic core is made to be not less than 60%.

30. A deflection yoke as claimed in claim 27, wherein a weight ratio of the compound having the aminoquinone group as a constitutional unit to the magnetic powder is made to be not less than 0.1%.

* * * * *